US009340030B2

(12) United States Patent
Nagashima et al.

(10) Patent No.: US 9,340,030 B2
(45) Date of Patent: May 17, 2016

(54) LIQUID CONTAINER

(71) Applicant: SEIKO EPSON CORPORATION, Tokyo (JP)

(72) Inventors: Takumi Nagashima, Shiojiri (JP); Yuji Aoki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/487,959

(22) Filed: Sep. 16, 2014

(65) Prior Publication Data

US 2015/0077485 A1 Mar. 19, 2015

(30) Foreign Application Priority Data

Sep. 17, 2013 (JP) ..... 2013-191454

(51) Int. Cl.
*B41J 2/175* (2006.01)

(52) U.S. Cl.
CPC ..... *B41J 2/1752* (2013.01); *B41J 2/17553* (2013.01)

(58) Field of Classification Search
CPC ..... B41J 2/1752
See application file for complete search history.

(56) References Cited

U.S. PATENT DOCUMENTS

| | | | | |
|---|---|---|---|---|
| 2007/0242115 | A1 | 10/2007 | Ishizawa et al. | |
| 2010/0225704 | A1* | 9/2010 | Aoki et al. | 347/50 |
| 2013/0176367 | A1* | 7/2013 | Morino et al. | 347/86 |

FOREIGN PATENT DOCUMENTS

| | | | |
|---|---|---|---|
| JP | 2007-301979 | A | 11/2007 |
| JP | 2010-253688 | A | 11/2010 |
| JP | 5262950 | B | 5/2013 |
| JP | 2013-154647 | A | 8/2013 |

* cited by examiner

*Primary Examiner* — Justin Seo
(74) *Attorney, Agent, or Firm* — Stroock & Stroock & Lavan LLP

(57) ABSTRACT

A liquid container can be smoothly mounted to a mounting portion, and the liquid container is reliably locked when mounting is complete. The liquid container includes: a first surface that is on a side in a direction of insertion (+Y direction); a second surface that opposes the first surface; a third surface that intersects the first surface and the second surface and has formed therein a groove portion that can engage with a lever member; a fourth surface that opposes the third surface; and lower protruding wall portions that are provided on at least one of the third surface and the fourth surface, and are positioned by guide surfaces of lower guide ribs of the mounting portion when the ink cartridge is locked by engagement of the groove portion with the lever member due to the ink cartridge moving in the direction of insertion into the mounting portion.

13 Claims, 33 Drawing Sheets

FIG. 8B
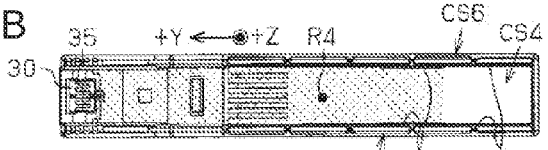
FIG. 8C
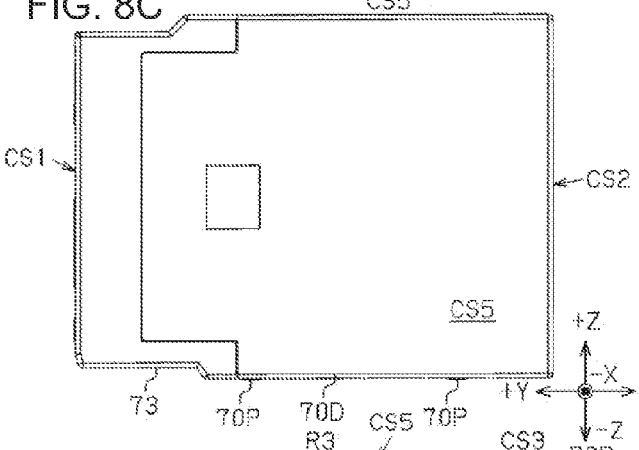
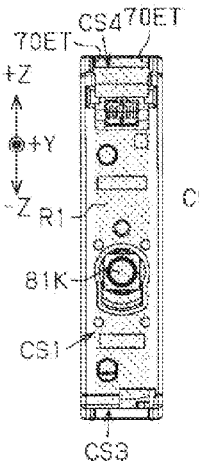
FIG. 8A
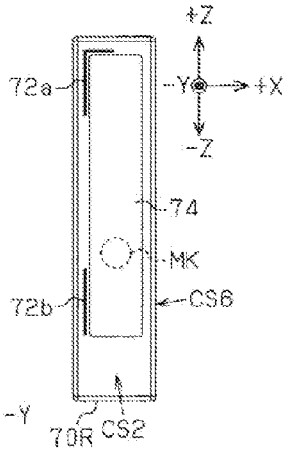
FIG. 8E
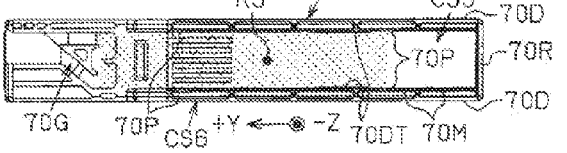
FIG. 8D

LIQUID CONTAINER

BACKGROUND

1. Technical Field

The invention relates to a liquid container that has a liquid storage chamber capable of storing a liquid and is removably mounted to a mounting portion provided in a liquid consuming apparatus.

2. Related Art

There are heretofore-known inkjet-type printers (liquid consuming apparatuses) that consume ink (a liquid) by ejecting it and can receive mounting of an ink cartridge (liquid container) provided with an ink chamber (liquid storage chamber) capable of storing ink that is to be consumed. In these printers, the ink cartridge that is to be mounted to the mounting portion is preferably mounted without positional shift.

In view of this, known ink cartridges have been configured such that the mounting position in the mounting portion (container holder), which has guiding ribs extending in the ink cartridge insertion direction, is determined by projection portions provided on the case member of the ink cartridge being brought into contact with the guiding ribs. The ink cartridge is configured such that when it is mounted to the mounting portion, a movable lock portion (fixing member) provided on the mounting portion becomes locked by engagement with a groove portion (guiding groove) provided in the ink cartridge, and thus the mounting position in the mounting portion is fixed (e.g., see JP-A-2010-253688).

However, known ink cartridges having the above configuration are configured such that the mounting position in the width direction that intersects the ink cartridge insertion direction is determined by the projection portions provided on one side of the case member of the ink cartridge. Accordingly, on the side opposite to the side where the projection portions are provided, it is possible for a situation to occur in which the position where the case member of the ink cartridge comes into contact with the guiding ribs is not likely to be determined due to warping of the case member, manufacturing variations, or the like. It is thus possible for a situation to occur in which due to positional shift of the ink cartridge in the width direction that intersects the insertion direction, the position of the groove portion of the ink cartridge becomes shifted relative to the movable lock portion, and the groove portion and the movable lock portion are not engaged correctly. As a result, it is difficult to smoothly mount the ink cartridge to the mounting portion, and it is difficult to determine the mounting position of the ink cartridge in the mounting portion.

Note that these actual situations are not limited to ink cartridges mounted to inkjet-type printers, but rather are generally common to liquid containers mounted to mounting portions provided in liquid consuming apparatuses.

SUMMARY

An advantage of some aspects of the invention is the provision of a liquid container that is smoothly mounted to a mounting portion and is reliably locked to the mounting portion when mounting is complete.

The following describes means for solving the above problems and the effects and advantages of such means.

A liquid container that solves the above problems is a liquid container having a liquid storage chamber configured to store a liquid, the liquid container being configured to be removably mounted to a mounting portion of a liquid consuming apparatus that includes a guide rail having a guide surface that guides insertion and removal of the liquid container and a movable lock portion that locks the liquid container when the liquid container is inserted, the liquid container including: a first surface that has formed therein a liquid supply opening through which the liquid can flow from the liquid storage chamber to the liquid consuming apparatus, and is on a side in a direction of insertion into the mounting portion; a second surface that opposes the first surface; a third surface that intersects the first surface and the second surface and has formed therein a groove portion configured to engage with the movable lock portion; a fourth surface that opposes the third surface; and a positioning portion that is provided on at least one of the third surface and the fourth surface, and is positioned by the guide surface of the guide rail of the mounting portion when the liquid container is locked by engagement of the groove portion with the movable lock portion due to the liquid container moving in the direction of insertion into the mounting portion.

According to this configuration, the liquid container is positioned when mounted in the mounting portion due to the groove portion being locked to the movable lock portion, and thus the liquid container is smoothly mounted to the mounting portion, and the liquid container is reliably locked in the mounting portion when mounting is complete.

In the above liquid container, it is preferable that the positioning portion positions the liquid container in a direction that intersects the insertion direction.

According to this configuration, when the liquid container is inserted into and mounted to the mounting portion, rotation of the liquid container in a direction that intersects the insertion direction is restricted, and thus the groove portion is reliably engaged to the movable lock portion when the liquid container is mounted.

In the above liquid container, it is preferable that the liquid container further includes: a protrusion portion that has an opposing surface that opposes the guide surface of the guide rail when the liquid container is mounted to the mounting portion, wherein the positioning portion is provided on the protrusion portion.

According to this configuration, the liquid container is guided to due to the opposing surface of the protrusion portion opposing the guide surface of the guide rail, and the groove portion reliably engages with the movable lock portion and is reliably locked by the movable lock portion due to the positioning portion provided on the protrusion portion.

In the above liquid container, it is preferable that a plurality of positioning portions are arranged so as to be located at positions that sandwich the guide rail when the liquid container is mounted to the mounting portion.

According to this configuration, the positioning portions of the liquid container are respectively located on the two sides of the guide rail, and thus the liquid container can be more reliably positioned in the mounting portion.

In the above liquid container, it is preferable that the positioning portions are provided on the third surface, and the groove portion is provided in an extension region that is an extension in the insertion direction of a surface region sandwiched by the positioning portions.

According to this configuration, positional shift of the groove portion and the movable lock portion is suppressed, thus making it possible to more reliably lock the groove portion and the movable lock portion.

In the above liquid container, it is preferable that the positioning portions are provided on the fourth surface, and an electrical connection portion that performs electrical connection with the liquid consuming apparatus is provided in an extension region that is an extension in the insertion direction of a surface region sandwiched by the positioning portions.

According to this configuration, the electrical connection portion of the liquid container is provided in the extension region of the surface sandwiched between the positioning portions, and thus electrical connection with the electrical connecting portion on the liquid consuming apparatus side can be performed more reliably due to being positioned by the positioning portions.

In the above liquid container, it is preferable that the liquid supply opening is arranged in a surface region of the first surface, the surface region intersecting the extension region of the surface region sandwiched by the positioning portions provided on the third surface and the extension region sandwiched by the positioning portions provided on the fourth surface.

According to this configuration, the liquid supply opening is also positioned in a state in which positional shift is suppressed by the positioning portions, and thus is reliably connected to the liquid consuming apparatus.

In the above liquid container, it is preferable that the liquid container further includes: an extended surface that extends in a direction that intersects the first surface, the third surface, and the fourth surface, wherein the extended surface is provided with a guide wall portion that is guided by a guide projection provided on the mounting portion.

According to this configuration, the liquid container can be inserted so as to be guided by the guide projection when inserted into the mounting portion, thus making it possible to mount the liquid container at an appropriate position in the mounting portion.

In the above liquid container, it is preferable that the mounting portion of the liquid consuming apparatus is provided with a guide projection on each of two sides in an intersection direction that intersects the insertion direction of the liquid container relative to the guide rail, and the liquid container further includes: a protrusion portion configured to be inserted between the guide rail and the guide projection and be guided by the guide rail when the liquid container is inserted into the mounting portion; and a recession portion that is provided on a side opposite to the guide rail in the intersection direction of the protrusion portion, and is configured to receive insertion of a guide projection when the liquid container is mounted to the mounting portion.

According to this configuration, the protrusion portion is guided by the guide rail, and the guide projection is inserted into the recession portion, thus making it possible to easily mount the liquid container at an appropriate position during insertion into the mounting portion.

In the above liquid container, it is preferable that the protrusion portion and the recession portion are provided on one surface.

According to this configuration, when the liquid container is inserted, insertion is difficult if a surface different from the one surface provided with the protrusion portion and the recession portion is on the guide rail and guide projection side, thus suppressing improper insertion of the liquid container into the mounting portion.

BRIEF DESCRIPTION OF THE DRAWINGS

The invention will be described with reference to the accompanying drawings, wherein like numbers reference like elements.

FIG. 6A is a plan view, FIG. 6B is a cross-sectional view as seen along arrows A-A in FIG. 6A, and FIG. 6C is an enlarged view of a portion indicated by an arrow 6*c* in FIG. 6B.

FIGS. 8A to 8E are diagrams showing surfaces of the ink cartridge.

FIG. 10A is a partial plan view, and FIG. 10B is a cross-sectional view as seen along arrows B-B in FIG. 10A.

FIG. 17A is a side view of the ink container, FIG. 17B is a cross-sectional view as seen along arrows C-C in FIG. 17A, and FIG. 17C is a cross-sectional view as seen along arrows D-D in FIG. 17A.

FIG. 18A is a plan view of the ink container, and FIG. 18B is a cross-sectional view as seen along arrows E-E in FIG. 18A.

FIG. 21A shows a state before the supply member is inserted into a through-hole in the case member, FIG. 21B shows a state in which the supply member has been inserted into the through-hole, and FIG. 21C shows a state in which the supply member has been rotated after insertion.

FIG. 28A is a side view of the mounting portion, FIG. 28B is a cross-sectional view as seen along arrows G-G in FIG. 28A, and FIG. 28C is a cross-sectional view as seen along arrows H-H in FIG. 28A.

FIG. 29A is a side view of the mounting portion, FIG. 29B is a cross-sectional view as seen along arrows I-I in FIG. 29A, and FIG. 29C is a cross-sectional view as seen along arrows J-J in FIG. 29A.

FIG. 30A is a side view of the mounting portion, FIG. 30B is a cross-sectional view as seen along arrows K-K in FIG. 30A, and FIG. 30C is a cross-sectional view as seen along arrows L-L in FIG. 30A.

DESCRIPTION OF EXEMPLARY EMBODIMENTS

An embodiment of an inkjet-type printer that is one example of a liquid consuming apparatus will be described below with reference to the drawings. The printer of this embodiment performs printing on a sheet P, which is an example of a target conveyed in one direction, by ejecting (i.e., consuming) ink, which is an example of a liquid, onto the sheet P so as to form an image or the like.

Configuration of Printer

Figure 1:
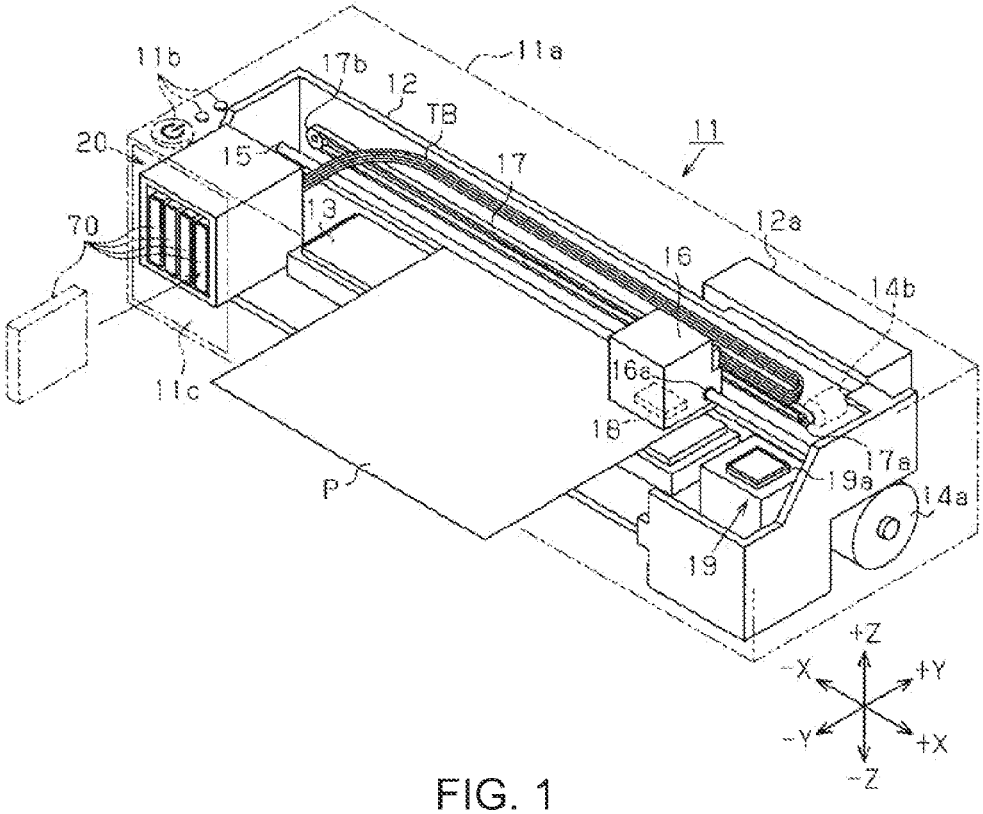
FIG. 1 is a schematic perspective diagram showing an embodiment of a printer that is one example of a liquid consuming apparatus.

As shown in FIG. 1, a printer 11 of this embodiment includes an approximately cuboid casing 11*a* as partially shown by dashed double-dotted lines, and operation buttons 11*b* such as power button for driving the printer 11 are provided on the upper surface of the casing 11*a* on the +Z direction side, which is the vertically upward direction. Also, an openable cover 11*c* is provided on the front surface of the casing 11*a* on the −Y direction side, which is the direction in which the sheet P is conveyed. A user can access the interior of the casing 11*a* when the cover 11*c* is opened.

An approximately rectangular box shaped frame 12 is accommodated in the interior space covered by the casing 11*a*, a support base 13 whose lengthwise direction is the ±X direction orthogonal to the −Y direction extends approximately horizontally in the lower portion, which is on the gravitational direction side (i.e., the −Z direction side), inside the frame 12, and a sheet feeding motor 14*a* is provided on the rearward side, which is the side opposite to the conveying direction side (−Y direction side) in the lower portion of the frame 12. In other words, a sheet feeding mechanism that operates due to driving of the sheet feeding motor 14*a* conveys the sheet P over the support base 13 in the −Y direction.

Also, a guide shaft 15 is provided above the support base 13 in the frame 12 and extends along the lengthwise direction of the support base 13. A carriage 16 that can move back and forth in the axial direction of the guide shaft 15, that is to say the ±X direction, is supported by the guide shaft 15. Specifically, a support hole 16*a* that extends in the ±X direction is formed in the carriage 16 so as to pass completely through, and the guide shaft 15 is inserted into the support hole 16*a*. Note that in a view in the −Y direction side, the rightward direction is the +X direction, and the leftward direction is the −X direction.

A driving pulley 17*a* and a driven pulley 17*b* are rotatably supported to the inner surface of the rear wall of the frame 12, at respective positions in the vicinity of the two ends of the guide shaft 15. The output shaft of a carriage motor 14*b* is linked to the driving pulley 17*a*, and an endless timing belt 17 partially linked to the carriage 16 is wound around the driving pulley 17*a* and the driven pulley 17*b*. When the carriage motor 14*b* is driven, the carriage 16 moves back and forth in the ±X direction, which is the scanning direction, while being guided by the guide shaft 15 via the timing belt 17.

A liquid injection head 18, which is one example of a liquid injection portion, is provided on the lower side of the carriage 16, and an image is printed on a sheet P by ink supplied to the liquid injection head 18 being injected from the liquid injection head 18. The supply of ink to the liquid injection head 18 is performed by an ink cartridge 70, which is one example of a liquid container that is removably mounted to a mounting portion 20 provided in the casing 11*a*. Specifically, the mounting portion 20 for mounting of the ink cartridge 70 is arranged on the −X direction side of the casing 11*a*, and an ink supply tube TB that allows the flow of ink is linked between the mounting portion 20 and the carriage 16. Ink is supplied from the ink cartridge 70 mounted to the mounting portion 20 to the liquid injection head 18 via the ink supply tube TB.

In this embodiment, four ink cartridges 70 (see FIG. 12) can be mounted to the mounting portion 20, and these ink cartridges 70 have case members 73 that respectively include ink containers 80, which are each one example of a liquid storage container, that store various colors of ink, such as the mutually different hues cyan, magenta, yellow, and black. The ink cartridges 70, one of which is shown by dashed double-dotted lines in FIG. 1, can be inserted into the mounting portion 20 when the cover 11*c* is released.

Also, a maintenance apparatus 19 that has a suction pump (not shown), a cap 19*a* shaped as a bottomed box that is open at the top, and the like is provided in a region on the +X direction side relative to the support base 13 inside the frame 12, that is to say a home position region in which the carriage 16 is not used in printing. Also, in the printer 11, after the carriage 16 is moved to the home position region, the maintenance apparatus 19 performs a maintenance operation in which maintenance is performed such that ink is stably injected from the liquid injection head 18.

Various types of operations performed in the printer 11 are controlled by a control portion. In this embodiment, the control portion is configured by a circuit board on which electrical elements such as a CPU, a RAM, and a ROM are implemented, and is arranged inside a case 12*a* provided in the rear of the frame 12, for example.

Furthermore, when ink is to be supplied from an ink cartridge 70, the control portion exchanges predetermined liquid information (e.g., identification data of the ink cartridge 70 and data indicating the remaining ink amount in the ink container 80 and the like) with a storage element 36 (see FIG. 10B), which is one example of a storage apparatus, that is included in the ink cartridge 70. Specifically, the exchange of this information is performed by electrical connection between an electrical connection portion provided in the mounting portion 20 and an electrical connection portion provided in the ink cartridge 70. Note that the electrical connection portions of the mounting portion and the ink cartridge will be described later.

Configuration of Ink Cartridge Mounting Portion

Next, the configuration of the mounting portion 20 will be described.

Figure 2:
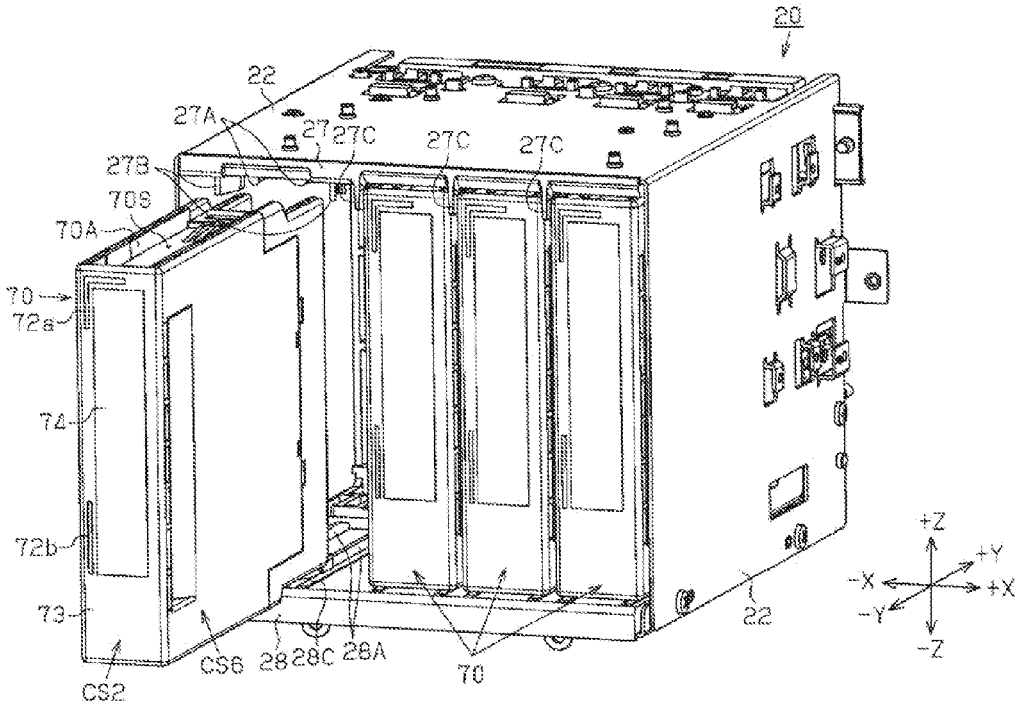
FIG. 2 is a perspective diagram showing an ink cartridge mounting portion provided in the printer.
Figure 3:
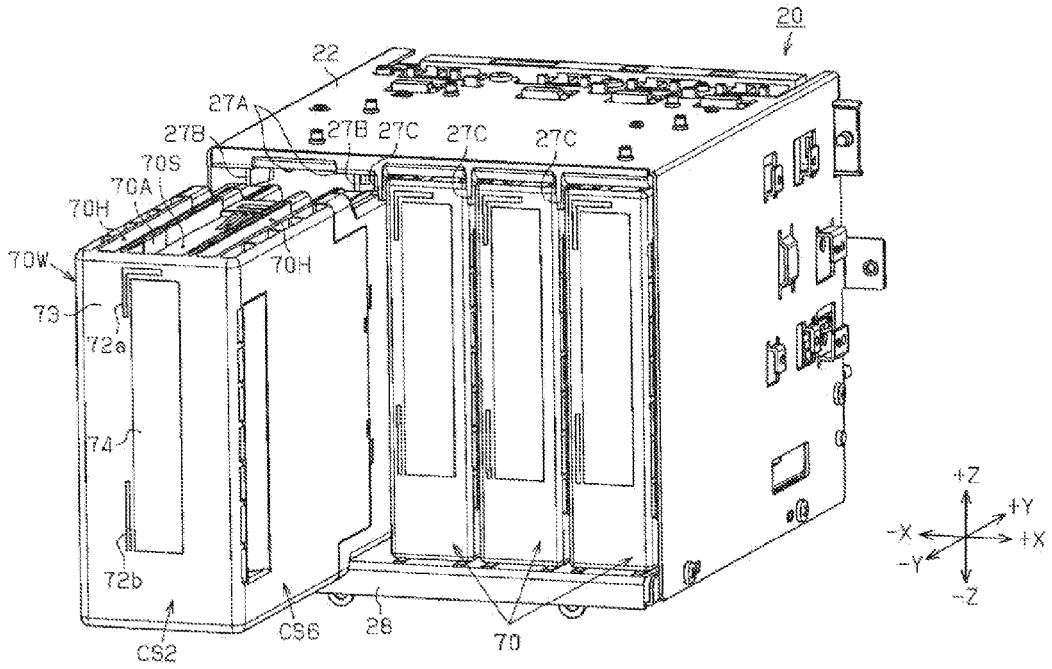
FIG. 3 is a perspective diagram showing a state in which a wide ink cartridge is to be mounted to the mounting portion.
Figure 4:
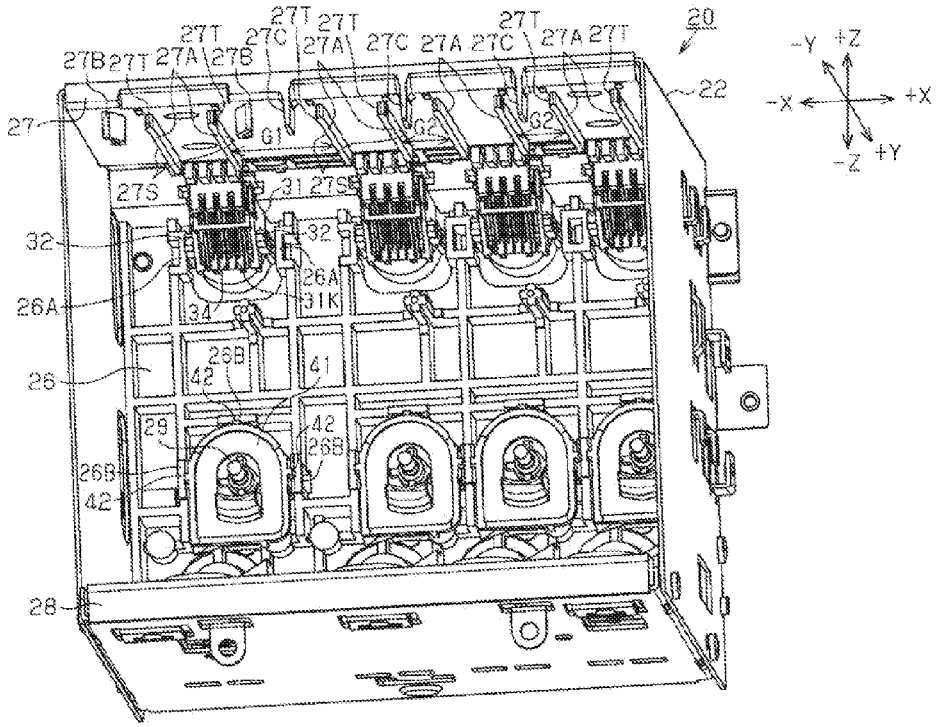
FIG. 4 is a perspective diagram showing the mounting portion to which ink cartridges are removably mounted.

As shown in FIGS. 2, 3, and 4, the mounting portion 20 of this embodiment is configured such that four approximately cuboid ink cartridges 70 can be held aligned along the ±X direction inside an approximately box shaped cartridge holding body 22 that is open on the −Y direction side. Also, at least one of the four ink cartridges 70 is an ink cartridge 70 having a different width dimension in the ±X direction, and the mounting portion 20 is configured such that this ink cartridge 70 can be held in the cartridge holding body 22.

Specifically, an ink cartridge 70W that is wider than the ink cartridges 70 can also be inserted into the mounting portion 20 of this embodiment in place of, among the four ink cartridges 70, the ink cartridge 70 held the farthest on the −X direction side in the cartridge holding body 22.

Specifically, a ceiling member 27 is attached to the inner ceiling surface located on the +Z direction inside the cartridge holding body 22. Upper guide ribs 27A, which are pairs of guide rails that protrude downward and extend along the +Y direction, which is the ink cartridge 70 insertion direction, are provided on the ceiling member 27 with predetermined intervals in the ±X direction so as to correspond to insertion positions in the cartridge holding body 22 where the ink cartridges 70 are to be inserted.

The upper guide ribs 27A extend in the +Y direction and are provided as pairs in the ±X direction for each ink cartridge 70. The ink cartridges 70 each have a recession portion 70S that extends in the +Y direction on the upper surface, and upper inner walls 70A, which are a pair of inner surfaces that oppose each other in the ±X direction, are formed in the recession portion 70S. Furthermore, each upper guide rib 27A in the pair has rib side surfaces 27S that oppose each other across a gap inside the recession portion 70S of the ink cartridge 70. The rib side surfaces 27S functions as surfaces for guiding the ink cartridge 70. Specifically, when the ink cartridge 70 is inserted into the mounting portion 20, the upper inner walls 70A come into contact with the rib side surfaces 27S of the upper guide ribs 27A that they oppose, and thus movement in the +Y direction is guided while the upper end side is positioned in the ±X direction of the cartridge holding body 22. Note that as shown in FIG. 4, in each of the upper guide ribs 27A in the pair, the end portion on the −Y direction side (i.e., the side in the direction opposite to the insertion direction) is provided with a rib portion 27T that protrudes outward in the ±X direction, is thicker than the other portions, and has a predetermined length. The function of the rib portions 27T of the upper guide ribs 27A will be described later.

As shown in FIG. 4, the upper guide ribs 27A that correspond to the ink cartridge 70 held the farthest on the −X direction side in the cartridge holding body 22 are provided on the ceiling member 27 with a wider gap from the adjacent upper guide ribs 27A than the upper guide ribs 27A that correspond to the other three ink cartridges 70 are. Specifically, in this embodiment, a gap G1 between the pair of upper guide ribs that correspond to the ink cartridge 70 held the farthest on the −X direction side and the pair of upper guide ribs 27A adjacent thereto is set larger than gaps G2 between the other three pairs of upper guide ribs 27A. Accordingly, due to the gap G1 being set larger than the gaps G2 in this way, the wide ink cartridge 70W can be inserted at the insertion position of the ink cartridge 70 held the farthest on the −X direction side in the cartridge holding body 22 as shown in FIG. 3. In other words, the gap G1 is set such that a gap that enables insertion of the wide ink cartridge 70W is provided.

Figure 5:
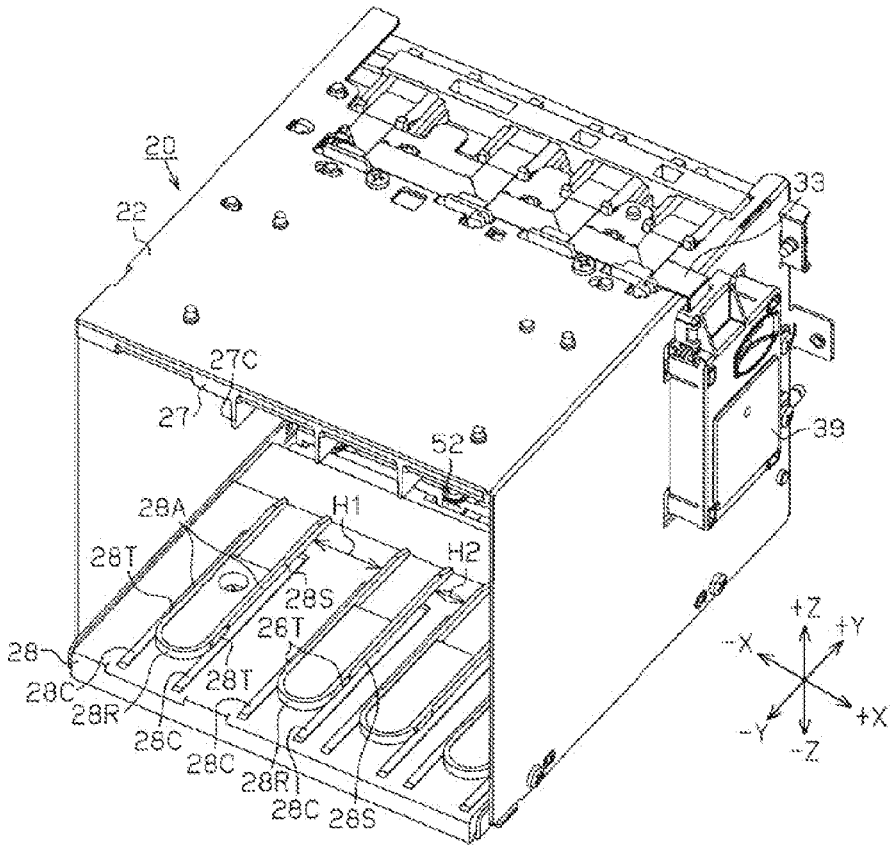
FIG. 5 is a perspective view of the mounting portion viewed from a different direction from FIG. 4.

Also, as shown in FIGS. 2 and 5, the approximately box shaped cartridge holding body 22 has an inner bottom surface located on the −Z direction side, which is the gravitational direction side on the inside, and a bottom member 28 is attached to the inner bottom surface. Pairs of lower guide ribs 28A, which are guide rails, that protrude upward and extend along the +Y direction, which is the ink cartridge 70 insertion direction, are provided on the bottom member 28 with predetermined intervals in the ±X direction, which is the scanning direction. The pairs of lower guide ribs 28A are provided so as to correspond to the insertion positions of the respective ink cartridges 70 in the ±X direction in the cartridge holding body 22. In this embodiment, the pairs of lower guide ribs 28A are provided at positions that approximately oppose the respective pairs of upper guide ribs 27A.

On the side in the direction opposite to the +Y direction, which is the ink cartridge 70 insertion direction, the ends of the lower guide ribs 28A in each pair are linked by a semicircular arc shaped rib 28R so as to be approximately U-shaped. Also, on the outer sides in the ±X direction, each pair of lower guide ribs 28A has rib side surfaces 28S that function as guiding surfaces for guiding the insertion of the ink cartridge 70. Also, a pair of lower protrusion portions 70D are provided on the bottom surface of each ink cartridge 70, specifically on the two end portions in the ±X direction, and the lower protrusion portions 70D in the pair have lower inner walls 70B (see FIGS. 7B and 9B), which are inner surfaces that oppose each other in the ±X direction. Furthermore, the rib side surfaces 28S of the lower guide ribs 28A are provided so as to oppose the lower inner walls 70B of the lower protrusion portions 70D of the ink cartridge 70 via a gap. When the ink cartridge 70 is inserted into the mounting portion 20, the lower inner walls 70B of the lower protrusion portions 70D come into contact with the rib side surfaces 28S of the lower guide ribs 28A, and thus movement in the +Y direction, which is the insertion direction, is guided while the upper end side is positioned in the ±X direction of the cartridge holding body 22.

Figure 6A:
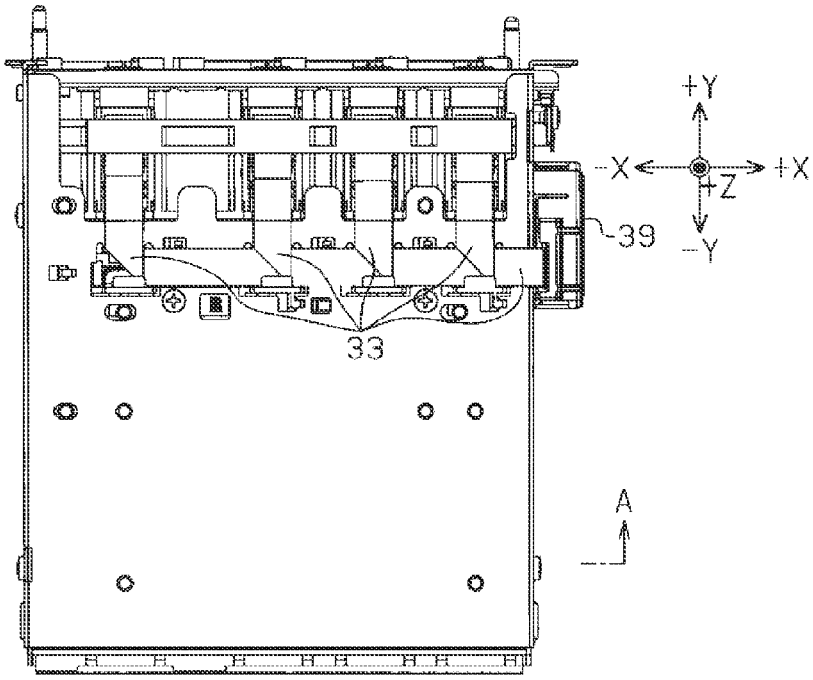
FIGS. 6A to 6C are diagrams showing the mounting portion, where
Figure 6B:
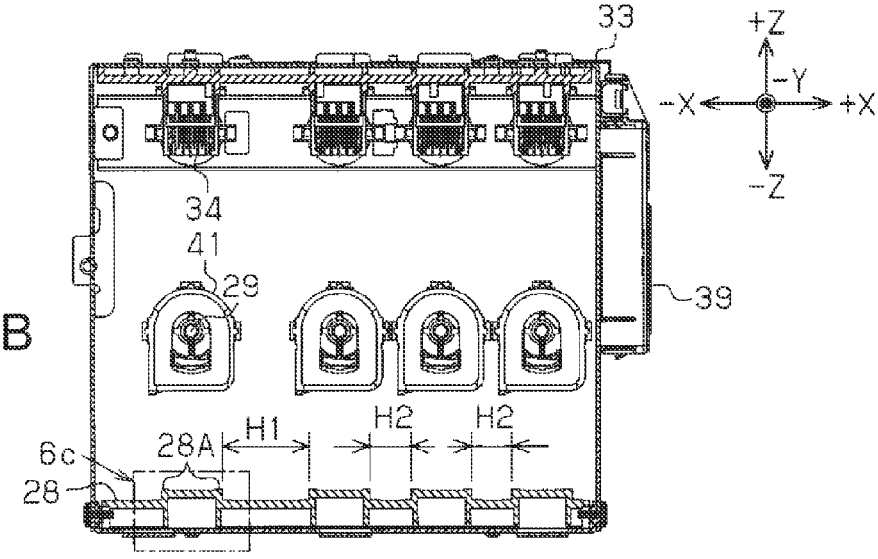
Figure 6C:
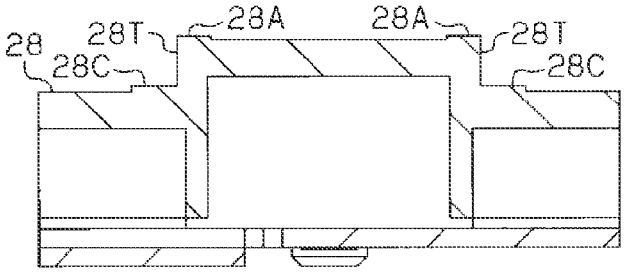

Also, as shown in FIGS. 5 and 6C, the U-shaped lower guide ribs 28A have a pair of rib portions 28T that are adjacent to the arc shaped rib 28R in the +Y direction and have a predetermined length in the +Y direction. The rib portions 28T are formed so as to protrude outward in the ±X direction and have a larger thickness than the other portions. Also, belt-like rail surfaces 28C that extend in the +Y direction are formed as surfaces protruding from the bottom surface of the bottom member 28, and are adjacent to the lower guide ribs 28A on the outer sides in the ±X direction. The functions of the rib portions 28T and the belt-like rail surfaces 28C of the lower guide ribs 28A will be described later.

Also, as shown in FIGS. 5 and 6B, the lower guide ribs 28A that correspond to the ink cartridge 70 held the farthest on the −X direction side in the cartridge holding body 22 are provided on the bottom member 28 with a wider gap from the adjacent lower guide ribs 28A than the lower guide ribs 28A that correspond to the other three ink cartridges 70 are. Specifically, in this embodiment, a gap H1 between the pair of lower guide ribs 28A that correspond to the ink cartridge 70 held the farthest on the −X direction side and the pair of lower guide ribs 28A adjacent thereto is set larger than gaps H2 between the other three pairs of lower guide ribs 28A. Accordingly, due to the gap H1 being set larger than the gaps H2 in this way, the wide ink cartridge 70W can be inserted at the insertion position of the ink cartridge 70 held the farthest on the −X direction side in the cartridge holding body 22 as shown in FIG. 3. In other words, the gap H1 is set such that a gap that enables insertion of the wide ink cartridge 70W is provided.

Also, as shown in FIGS. 3 and 4, the ink cartridges 70 and the wide ink cartridge 70W are inserted into the cartridge holding body 22 while being positioned in the ±X direction. Specifically, in the end portion of the cartridge holding body 22 on the opening side, which is the −Y direction side opposite to the +Y direction side of the ink cartridge 70, the ink cartridges 70 and the wide ink cartridge 70W are respectively approximately positioned in the ±X direction by insertion guiding portions 27C provided on the ceiling member 27 as guiding projections that protrude downward.

Also, as shown in FIGS. 2 and 4, when an ink cartridge 70 is inserted into the cartridge holding body 22 in place of the wide ink cartridge 70W, positioning in the ±X direction by the insertion guiding portion 27C is difficult due to the ±X direction width of the ink cartridge 70 being smaller than the ink cartridge 70W. In view of this, in this embodiment, guiding portions 27B are provided on the ceiling member 27 as a pair of guiding projections for guiding an ink cartridge 70 in the ±X direction by engaging with the upper portion of the ink cartridge 70 on the +Y direction side, which is the insertion direction side. Specifically, the ink cartridge 70 is guided into the cartridge holding body 22 such that the upper guide ribs 27A are positioned in the recession portion 70S of the ink cartridge 70. The guiding portions 27B are formed on the ceiling member 27 as ribs that protrude downward in the opening-side end portion of the cartridge holding body 22, specifically on the two sides of the upper guide ribs 27A in the ±X direction that intersects the +Y direction, which is the ink cartridge 70 insertion direction. The guiding portions 27B are provided such that the ±X direction gap therebetween decreases as they extend in the +Y direction. For this reason, as shown in FIG. 3, the wide ink cartridge 70W is provided with recessed grooves 70H for insertion of the guiding portions 27B during insertion into the cartridge holding body 22, specifically on the two sides of the recession portion 70S in the ±X direction.

Configuration of Ink Cartridge

Next, the configurations of the ink cartridges 70 and the ink cartridge 70W will be described in detail. Note that the configuration of the ink cartridges 70 will be described first, and then only differences from the configuration of the ink cartridge 70 will be described for the wide ink cartridge 70W.

Figure 7A:
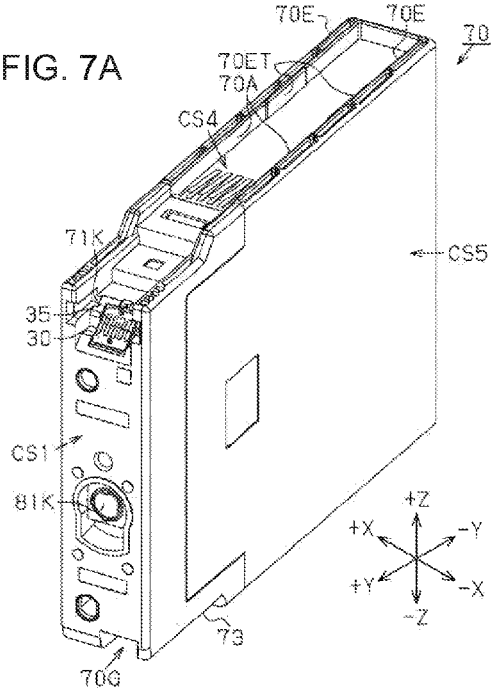
FIGS. 7A and 7B are perspective diagrams showing the shape of an ink cartridge.
Figure 7B:
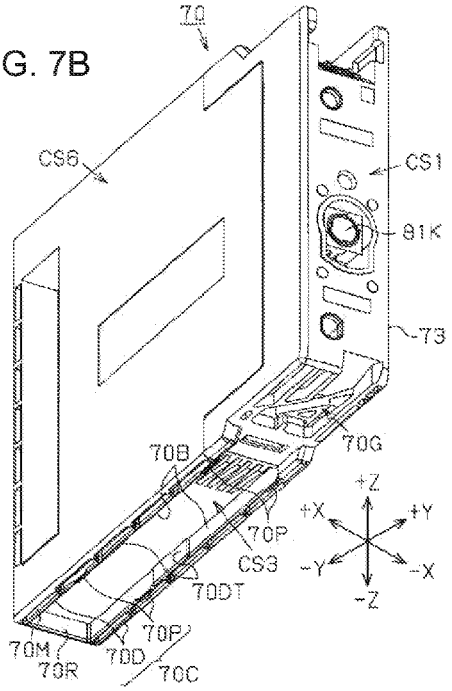

As shown in FIGS. 2, 7A, and 7B, each ink cartridge 70 is approximately shaped as a cuboid having six surfaces. Specifically, the ink cartridge 70 has a first surface CS1 on the side in the +Y direction, which is the direction of insertion into the mounting portion 20, and a second surface CS2 that opposes the first surface CS1. The ink cartridge 70 further has a third surface CS3 that intersects the first surface CS1 and the second surface CS2 and is on the side in the gravitational direction in the state of being mounted to the mounting portion 20; a fourth surface CS4 that opposes the third surface; a fifth surface CS5 that is an extended surface extending in a direction that intersects the first surface, the second surface, and the third surface; and a sixth surface CS6 that opposes the fifth surface CS5 and is likewise an extended surface. In this embodiment, in a view from the second surface CS2 side, the extended surface on the −X direction side is the fifth surface CS5, and the extended surface on the +X direction side is the sixth surface CS6.

As shown in FIGS. 7A and 8B, the ink cartridge 70 is provided with a pair of upper protrusion portions 70E that extend in the +Y direction on the two ±X direction end portions of the fourth surface CS4, which is the upper surface during mounting to the mounting portion 20. The pair of upper inner walls 70A are formed on the ±X direction inner sides of the pair of upper protrusion portions 70E. Furthermore, the pair of upper protrusion portions 70E extend in the +Y direction on the fifth surface CS5 side and the sixth surface CS6 side respectively. In other words, in this embodiment, the ±X direction outer surfaces of the pair of upper protrusion portions 70E are formed as portions of the fifth surface CS5 and the sixth surface CS6 respectively. Upper protruding wall portions 70ET, which protrude inward at mutually opposing positions on the upper inner walls 70A, are formed with a predetermined length in the +Y direction on the upper protrusion portions 70E. The functions of the upper protruding wall portions 70ET will be described later.

Also, as shown by the shaded region in FIG. 8B, a circuit board 30 provided with a first electrode 35 serving as an electrical connection portion for electrical connection with the printer 11 (mounting portion 20) is attached in an extension region R4, which is an extension in the +Y direction of the surface region sandwiched between the two opposing upper protruding wall portions 70ET. Also, the circuit board 30 is attached in a downward oblique orientation so as to approach the third surface CS3 side as it extends in the +Y direction, and is inclined relative to the +Y direction.

As shown in FIGS. 7B and 8D, the third surface CS3, which is the bottom surface during mounting to the mounting portion 20, is provided with the previously-described pair of lower protrusion portions 70D that extend in the +Y direction on the fifth surface CS5 side and the sixth surface CS6 side respectively. In this embodiment, the ±X direction inner surfaces of the pair of lower protrusion portions 70D configure the lower inner walls 70B that extend in the +Y direction. On the other hand, the ±X direction outer surfaces of the pair of lower protrusion portions 70D are formed as portions of the fifth surface CS5 and the sixth surface CS6 respectively. Lower protruding wall portions 70DT, which protrude inward at mutually opposing positions, are formed with a predetermined length in the +Y direction on the lower inner walls 70B. The functions of the lower protruding wall portions 70DT will be described later.

Also, as shown by the shaded region in FIG. 8D, a groove portion 70G capable of engaging with a movable lock portion provided on the printer 11 (mounting portion 20) is formed in an extension region R3, which is an extension in the +Y direction of the surface region sandwiched between the two opposing lower protruding wall portions 70DT.

Also, as shown in FIGS. 8C and 8D, the third surface CS3 is provided with lower protrusion portions 70D formed on the fifth surface CS5 side and the sixth surface CS6 side, and projection portions 70P that protrude from the third surface CS3 in the −Z direction, which is the gravitational direction, are provided on portions of the lower protrusion portions 70D. In this embodiment, two projection portions 70P are provided with a gap in the +Y direction on each side of the third surface CS3, and thus a total of four projection portions 70P are formed on the bottom surface. In other words, the pair of lower protrusion portions 70D extending in the +Y direction and the projection portions 70P provided on the lower protrusion portions 70D configure protrusion portions 70C. As will be described later, the protrusion portions 70C come into contact with the mounting portion 20 by sliding over the belt-like rail surface 28C provided on the bottom member 28.

Note that in this embodiment, multiple rectangular grooves 70M for preventing sink marks during molding for example are formed in each of the lower protrusion portions 70D, and the lower protrusion portion 70D having the rectangular grooves 70M is provided with the projection portions 70P on portions that are the most inward in the width direction. Also, the projection portions 70P are formed such that in the state in which the ink cartridge 70 has been mounted to the mounting portion 20, the first electrode 35 provided on the circuit board 30 attached to the fourth surface CS4 is located between the projection portions 70P (protrusion portions 70C) provided on the fifth surface CS5 side and the sixth surface CS6 side in a view in the +Y direction. The circuit board 30 provided with the first electrode 35 functions as an electrical connection portion that can be electrically connected to a connector provided on the printer 11 side.

Furthermore, as shown in FIGS. 7B, 8D, and 8E, letting the protrusion portions 70C provided on the third surface CS3 be first protrusion portions, the ink cartridge 70 of this embodiment is provided with a linking rib 70R that links the two lower protrusion portions 70D as a second protrusion portion located between the first protrusion portions in a view in the +Y direction. The linking rib 70R is provided on the second surface CS2 side, which is the side opposite to the +Y direction side, of the third surface CS3. Note that in this embodiment, the linking rib 70R is formed so as to protrude with a height from the third surface CS3 that is the same as the lower protrusion portions 70D, and configures a portion of the second surface CS2.

As shown in FIGS. 7A, 7B, 8A, 8B, and 8D, the first surface CS1 of the ink cartridge 70 is provided with a liquid supply opening 81K in a surface region R1 that intersects the extension region R3 and the extension region R4, and ink from an ink chamber IS (see FIG. 12), which is one example of a liquid storage chamber, included in the ink cartridge 70 can flow to the outside through the liquid supply opening 81K. Specifically, the surface region R1 of the first surface CS1 is a region that connects the extension region R3 and the extension region R4 as shown by the shaded region in FIG. 8A, and the liquid supply opening 81K is provided at a position in the surface region R1 that is closer to the third surface CS3 than the fourth surface CS4. Note that in this embodiment, the liquid supply opening 81K is provided in the center of the surface region R1 in the width direction, which is approximately the center between the fifth surface CS5 and the sixth surface CS6.

As shown in FIGS. 2 and 8E, position marks 72*a* and 72*b*, which indicate the adhesion position of a label 74 for identifying the ink cartridge 70, are formed on the second surface CS2 on the −Y direction side. The position marks 72*a* and 72*b* are formed as protrusions or recessions relative to the surface of the second surface CS2, and using the position marks 72*a* and 72*b* as markers, the user can easily adhere the label 74 at the appropriate position on the second surface CS2.

Also, although not shown, a mark MK indicating the position to be pressed by the user when inserting the ink cartridge 70 into the mounting portion 20 can be provided by the characters "Push" or the like on the label 74 adhered to the second surface CS2. Note that it is preferable that this mark MK on the label 74 adhered to second surface CS2 is provided at a position that opposes the liquid supply opening 81K provided in the first surface CS1 as shown by the circular dashed line in FIG. 8E.

Figure 9A:
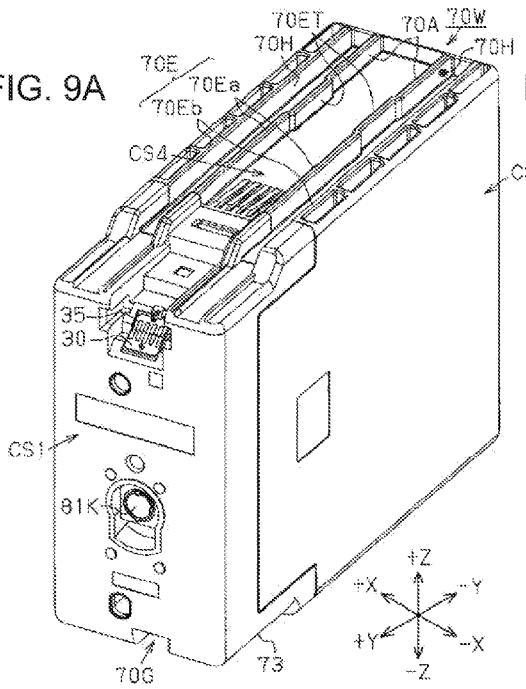
FIGS. 9A and 9B are perspective diagrams showing the shape of a wide ink cartridge.
Figure 9B:
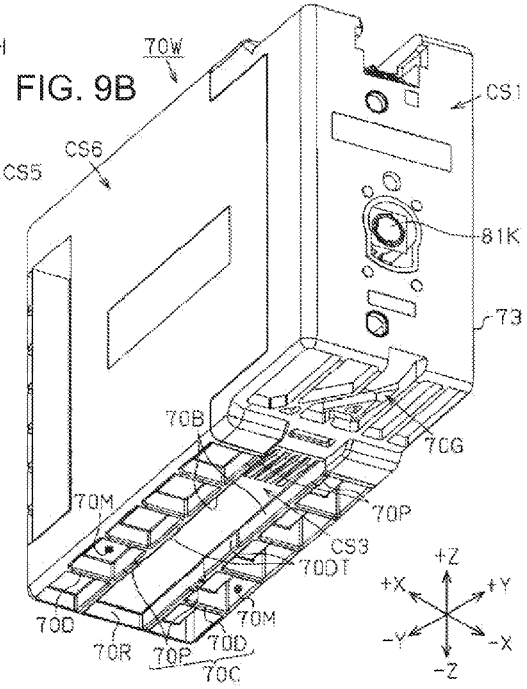

Next, as shown in FIGS. 3, 9A, and 9B, the liquid supply opening 81K, the groove portion 70G, the circuit board 30, and the label 74 of the ink cartridge 70W have the same shapes as the corresponding members of the ink cartridge 70, but the case member 73 is shaped so as to be wider in the width direction (±X direction). Accordingly, the fifth surface CS5 and the sixth surface CS6 are the same shapes as in the ink cartridge 70, but the shapes of the first surface CS1, the second surface CS2, the third surface CS3, and the fourth surface CS4 are different from the ink cartridge 70.

In this embodiment, the first surface CS1 in which the liquid supply opening 81K is provided and the second surface CS2 to which the label 74 is adhered are shaped such that the case member 73 is elongated by the same length on both sides in the width direction. Also, the third surface CS3 is shaped such that the width of the lower protrusion portions 70D is increased. The projection portions 70P are provided on portions of the lower protrusion portions 70D that are located the most inward in the width direction, and are at the same locations as in the ink cartridge 70.

Unlike the third surface CS3, the pair of upper protrusion portions 70E of the fourth surface CS4 are each configured by two substantially parallel protrusion portions, namely an inner protrusion portion 70Ea and an outer protrusion portion 70Eb that have an interval between them in the ±X direction, which is the width direction. Out of the two inner protrusion portions 70Ea and outer protrusion portions 70Eb, the upper protruding wall portions 70ET are provided on the inner protrusion portions 70Ea located inward in the width direction relative to the outer protrusion portions 70Eb, and are arranged with the same positions and shapes as in the ink cartridge 70. Also, the interval between each pair of one inner protrusion portion 70Ea and one outer protrusion portion 70Eb is the recessed groove 70H, which is a recession portion that extends in the +Y direction. The recessed grooves 70H are provided as grooves for insertion of the guiding portions 27B, which are guiding projections, during insertion into the cartridge holding body 22. Also, the inner protrusion portions 70Ea can be inserted between the upper guide ribs 27A and the guiding portions 27B, and the upper inner walls 70A are configured so as to be guided by the upper guide ribs 27A. In this way, in this embodiment, the upper protrusion portions 70E and the recessed grooves 70H are provided in the same one fourth surface CS4, in the ink cartridge 70W.

Configuration of Mechanisms Related to Mounting of Ink Cartridge in Mounting Portion The mounting portion 20 of this embodiment includes an electrode connection mechanism for the transmission of information data such as data related to ink consumption to the first electrode 35 provided in the inserted ink cartridge 70 (70W) via the connected electrode connection portions, and a flow channel connection mechanism for allowing the outflow of ink from the liquid supply opening 81K of the inserted ink cartridge 70 (70W). The mounting portion 20 also includes a holding mechanism for holding the inserted ink cartridge 70 (70W) so as to not come out of the cartridge holding body 22.

Next, the electrode connection mechanism, the flow channel connection mechanism, and the holding mechanism will be described taking the example of attachment of an ink cartridge 70, with reference to the drawings. The same of course applies to the case of attachment of the ink cartridge 70W as well.

First, the configuration of the electrode connection mechanism will be described.

Figure 10A:
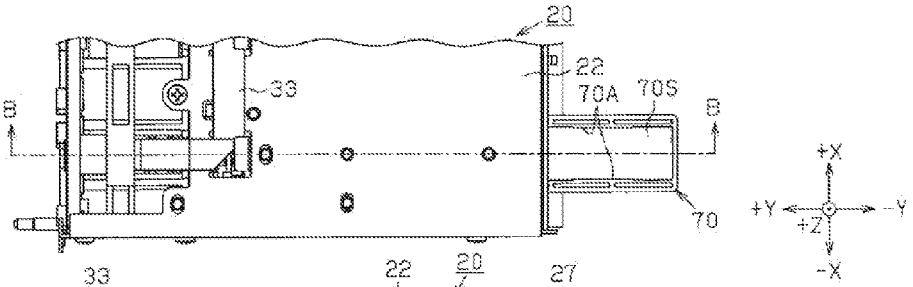
FIGS. 10A and 10B are diagrams showing a state in which an ink cartridge has been partially inserted into the mounting portion, where
Figure 10B:
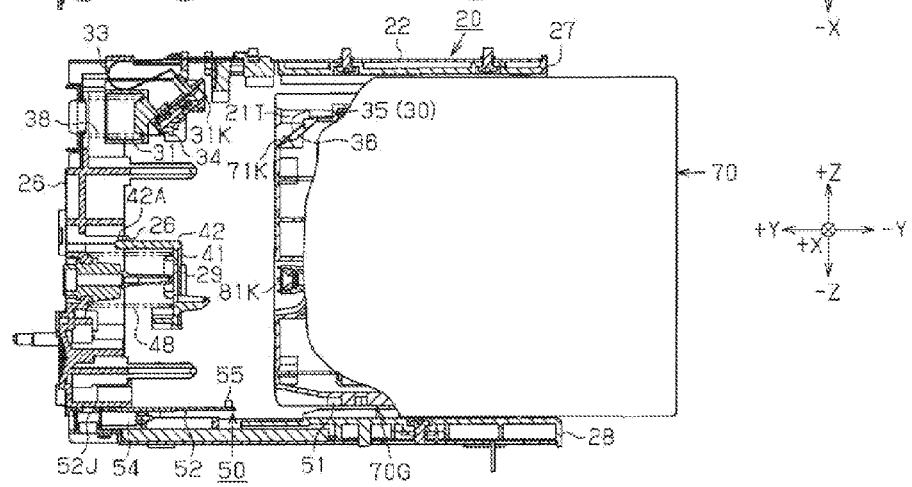

As shown in FIGS. 4, 10A, and 10B, on the inner rear side (+Y direction side) opposite to the opening side of the substantially box shaped cartridge holding body 22, a wall member 26 that extends in the directions orthogonal to the +Y direction is formed as one member that configures the rear wall surface of the cartridge holding body 22, and second electrodes 34 are provided on the wall member 26 as electrical connection portions on the mounting portion 20 side. These second electrodes 34 come into contact with and become electrically connected to the first electrodes 35 provided as electrical connection portions on the ink cartridges 70. Also, when a first electrode 35 and a second electrode 34 become electrically connected, information data sent from a wiring substrate 33 such as a flexible substrate to the second electrode 34 is transmitted to the storage element 36 provided as a storage apparatus in the ink cartridge 70 via the first electrode 35 and stored therein.

Specifically, as shown in FIG. 4, the wall member 26 of the cartridge holding body 22 is provided with movable members 31 that can slide along the +Y direction. Here, a pair of sliding guide portions 26A that have guide holes (not shown) extending along the +Y direction are formed on the wall member 26 in correspondence with each of the ink cartridges 70. Each movable member 31 is provided with a pair of slide portions 32, and sliding portions (not shown) that slide in the guide holes are formed on portions of the slide portions 32. Accordingly, a sliding mechanism is configured by the slide portions 32 moving along the sliding guide portions 26A (guide holes), and the movable member 31 moves in the +Y direction. Note that movement of the movable member 31 toward the +Y direction side is restricted by the rear end portion of the slide portions 32 coming into contact with the sliding guide portions 26A.

Also, in this embodiment, as shown in FIGS. 4, 7A, 10A, and 10B, in the ink cartridge 70, an inclined surface 71K that is inclined so as to intersect the +Y direction is formed in the end portion of the fourth surface CS4 on the +Y direction side toward the cartridge holding body 22. The first electrode 35 is provided on the inclined surface 71K. Also, an opposing portion 31K that opposes the first electrode 35 when the ink cartridge 70 is inserted into the cartridge holding body 22 is formed on the front side (the side in the direction opposite to the +Y direction) of each of the movable members 31. The second electrode 34 is provided on the opposing portion 31K. The movable member 31 is provided at a location where the second electrode 34 can come into contact with the first electrode 35 when the movable member 31 slides in the +Y direction to the wall member 26.

Note that in this embodiment, the first electrode 35 serving as an electrical connection portion is the circuit board 30 whose substrate surface is arranged along the inclined surface 71K of the ink cartridge 70, and more specifically is a metal pattern formed on the substrate surface. Also, the memory of an IC chip provided in the circuit board 30 functions as the storage element 36. Also, the second electrode 34 is configured by metal plates attached in a cantilevered state on the opposing portion 31K of the movable member 31, and the portions of these metal plates that come into contact with the first electrode 35 (contact portions) can be slightly displaced so as to enable reliable contact with the first electrode 35.

Also, in the circuit board 30 provided on the inclined surface 71K that is inclined relative to the +Y direction, the area of the substrate surface extending along the inclined surface 71K is larger than the area projected in the +Y direction. This enables multiple metal patterns to be formed on the substrate surface of the circuit board 30.

The movable member 31 of this embodiment is biased in the direction in which the opposing portion 31K approaches the first electrode 35 of the ink cartridge 70 (here, the direction opposite to the +Y direction). Specifically, the wall member 26 includes a second biasing member 38 that biases the movable member 31 in the −Y direction, that is to say the direction in which the opposing portion 31K approaches the first electrode 35. Note that in this embodiment, a compression coil spring is used as the second biasing member 38, and the movable member 31 is biased by the second biasing member 38 in a state in which forward movement is restricted.

Note that as shown in FIGS. 5, 6A, and 6B, the wiring substrate 33 exchanges predetermined information with the control portion provided in the printer 11 via a repeater 39 attached to a side surface of the cartridge holding body 22. The terminal connection mechanism is configured in this way.

Next, the configuration of the flow channel connection mechanism will be described.

As shown in FIG. 4, when a supply needle 29 provided on the wall member 26 is inserted into the liquid supply opening 81K provided in an ink cartridge 70, ink stored in the ink chamber IS in the ink cartridge 70 flows into the supply needle 29. The ink that flowed into the supply needle 29 is supplied to the liquid injection head 18 via a flow channel (not shown) formed in the wall member 26, by a liquid supply mechanism (likewise not shown).

Also, as shown in FIGS. 4 and 10B, the mounting portion 20 includes a moving body 41 that is arranged so as to surround the supply needle 29 and can move in the +Y direction, and a first biasing member 48 that is a first surface biasing member for biasing the moving body 41 in the −Y direction. In this embodiment, the first biasing member 48 is a compression coil spring, and is arranged on the wall member 26 such that the supply needle 29 is located inside the coil shaped portion.

Accordingly, when the moving body 41 comes into contact with the inserted ink cartridge 70, the first biasing member 48 functions as the first surface biasing member for biasing the first surface CS1 of the ink cartridge 70. Also, the portion of the first surface CS1 centered about the liquid supply opening 81K functions as a first surface biased portion during contact with the moving body 41. Note that in this embodiment, the liquid supply opening 81K is provided in the first surface CS1 at a location closer to the third surface CS3 than the fourth surface CS4. Accordingly, the first surface biased portion is similarly located on the first surface CS1 at a position closer to the third surface CS3 than the fourth surface CS4.

Note that in this embodiment, three projection portions 42 that extend in the +Y direction are formed on the moving body 41, and the moving body 41 moves in the +Y direction as the projection portions 42 respectively move along three groove portions 26B provided in the wall member 26. Also, movement of the moving body 41 toward the +Y direction side is restricted due to rear end portions 42A of the projection portions 42 coming into contact with the wall member 26. The flow channel connection mechanism is configured in this way.

Next, the configuration of the holding mechanism will be described.

In the mounting portion 20 of this embodiment, after the ink cartridge 70 inserted into the cartridge holding body 22 comes into contact with the moving body 41, movement of the ink cartridge 70 in the +Y direction is accompanied by biasing force in the −Y direction due to compression of the first biasing member 48. The generated biasing force acts as force that pushes the ink cartridge 70 back via the moving body 41. For this reason, it is difficult to hold the ink cartridge 70 in the state of being pushed into the cartridge holding body 22 in resistance to the biasing force of the first biasing member 48. In view of this, in this embodiment, a holding mechanism is provided for holding the ink cartridge 70 pushed into the cartridge holding body 22 so as to not come out.

Figure 11A:
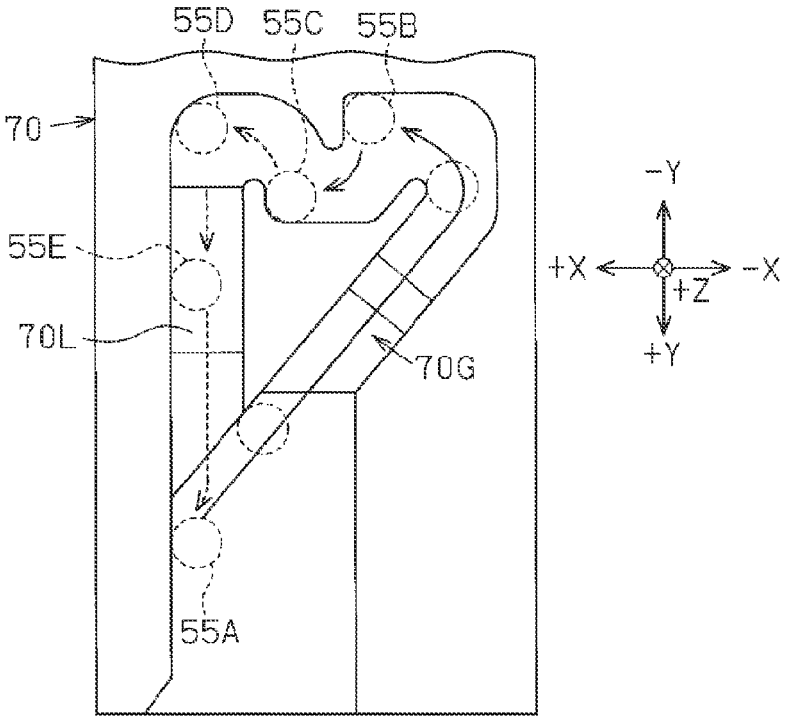
FIG. 11A is a partial bottom view of a groove portion of the ink cartridge that engages with a movable lock portion.
Figure 11B:
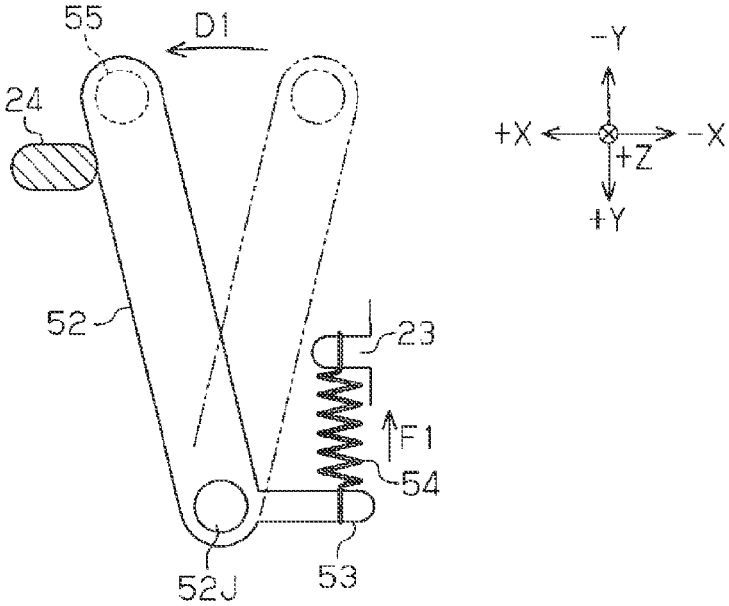
FIG. 11B is a schematic view of a configuration of a lever member that functions as the movable lock portion provided on the mounting portion.

As shown in FIGS. 10B, 11A, and 11B, the holding mechanism is configured by the groove portion 70G provided in the third surface CS3 (bottom surface) of the ink cartridge 70, and a lever member 52 provided as a movable lock portion that is rotatably supported to the cartridge holding body 22 (bottom member 28) via a shaft. Specifically, the groove portion 70G of the ink cartridge 70 is shaped as a cam, and the ink cartridge 70 is locked to the mounting portion 20 and held by the cam shaped groove portion 70G engaging with the lever member 52.

The lever member 52 rotates about a shaft portion 52J that is formed on the base side thereof and has an axis line perpendicular to the inner bottom surface of the cartridge holding body 22, and a pin 55 that pivots is formed on the upper side of the tip side opposite to the base side. A spring 54 is provided so as to span a catch portion 53 formed on the lever member 52 and a catch portion 23 formed on the cartridge holding body 22, and the lever member 52 is constantly biased so as to pivot in one direction D1 (here, the counterclockwise direction when viewed from below) about the shaft portion 52J due to tensile force F1 from the spring 54. As a result, the pin 55 formed on the lever member 52 is constantly biased so as to pivot in the one direction D1. Note that the rotation of the lever member 52 in the one direction D1 is restricted by a restriction portion 24 provided on the cartridge holding body 22.

In the holding mechanism configured in this way, insertion of the ink cartridge 70 into the cartridge holding body 22 is accompanied by movement of the pin 55 in the cam shaped groove portion 70G along a defined path as shown by dashed-line circles in FIG. 11A. In other words, the groove portion 70G of the ink cartridge 70 functions as a cam, and the pin 55 of the lever member 52 functions as a cam follower.

Specifically, as the ink cartridge 70 is pressed into the cartridge holding body 22 in resistance to the biasing force of the first biasing member 48, the pin 55 of the ink cartridge 70 moves from the initial position shown by reference sign 55A in the manner indicated by the solid-line arrows in FIG. 11A, and moves to the position shown by reference sign 55B. When the pressing is canceled in this state, the ink cartridge 70 is pushed back in the forward direction a little by the first biasing member 48, and the pin 55 moves along the cam shape of the groove portion 70G by pivoting in the one direction D1 and then moves to the position indicated by reference sign 55C. This position is a restricted position at which movement of the pin 55 is restricted in the groove portion 70G, and when the pin 55 moves to this restricted position, the ink cartridge 70 is held in a restricted state in which movement in the removal direction opposite to the +Y direction (here, the removal direction is the −Y direction) is restricted by the biasing force of the first biasing member 48. Specifically, when the pin 55 is located at the restricted position, the groove portion 70G is locked by the pin 55 of the lever member 52, and the ink cartridge 70 is held such that movement in the direction of removal from the mounting portion 20 is restricted.

In this embodiment, the held state of the ink cartridge 70 is a state in which the ink cartridge 70 is mounted to the mounting portion 20, and in this mounted state, the lever member 52 generates biasing force by which the pin 55 presses the ink cartridge 70 up in the groove portion 70G. Specifically, the lever member 52 is configured so as to come into contact with the groove portion 70G in the pressed state in order to be able to reliably move along the cam shape of the groove portion 70G. Accordingly, the lever member 52 functions as a movable lock portion and also functions as a third surface biasing member that biases the third surface. Also, the groove portion 70G functions as a third surface biased portion that is biased by the lever member 52.

Thereafter, if the ink cartridge 70 in the mounted state is again pressed into the cartridge holding body 22 in the +Y direction in resistance to the biasing force of the first biasing member 48, the restriction on the movement of the pin 55 in the groove portion 70G is canceled, and the pin 55 moves from the restricted position to the position indicated by reference sign 55D in FIG. 6A. When the pressing of the ink cartridge 70 is canceled after the movement to the position indicated by reference sign 55D, the ink cartridge 70 is pressed back in the removal direction (−Y direction) by the first biasing member 48, and the pin 55 moves from the position indicated by reference sign 55D to the position indicated by reference sign 55E. Also, as the ink cartridge 70 moves in the removal direction due to the biasing force of the first biasing member 48, the pin 55 is pressed downward along an oblique surface portion 70L shaped as a cam and moves along the oblique surface portion 70L, and moves from the position indicated by reference sign 55E to the initial position indicated by reference sign 55A as shown by the dashed-line arrows in FIG. 6A. In this way, with the holding mechanism, the operation of pressing the ink cartridge 70 is accompanied by repeated movement of the pin 55 between the initial position and the restricted position. The holding mechanism is configured in this way.

Configuration of Members of Ink Cartridge

Next, the configurations of the ink cartridge 70 and the wide ink cartridge 70W will be described.

Figure 12:
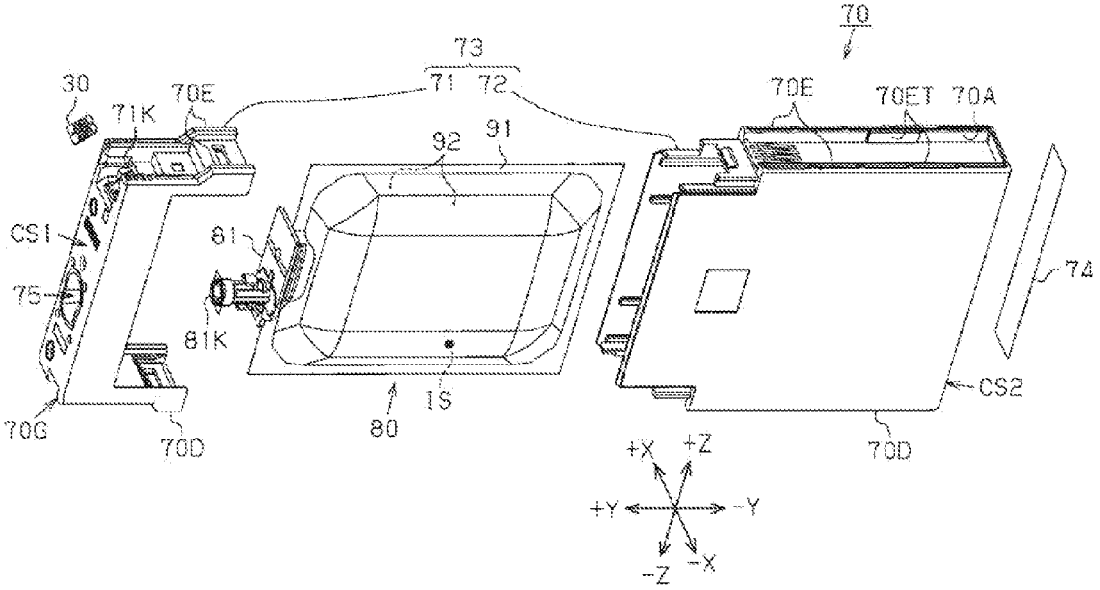
FIG. 12 is an exploded perspective diagram showing the structure of an ink cartridge.

As shown in FIG. 12, the case member 73 of the ink cartridge 70 is a combination of two members, namely a first case member 71 on the +Y direction side and second case member 72 on the side in the direction opposite to the +Y direction, and an ink container 80 serving as a liquid storage container is accommodated in the case member 73. The inclined surface 71K, whose end portion on the +Y direction side can receive attachment of the circuit board 30, is provided on the upper surface side of the first case member 71, which is the +Z direction side during mounting to the mounting portion 20, and the groove portion 70G is provided on the lower surface side of the first case member 71. Also, a first supply member 81, which is the supply member in which the liquid supply opening 81K is provided, is attached and supported to the first case member 71, and thus the liquid supply opening 81K is provided in the surface of the first case member 71 on the +Y direction side, that is to say the first surface CS1 via a through-hole 75H of a through-hole formation portion 75 provided in the first case member 71 (see FIGS. 21A and 22A). The label 74 is adhered to the surface of the second case member 72 on the side in the direction opposite to the +Y direction, that is to say the second surface CS2 that opposes the first surface CS1. The ink cartridge 70 is completed by sliding the second case member 72 in the +Y direction so as to combine it with the first case member 71 to which the ink container 80 is supported.

The ink container 80 is formed as a so-called ink pack container in which the opening side of a bag-like pack body 91, which is one example of a storage compartment member, is joined to the first supply member 81, and the interior of the ink container 80 is the ink chamber IS, which is one example of a liquid storage chamber that can store ink. In this embodiment, the pack body 91 is formed by a film, which is one example of a flexible member, and two pack members 92 that are shaped as rectangular thin plates and extend in the directions that intersect the ±X direction are formed in the shape of a bag, and three of the four outer peripheral ends are adhered. The first supply member 81 is inserted into the opening side of the formed bag, and the one end on the opening side is adhered to the first supply member 81, and thus the pack body 91 is joined to the first supply member 81, and the interior of the pack body 91 serves as the ink chamber IS. Accordingly, the flexible pack body 91 undergoes deformation such that the gap between the two opposing pack members 92 decreases in the ±X direction as the volume of the ink chamber IS decreases due to the outflow of ink.

Figure 13:
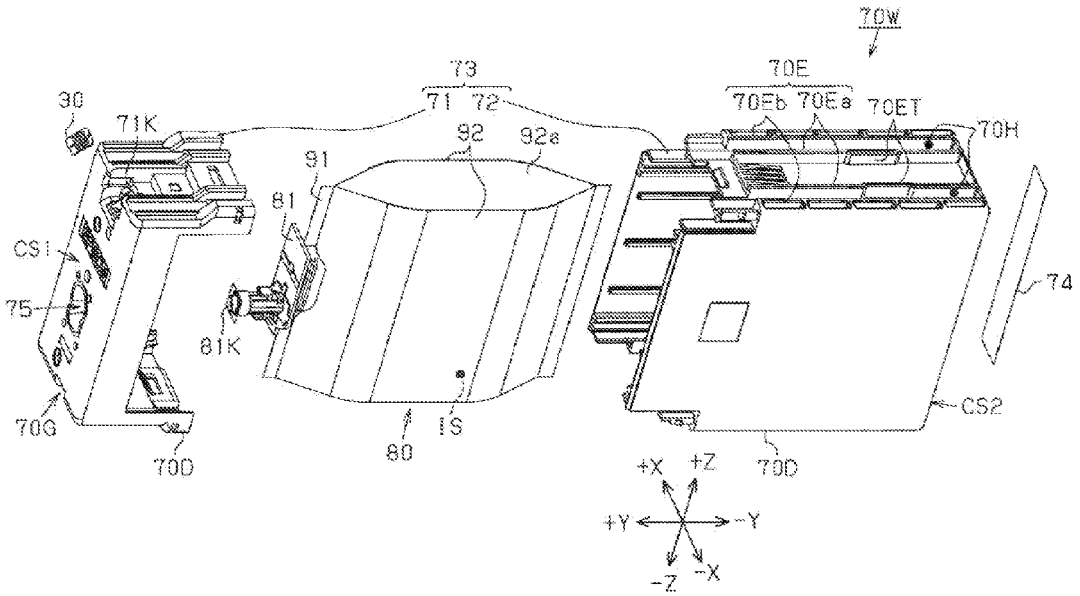
FIG. 13 is an exploded perspective diagram showing the structure of a wide ink cartridge.

As shown in FIG. 13, similarly to the ink cartridge 70, the case member 73 of the wide ink cartridge 70W is a combination of two members, namely a first case member 71 on the +Y direction side and second case member 72 on the side in the direction opposite to the +Y direction, and an ink container 80 serving as a liquid storage container is accommodated in the case member 73. The first case member 71 and the second case member 72 of the ink cartridge 70W are configured similarly to the first case member 71 and the second case member 72 of the ink cartridge 70 with the exception of having different widths. The configuration of the ink container 80 differs from the ink cartridge 70 with respect to the shape of the pack body 91 in accordance with the increased width.

Specifically, in the pack body 91 forming the ink container 80 of the ink cartridge 70W, the pack members 92 are shaped as a tube that extends in the +Y direction and has folded flat portions 92*a* in the upward and downward directions that intersect the +Y direction. The tube shaped pack member 92 is formed in the shape of a bag by adhering the +Y direction and the opposite side, and then the remaining opening side on the +Y direction side is joined to the first supply member 81 by adhesion. Accordingly, with the pack body 91 of the ink cartridge 70W, when ink is stored in the ink chamber IS, the flat portions 92*a* extend so as to form a relatively large-volume ink chamber IS. Also, the pack body 91 shrinks by returning to the state in which the flat portions 92*a* are folded as the volume of the ink chamber IS decreases due to the outflow of ink, and thus the pack body 91 undergoes deformation such that the gap between the pack members 92 of the pack body 91 that oppose each other in the ±X direction decreases.

Configuration of Members of Ink Container

Next, the configuration of members of the ink container 80 will be described. Note that in this embodiment, the ink cartridge 70 and the ink cartridge 70W differ only with respect to the pack body 91, and the configurations of the other members are the same.

Figure 14A:
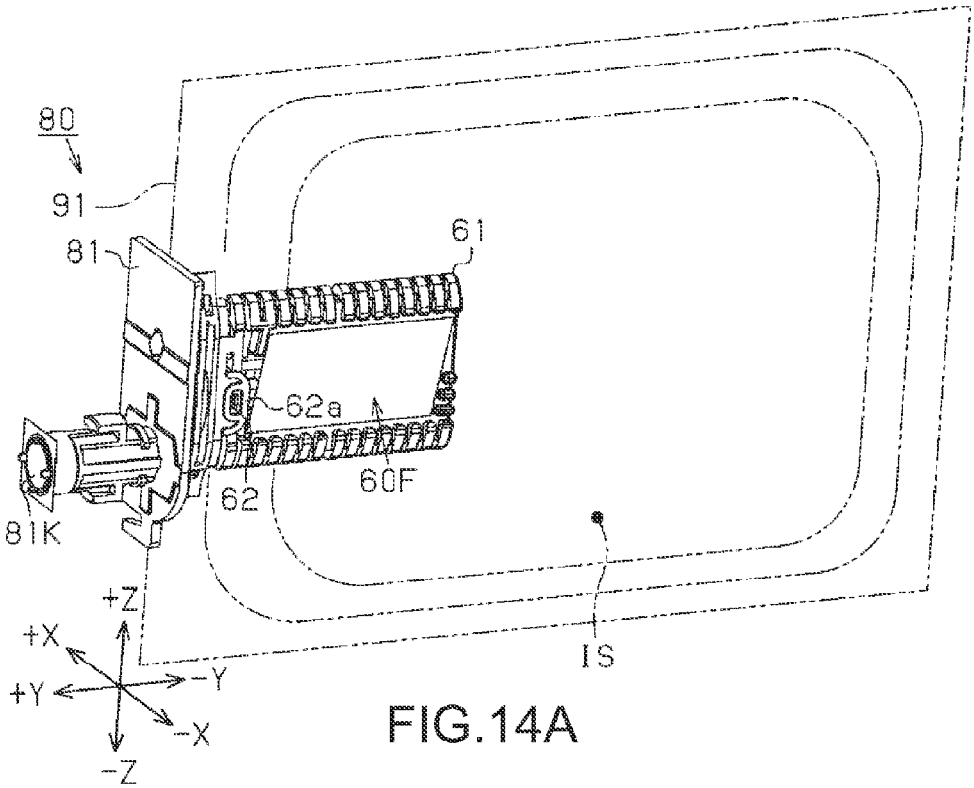
FIGS. 14A and 14B are diagrams showing an ink container included in an ink cartridge, and specifically are perspective diagrams showing the ink container from opposite sides.
Figure 14B:
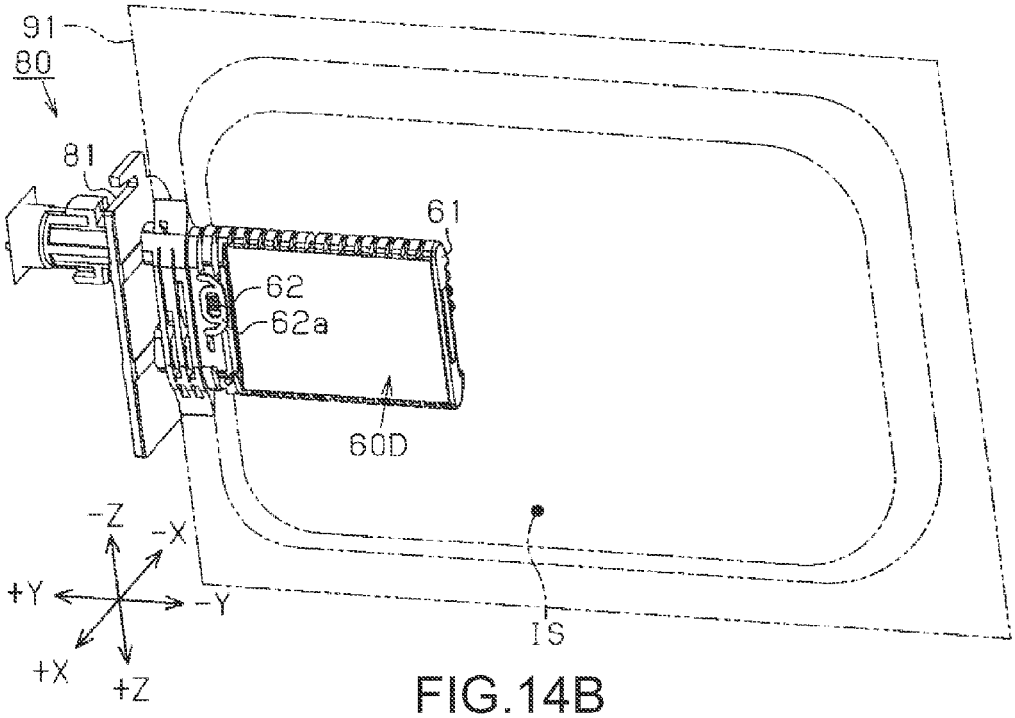

As shown in FIGS. 14A and 14B, the ink container 80 includes the first supply member 81 in which the liquid supply opening 81K is formed, and a filter chamber 60F and a low pressure chamber 60D in the ink chamber IS, which is the ink storage space formed by the pack body 91 joined to the first supply member 81. In this embodiment, the filter chamber 60F and the low pressure chamber 60D are formed in the second supply member 61 configured so as to be capable of connection to the first supply member 81, and are arranged at overlapping positions, that is to say positions that are in an over-under relationship, in a view in the direction that is the ±X direction during mounting to the mounting portion 20.

The second supply member 61 is provided with an injection opening 62 used when injecting ink into the ink chamber IS, and an annular rib 62*a* that surrounds the injection opening 62. After ink injection, the pack body 91 (pack member 92) is joined (adhered) to the annular rib 62*a*, thus sealing the injection opening 62 so as to cut off communication with the ink chamber IS.

Next, the first supply member 81 and the second supply member 61 will be described with reference to the drawings. Note that the pack body 91 has been omitted from the drawings referenced here.

Figure 15A:
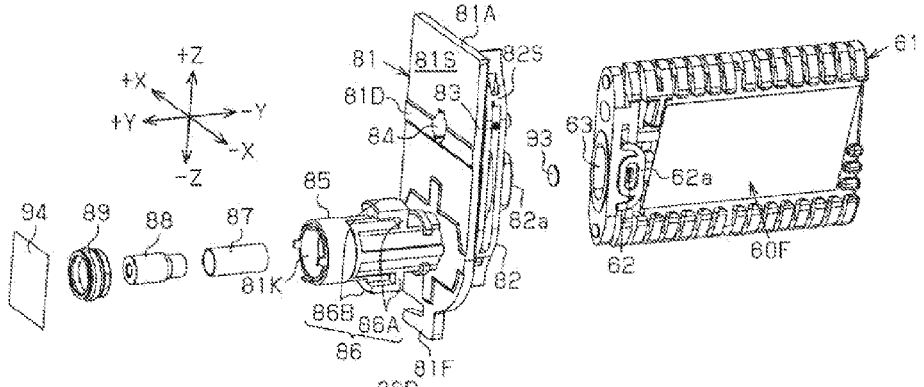
FIGS. 15A and 15B are exploded perspective diagrams showing the structure of an ink container viewed in the same directions as in FIGS. 14A and 14B.
Figure 15B:
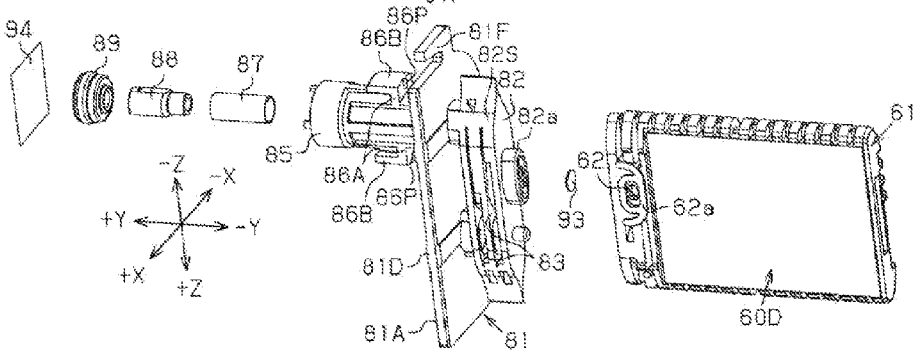

As shown in FIGS. 15A and 15B, the first supply member 81 has a connecting portion 82*a* whose cross-section is shaped as an elliptical column, and the second supply member 61 has a connection receiving portion 63, which is a hole having an elliptical cross-section. The first supply member 81 and the second supply member 61 are connected by inserting a valve element 93 (check valve) into the connection receiving portion 63, and then inserting the connecting portion 82*a*. Note that in this embodiment, the first supply member 81 and the second supply member 61 are detachably connected using the connecting portion 82*a* and the connection receiving portion 63.

The portion of the first supply member 81 where the connecting portion 82*a* is formed is shaped as a boat elongated in one direction, with boat tip shapes at the two ends in the lengthwise direction in a view in the +Y direction. The side surfaces of this boat shape are joining surfaces 82S to which the pack body 91 is joined by adhesion or the like. Accordingly, the boat shaped portion is a joining portion 82 for joining to the pack body 91. Note that the lengthwise direction of the joining portion 82 is the direction that conforms to the vertical direction during mounting to the mounting portion 20.

Also, on the +Y direction side of the joining portion 82 toward the mounting portion 20, the first supply member 81 is provided with an approximately rectangular plate shaped base portion 81A whose plate thickness direction is the +Y direction and whose lengthwise direction is the same direction as the lengthwise direction of the joining portion 82. In this embodiment, the base portion 81A is formed so as to be asymmetric in a view in the +Y direction. Specifically, one end in the lengthwise direction is rectangular, whereas an L-shaped portion 81F that is approximately L-shaped is formed at the other end.

A tubular flow channel portion 85 having the liquid supply opening 81K formed at the tip is provided in the base portion 81A of the first supply member 81. The tubular flow channel portion 85 is provided at a position toward the other end side where the L-shaped portion 81F is formed, and is provided so as to project toward the side in the +Y direction, which is the plate thickness direction of the base portion 81A. The tubular flow channel portion 85 is provided with engaged portions 86 that can be engaged with the first case member 71 when fixed to the first case member 71, and movement in the direction opposite to the +Y direction is restricted during engagement. The engaged portions 86 are respectively formed at the two ends of the tubular flow channel portion 85 in the direction that conforms to the lengthwise direction of the base portion 81A. Each of the engaged portions 86 is configured by a first engaged portion 86A that projects with a plate surface approximately parallel to the base portion 81A, and a second engaged portion 86B so as to extend toward the +Y direction from the tip of the first engaged portion 86A approximately perpendicular to the first engaged portion 86A. Note that the first engaged portion 86A is provided with a column 86P that projects slightly so as to form a columnar side surface on the upper surface of the body on the base portion 81A side.

Also, a supply opening spring 87, a supply opening spring seat 88, and a supply opening rubber seal 89 are inserted into the tubular flow channel portion 85 in order from the side having the liquid supply opening 81K formed at the tip, and lastly a supply opening film 94 is joined to the tip of the tubular flow channel portion 85 by adhesion or the like. The liquid supply opening 81K is sealed by the joining of the supply opening film 94. Then, although not shown in the figures, when the supply needle 29 is inserted into the liquid supply opening 81K formed at the tip of the tubular flow channel portion 85, the seal of the supply opening film 94 is broken, and the supply opening spring seat 88 that had been in contact with the supply opening rubber seal 89 so as to obstruct the ink flow channel is pressed so as to separate from the supply opening rubber seal 89. As a result, a gap that allows the flow of ink is formed in the liquid supply opening 81K, and ink flows into the supply needle 29 through the gap that was formed.

On the other hand, the second supply member 61 for connection to the joining portion 82 of the first supply member 81 has an approximately cuboid shape whose outer shape is elongated in the +Y direction. The side that is connected to the first supply member 81 is shaped such that the lengthwise direction is the same direction as the lengthwise direction of the boat shape of the joining portion 82, and the two ends in the lengthwise direction are semicircular or oblong as a semi-ellipse. The oblong shape on the connection side of the second supply member 61 is a shape that fits into the boat shape of the joining portion 82 in a view in the +Y direction.

Figure 16A:
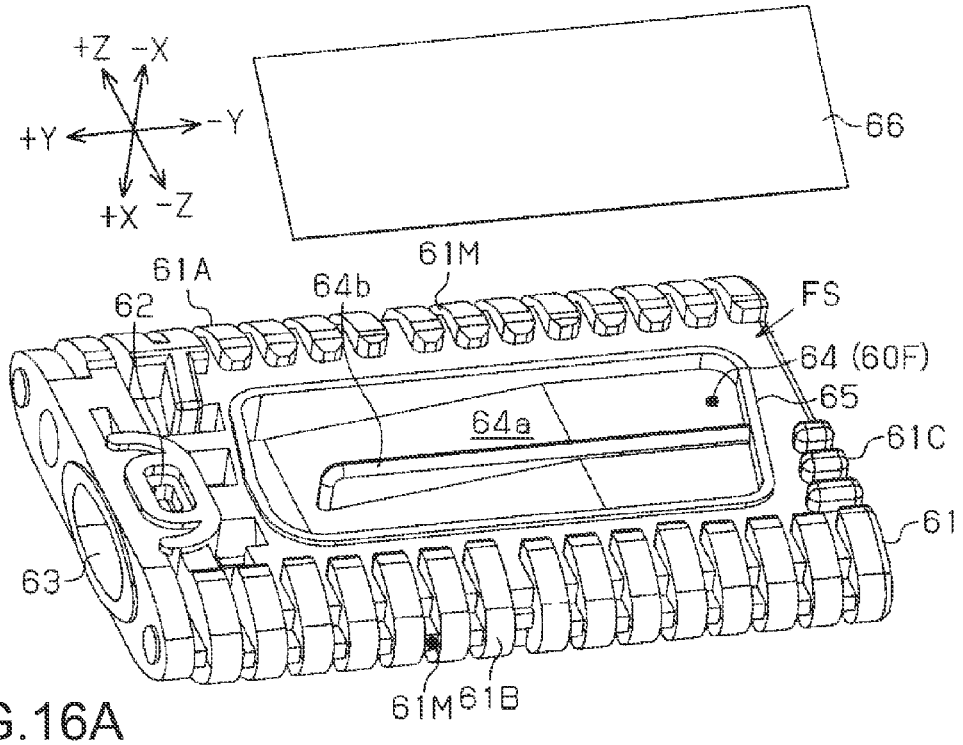
FIG. 16A is an exploded perspective diagram showing a configuration of a filter chamber in the ink container.
Figure 16B:
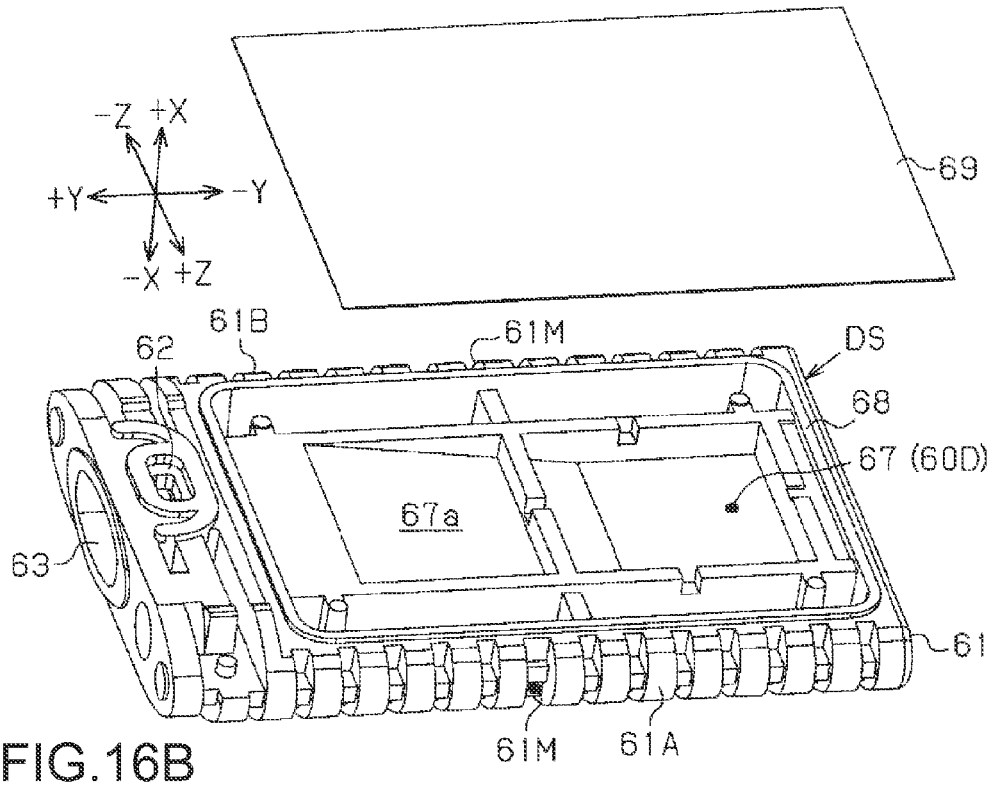
FIG. 16B is an exploded perspective diagram showing a configuration of a low pressure chamber in the ink container.

As shown in FIGS. 16A and 16B, out of the two flat surfaces of the second supply member 61 that have the largest area and are located so as to correspond to the two sides in the ±X direction in the cuboid shape, the filter chamber 60F is formed on the one first flat surface FS side, and the low pressure chamber 60D is formed on the other second flat surface DS side. Also, in this embodiment, at least a portion of the second supply member 61 is a common member forming both the filter chamber 60F and the low pressure chamber 60D.

The filter chamber 60F is configured as shown in FIG. 16A. Specifically, a first recessed portion region 64 is provided on the first flat surface FS side of the second supply member 61, and the first recessed portion region 64 has a first opening portion 65 that is approximately a parallelogram that is elongated in the +Y direction and short in a direction that intersects the +Y direction. Also, an inclined surface 64*a* that is for connection with the connecting portion 82*a* and is inclined toward the connection receiving portion 63 is provided on the bottom surface of the first recessed portion region 64. The inclined surface 64*a* is inclined such that the bottom surface of the connection receiving portion 63 is located farther on the X direction side than the bottom surface on the first opening portion 65 side is. Furthermore, a filter 66 that allows permeation of ink and suppresses permeation of foreign objects is externally shaped as approximately a parallelogram whose long sides are in the +Y direction. The filter chamber 60F is formed by affixing the filter 66 to the second supply member 61 so as to block the first opening portion 65 of the first recessed portion region 64. In other words, due to first opening portion 65 functioning as a liquid inflow region that allows the inflow of ink that has passed through the filter 66, the first recessed portion region 64 configures the filter chamber 60F on the first flat surface FS side of the second supply member 61.

In this embodiment, a rib 64*b* that extends in the +Y direction is provided in the first recessed portion region 64 that configures the filter chamber 60F. The rib 64*b* functions as a contact portion that comes into contact with the filter 66 when the filter 66 has undergone deformation toward the interior of the filter chamber 60F, and can suppress deformation of the filter 66.

Also, in this embodiment, the filter 66 is formed by cutting a sheet of woven fibers, and in order to prevent the woven fibers from coming undone, the external shape is set to a parallelogram as an innovation for causing the cut surface to be oblique to the weaving directions of the fibers.

The low pressure chamber 60D is configured as shown in FIG. 16B. Specifically, a second recessed portion region 67 is provided on the second flat surface DS side of the second supply member 61, and the second recessed portion region 67 has a second opening portion 68 that is approximately a rectangle that is elongated in the +Y direction and short in a direction that intersects the +Y direction. An inclined surface 67*a* is provided in the second recessed portion region 67 at a position that approximately overlaps the inclined surface 64*a* of the first recessed portion region 64 in a view in the scanning direction X. The inclined surface 67*a* is inclined such that the bottom surface on the side in the direction opposite to the +Y direction is farther from the second opening portion 68 than the bottom surface on the connection receiving portion 63 side is.

Also, in this embodiment, the second recessed portion region 67 is formed such that the projected area is the largest in the projected direction that conforms to the ±X direction. In a view in this projection direction, that is to say the ±X direction, the first recessed portion region 64 that functions as the filter chamber 60F is formed so as to be positioned within the second recessed portion region 67.

Also, a film 69 is affixed to the second supply member 61 so as to block the second opening portion 68 in a reduced-pressure atmosphere, and thus the second recessed portion region 67 is a reduced-pressure space having a lower pressure than atmospheric pressure, and is also an enclosed space. The film 69 is a film that has the property of allowing permeation of gases dissolved in the ink and air bubbles that have formed in the ink. Accordingly, the second recessed portion region 67 is the interior of the second supply member 61 and configures the low pressure chamber 60D on the second flat surface DS side of the second supply member 61. Note that the second recessed portion region 67 need only be a reduced-pressure space having a lower pressure than atmospheric pressure, and is not necessarily required to be an enclosed space.

Additionally, as shown in FIGS. 16A and 16B, the second supply member 61 is provided with multiple protrusion portions 61A, 61B, and 61C. In this embodiment, the protrusion portions 61A and 61B are formed so as to sandwich the filter 66 at the two end portions in the short-side direction (vertical direction Z) of the second supply member 61 that intersects the +Y direction. The protrusion portions 61A and 61B are shaped as protrusion portions that extend along the short-side direction of the second supply member 61. These protrusion portions are shaped as semicircles or semi-ellipses in a view in the +Y direction. Specifically, the protrusion portions 61A and 61B are formed on the second supply member 61 as portions that have approximately the same shape as the semicircle or semi-ellipse shape in the oblong shape on the side for connection to the first supply member 81, and a plurality of these protrusion portions extend aligned in the +Y direction. Also, gaps are formed between adjacent protrusion portions 61A, 61B, and 61C, and the gaps between adjacent protrusion portions 61A and 61B are provided as grooves 61M that extend from the film 69 of the low pressure chamber 60D to the filter 66 of the filter chamber 60F.

Accordingly, when the pack body 91 undergoes deformation such that the gap between the pack members 92 thereof that oppose each other in the ±X direction decreases, and the pack members 92 come into contact with the protrusion portions 61A, 61B, and 61C, the grooves 61M provided between adjacent protrusion portions 61A and 61B, for example, are formed as gap allowing the passage of ink. Accordingly, ink in the ink chamber IS can flow into the filter 66 through the grooves 61M.

Figure 17A:
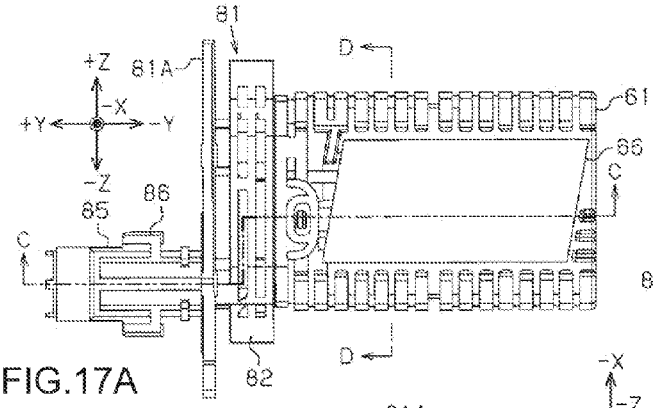
FIGS. 17A to 17C are diagrams showing the structure of the filter chamber and the low pressure chamber, and specifically
Figure 17C:
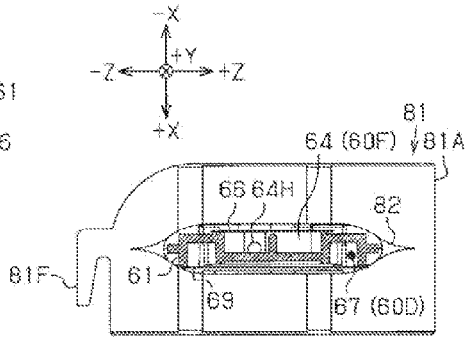
Figure 17B:
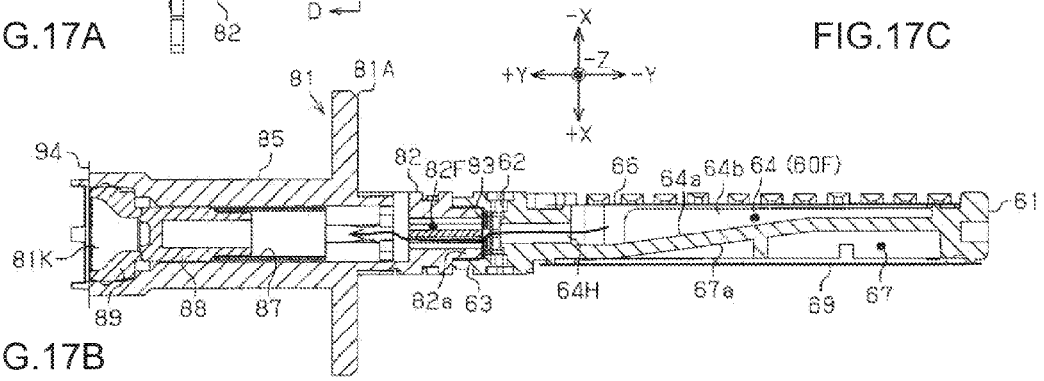
Figure 18A:
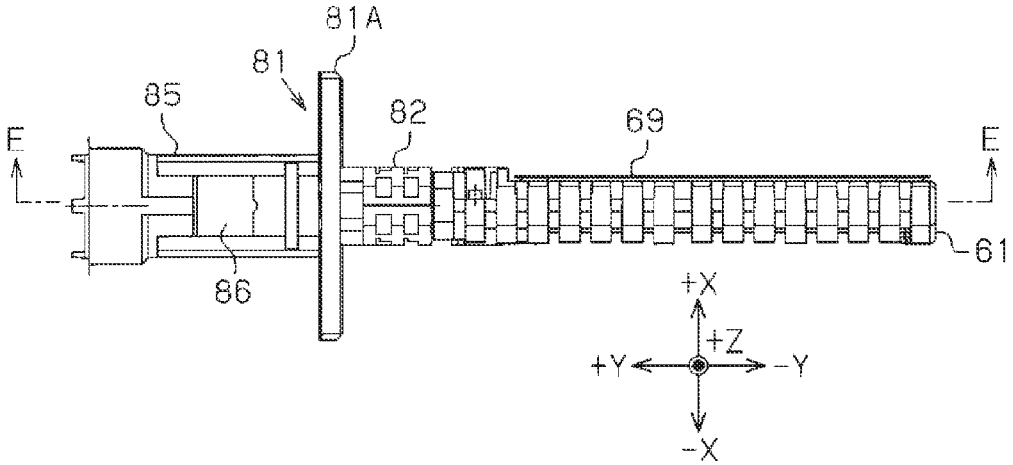
FIGS. 18A and 18B are diagrams showing an ink flow channel provided in a supply member, and specifically
Figure 18B:
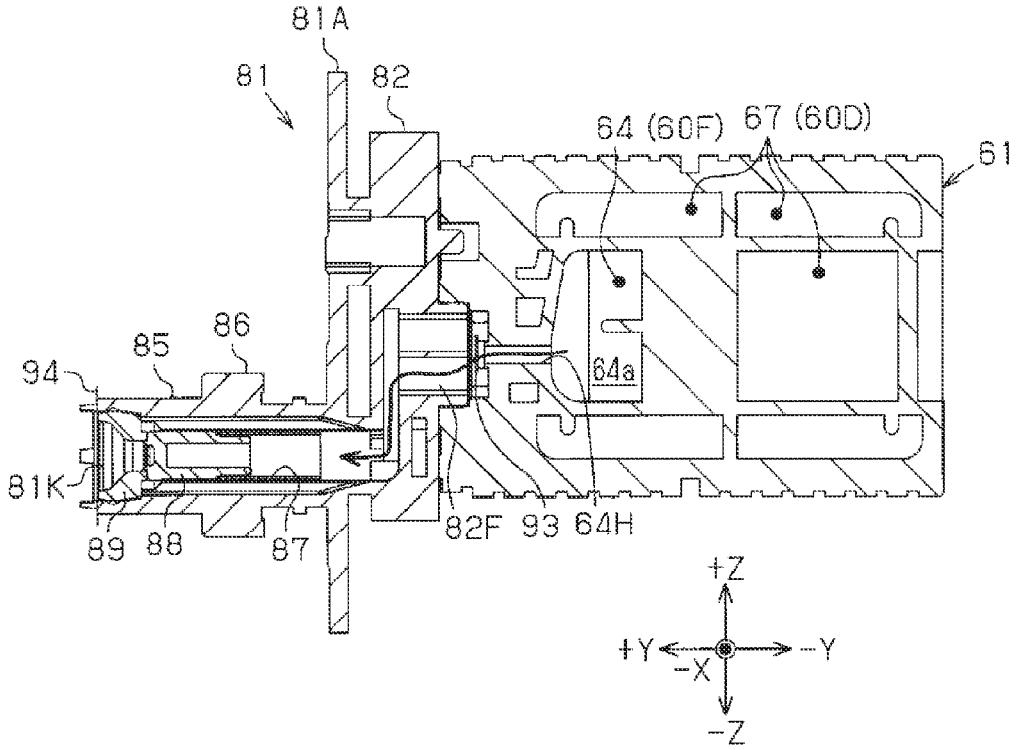

Also, as shown in FIGS. 17B, 17C, and 18B, due to the configuration in which the filter chamber 60F and the low pressure chamber 60D are formed on the two sides of the second supply member 61, namely the first flat surface FS side and the second flat surface DS side, the filter chamber 60F is arranged so as to be surrounded by the low pressure chamber 60D. Specifically, the filter chamber 60F is provided at a position where it is overlapped with the low pressure chamber 60D in the ±X direction and sandwiched by the low pressure chamber 60D on the two sides in the vertical direction. In this way, the second supply member 61 is configured such that the low pressure chamber 60D can be formed at a position where it is possible to reduce the ratio of gases dissolved in the ink in the filter chamber 60F.

Also, as shown in FIGS. 16A, 17A, 17B, and 17C, the filter chamber 60F is provided with the inclined surface 64*a* that is inclined such that the bottom surface of the connection receiving portion 63 is located farther on the X direction side than the bottom surface on the first opening portion 65 side. Also, an ink outflow opening 64H for the outflow of ink is provided on the first supply member 81 side of the first recessed portion region 64. Accordingly, a flow channel for flowing ink is formed on the first supply member 81 side in the filter chamber 60F. Also, the cross-sectional area of the flow channel at a first position on the downstream side in the vicinity of the first supply member 81 is larger than the cross-sectional area of the flow channel at a second position on the upstream side farther from the first supply member 81 than the first position is. According to this flow channel, ink that has flowed into the filter chamber 60F can flow out from the liquid supply opening 81K in a state in which an increase in pressure loss is suppressed, that is to say a state in which an increase in the flow rate is suppressed.

In this way, ink stored in the ink chamber IS, which includes the filter chamber 60F and the low pressure chamber 60D configured in the second supply member 61, flows to the liquid supply opening 81K via the ink outflow opening 64H in the filter chamber 60F. The ink that flowed to the liquid supply opening 81K then flows out to the supply needle 29 side, and is then supplied to the liquid injection head 18.

Specifically, as shown by the solid arrows in FIGS. 17B and 18B, ink that has flowed from the ink chamber IS into the filter chamber 60F flows into the ink outflow opening 64H, then flows through the valve element 93 to a junction flow channel 82F formed in the joining portion 82, and then flows into the tubular flow channel portion 85 that is in communication with the junction flow channel 82F. In this way, ink in the ink chamber IS is guided to the liquid supply opening 81K via the filter 66. Note that the valve element 93 functions as a check valve that permits the flow of ink from the ink chamber IS side to the liquid supply opening 81K side, and restricts the backflow of ink from the liquid supply opening 81K side to the ink chamber IS side.

As shown in FIGS. 15A, 15B, 19A, and 19B, the joining portion 82 to which the pack body 91 is joined by adhesion or the like is provided with multiple grooves extending in the lengthwise direction on the boat-shaped side surfaces that are the joining surfaces 82S. Spaces 83 are formed by these grooves when the pack body 91 is joined (adhered) to the joining surface 82S. The spaces 83 are configured so as to be in communication with the atmosphere, and are one example of a non-storage space other than the ink chamber IS (not in communication with the ink chamber IS), in which ink is not stored.

Figure 19A:
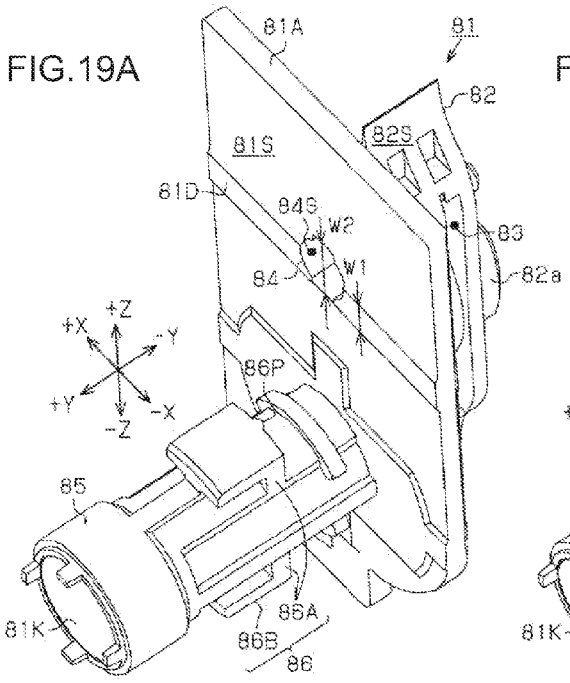
FIG. 19A is a perspective diagram showing the supply member.
Figure 19B:
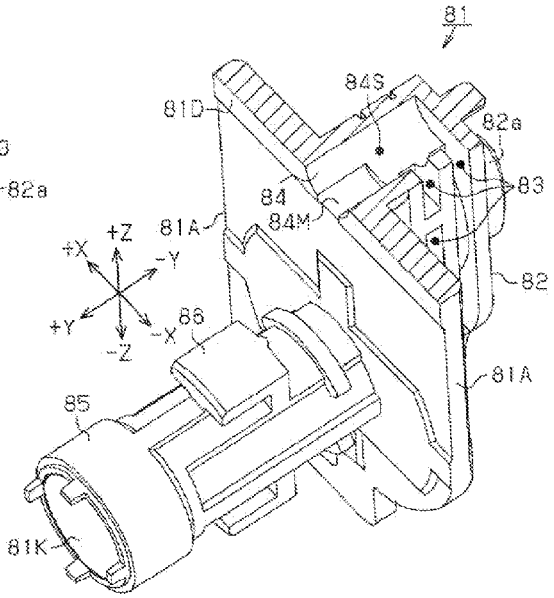
FIG. 19B is a cross-sectional perspective diagram in which the supply member has been cut at a position that intersects a communication opening.

Specifically, as shown in FIGS. 19A and 19B, in this embodiment, the first supply member 81 is provided with a cylindrical space 84S, a communication opening 84 in communication with the atmosphere is formed in a plate-shaped member surface 81S of the space 84S on the side opposite to the joining portion 82 in the base portion 81A, and the cylindrical space 84S and the spaces 83 are in communication with each other. Accordingly, the spaces 83 are formed as spaces in which the communication opening 84 is in communication with the atmosphere via the cylindrical space 84S.

Also, in this embodiment, side wall grooves 84M having a predetermined width and depth are formed on the two sides of the cylindrical space 84S in the lengthwise direction of the base portion 81A, on the communication opening 84 side of the cylindrical side surfaces. For this reason, the communication opening 84 is shaped as a polygon obtained by deforming a circle such that arcs in opposing portions bulge outward. Furthermore, the member surface 81S of the first supply member 81 is provided with a step portion 81D that forms at least a portion of the edge of the communication opening 84. In this embodiment, the step portion 81D is formed so as to project outward from the member surface 81S, that is to say toward the side opposite to the joining portion 82, and extend in a direction along the short-side portion of the base portion 81A.

Also, the step portion 81D is formed such that when the ink cartridge 70 (70W) is mounted to the mounting portion 20 of the printer 11, that is to say the ink container 80 is mounted, the step portion 81D is located on the gravitational direction side of the communication opening 84 and extends in the ±X direction. Also, the width of the step portion 81D in the vertical direction, that is to say a width W1 of the protrusion portion is set smaller than a width W2 of the communication opening 84 in the vertical direction.

Likewise, the communication opening 84 is located farther on the +Z direction side than the liquid supply opening 81K is when the ink cartridge 70 (70W) is mounted to the mounting portion 20 of the printer 11, that is to say the ink container 80 is mounted. Also, the communication opening 84 formed on the side opposite to the joining portion 82 in the base portion 81A is located on the +Y direction side toward the mounting portion 20 in the first supply member 81.

In the following description of effects of the configuration of this embodiment, effects in the ink container 80, effects in assembly of the ink cartridges 70 and 70W, and effects in mounting of the ink cartridges 70 and 70W to the mounting portion 20 will be described in the stated order.

Effects Ink Container

As shown in FIG. 19A, the joining portion 82 of the first supply member 81 is provided with the spaces 83 that are in communication with the atmosphere and are an example of non-ink-storing spaces other than the ink chamber IS, and thus air can be allowed to escape to these spaces 83 so as to prevent air from being enclosed by the adhesion surfaces during adhesion of the pack body 91.

Also, the shape of the communication opening 84 is a polygon rather than a circle, thus suppressing the case where the communication opening 84 is easily blocked by a round bar or the like. Also, due to the step portion 81D with a narrow width provided in the member surface 81S of the base portion 81A in which the communication opening 84 is formed, at least one step is formed in the communication opening 84. Accordingly, even if the communication opening 84 is covered by a sheet member for example, obstruction of the communication opening 84 is suppressed by the step that is formed. Furthermore, since the communication opening 84 is located farther on the +Z direction side than the liquid supply opening 81K is, there is a reduced probability that ink leaking out from the liquid supply opening 81K will flow into the communication opening 84. Also, since the communication opening 84 is located on the +Y direction side toward the mounting portion 20 in the first supply member 81, there is a reduced probability that the communication opening 84 will be blocked by a foreign object that entered from outside the printer 11 when the ink container 80 (ink cartridge 70 (70W)) is mounted to the printer 11.

Figure 20A:
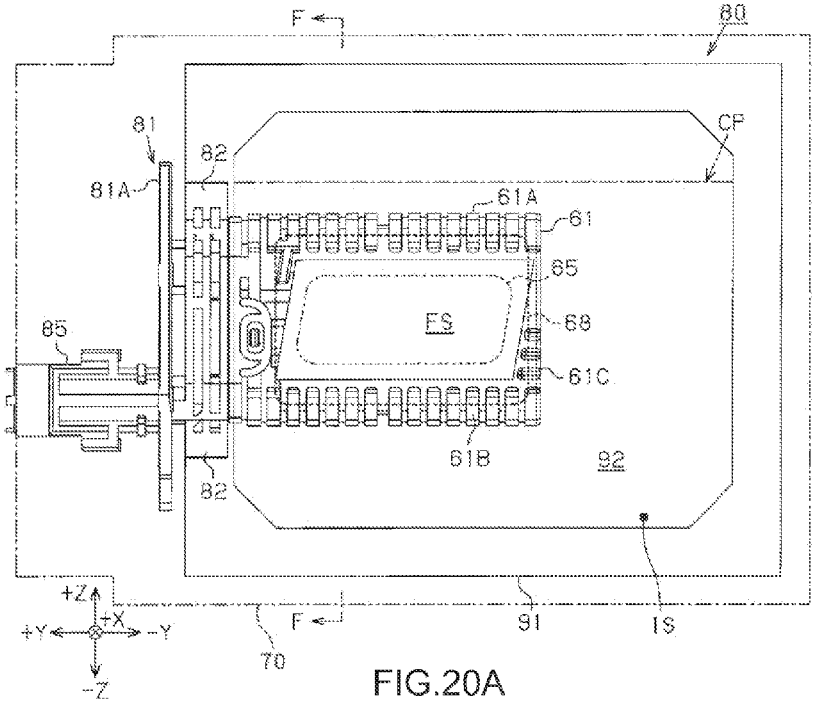
FIG. 20A is a side view of the ink container.
Figure 20B:
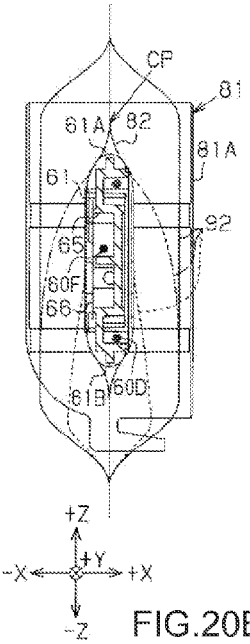
FIG. 20B is a cross-sectional view as seen along arrows F-F in FIG. 20A.

Also, as shown in FIGS. 20A and 20B, in the ink container 80, when the ink cartridge 70 (70W) is mounted to the mounting portion 20, the perpendicular direction of the first flat surface FS (second flat surface DS) of the second supply member 61 is a direction that intersects the vertical direction (i.e., is the ±X direction). Also, in the ink chamber IS, the opening of the approximately parallelogram shaped filter chamber 60F to which the filter 66 is affixed is shaped so as to be elongated in the +Y direction and have a short vertical direction, which is a direction that intersects the +Y direction, as shown by the thin dashed line in FIG. 20A. Note that only the outer shape lines of the pack body 91 (pack members 92) are shown in FIGS. 20A and 20B in order to simplify the illustration.

Accordingly, when the amount of ink in the ink chamber IS decreases as it flows out from the liquid supply opening 81K, the pack body 91 undergoes deformation such that the gap between the pack members 92 decreases as shown by the dashed double-dotted lines in FIG. 20B, and thus a larger amount of ink remains on the gravitational direction side in the ink chamber IS. Specifically, a contact position CP where the pack members 92 come into contact with each other gradually moves from the +Z direction side to the −Z direction side (gravitational direction side) as shown by the dashed single-dotted line in FIG. 20A.

Compared to the side in the vertical direction, the first opening portion 65, which is the region where ink flows into the filter chamber 60F, is longer on the side in the +Y direction that intersects the vertical direction. Accordingly, compared to the case where the first opening portion 65 is elongated in the vertical direction, a greater amount of ink can flow out before the pack body 91 (pack members 92), which undergoes deformation (the contact position CP moves in the gravitational direction) as the amount of liquid decreases, covers the first opening portion 65. Also, when the pack members 92 come into contact with the protrusion portions 61A at this contact position CP, the ink in the ink chamber IS can flow from the low pressure chamber 60D side to the filter chamber 60F side via the gaps provided between adjacent protrusion portions 61A.

Also, in this embodiment, since the second supply member 61 is formed so as to be elongated in a direction that intersects the vertical direction in accordance with the shape of the first opening portion 65, the second supply member 61 can be arranged closer to the gravitational direction side in the ink chamber IS, but this will not be described here using the drawings. As a result, a greater amount of ink can flow out before the pack body 91 (pack members 92), which undergoes deformation as ink flows out from the ink chamber IS, covers the first opening portion 65.

Also, when more ink flows out, and the pack body 91 undergoes deformation such that the gap between the pack members 92 decreases further as shown by the dashed lines in FIG. 20B, the pack body 91 comes into contact with the first flat surface FS of the second supply member 61. In this state of contact, when the pack member 92 is in contact with the protrusion portions 61B and 61C in addition to the protrusion portions 61A, ink located on the gravitational direction side in the ink chamber IS can flow into the filter chamber 60F via the gaps provided between adjacent protrusion portions 61B and 61C.

Also, as shown by the thick dashed lines and thin dashed lines in FIG. 20A, in a view in the +X direction, the first opening portion 65 of the filter chamber 60F is arranged so as to be overlapped with the interior of the second opening portion 68 of the low pressure chamber 60D. For this reason, if gases are dissolved in the ink that flowed into the filter chamber 60F, the dissolved gases are easily moved to the low pressure chamber 60D via the portion of the second supply member 61 located between the filter chamber 60F and the low pressure chamber 60D, that is to say the common member portion that forms the filter chamber 60F and the low pressure chamber 60D. Of course, in this case at least the common member portion of the second supply member 61 is formed from a resin material that has high gas permeability.

Effects in Assembly of Ink Cartridge

As shown in FIGS. 21A, 21B, 21C, 22A, 22B, and 22C, in the ink cartridge 70 (70W), before the first case member 71 and the second case member 72 are combined for assembly, the ink container 80 is supported in a positioned state of being attached to the first case member 71.

Figures 21A, 21B, 21C:
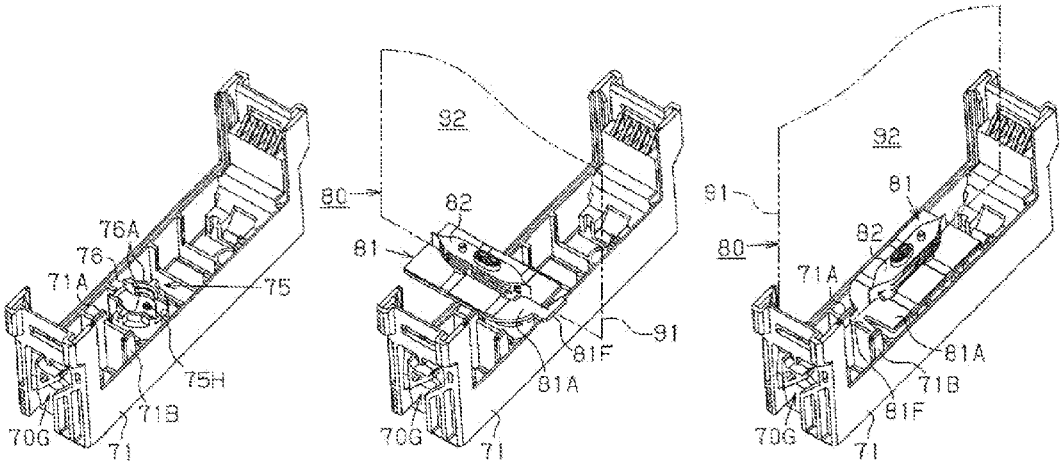
FIGS. 21A to 21C are perspective diagrams showing a supply member to be supported to a case member of an ink cartridge, and specifically
Figure 22A:
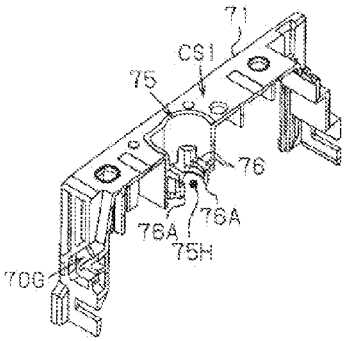
FIGS. 22A to 22C are diagrams showing states that correspond to FIGS. 21A to 21C, and the case member of the ink cartridge is in a partially-cut state.

First, as shown in FIGS. 21A and 22A, the first case member 71 is provided with the through-hole formation portion 75 that has formed therein the through-hole 75H for insertion of the tubular flow channel portion 85 provided in the first supply member 81 along with the engaged portion 86. The through-hole formation portion 75 has a recession portion that is recessed from the first surface CS1 in approximately the shape of a keyhole, and the through-hole 75H is formed in the bottom wall formed in the recession portion in a direction approximately parallel to the first surface CS1. Also, a support portion 76 is provided in the bottom wall surrounding the formed through-hole 75H, and the support portion 76 is provided with a contact portion 76A that comes into contact with the base portion 81A of the inserted first supply member 81, on the side opposite to the first surface CS1 side, which is the side into which the first supply member 81 (tubular flow channel portion 85) is inserted.

Figure 22B:
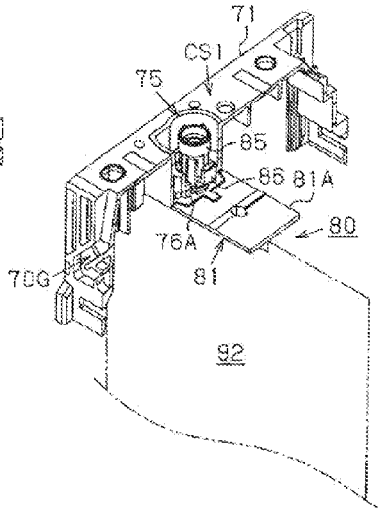

Next, as shown in FIGS. 21B and 22B, the tubular flow channel portion 85 provided in the first supply member 81 and the engaged portion 86 are inserted into the through-hole formation portion 75 of the first case member 71 via the through-hole 75H. In other words, the through-hole 75H is formed with a shape that allows passage of the tubular flow channel portion 85 and the engaged portion 86. During this insertion, the insertion orientation of the ink container 80 is such that the lengthwise direction of the joining portion 82 is a direction that intersects the lengthwise direction of the first case member 71. Note that in this embodiment, this is 90 degrees relative to the lengthwise direction of the first case member 71. Also, at this time, the user can easily identify the insertion orientation by the base portion 81A that has an asymmetrical shape.

Also, the first engaged portion 86A of the engaged portion 86 and the support portion 76 of the through-hole formation portion 75 are provided such that when the first supply member 81 is inserted to the position at which the contact portion 76A of the first case member 71 comes into contact with the base portion 81A, the first engaged portion 86A and the support portion 76 are located at non-overlapping positions in a view in a direction that intersects (here, is orthogonal to) the insertion direction.

Figure 22C:
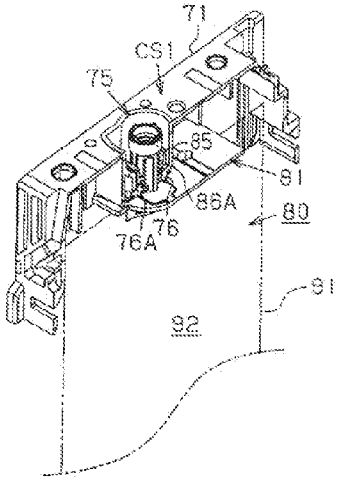

Next, as shown in FIGS. 21C and 22C, when the tubular flow channel portion 85 is inserted into the through-hole 75H of the first case member 71 (through-hole formation portion 75), the first supply member 81 is rotated about the tubular flow channel portion 85 with the insertion direction serving as the axis line direction, in a state of contact with the contact portion 76A. In this embodiment, the first supply member 81 is rotated 90 degrees in the clockwise direction in a view from the forward side in the insertion direction of the tubular flow channel portion 85. Due to this rotation, the lengthwise direction of the base portion 81A of the first supply member 81 conforms to the direction along the lengthwise direction of the first case member 71, and the first engaged portion 86A moves to an engagement position overlapped with the support portion 76 in a view in the insertion direction. As a result, in the ink container 80, movement of the tubular flow channel portion 85 in the insertion direction and the direction opposite thereto in the through-hole formation portion 75 is restricted by the engagement of the first engaged portion 86A and the support portion 76, and thus the ink container 80 is attached and supported to the first case member 71 in a positioned state in which movement of the ink container 80 in the insertion direction is constrained. Note that in this embodiment, in the state in which the ink container 80 is supported in a state of being positioned with respect to the first case member 71, the first engaged portion 86A of the tubular flow channel portion 85 engages with the support portion 76 of the through-hole formation portion 75 with no gap in the insertion direction due to the column 86P projecting on the base portion 81A side. At this point, the support portion 76 functions as an engagement portion that engages with the first supply member 81 so as to restrict movement of the first supply member 81 in the insertion direction and the direction opposite thereto.

Furthermore, as shown in FIG. 21C, a lock portion is provided for, when the ink container 80 is attached to the first case member 71, restricting rotation of the tubular flow channel portion 85 while the first engaged portion 86A of the tubular flow channel portion 85 is engaged with the support portion 76, by locking to the first supply member 81. Specifically, as lock portions, the first case member 71 is provided with a first projection portion 71A and a second projection portion 71B that project toward the attached first supply member 81 side within the rotation trajectory of the L-shaped portion 81F provided on the first supply member 81 that rotates in the clockwise direction.

The first projection portion 71A functions as a lock portion that locks the first supply member 81 on the rotation direction side by coming into contact with the rotation direction side of the L-shaped portion 81F that rotates on the rotation direction side when the ink container 80 is attached to the first case member 71. On the other hand, the second projection portion 71B functions as a lock portion that locks the first supply member 81 on the counter-rotation direction side by coming into contact with the L-shaped portion 81F on the rotation direction side opposite to the rotation direction side when the ink container 80 is attached to the first case member 71. Also, the L-shaped portion 81F functions as a locked portion.

Figure 23:
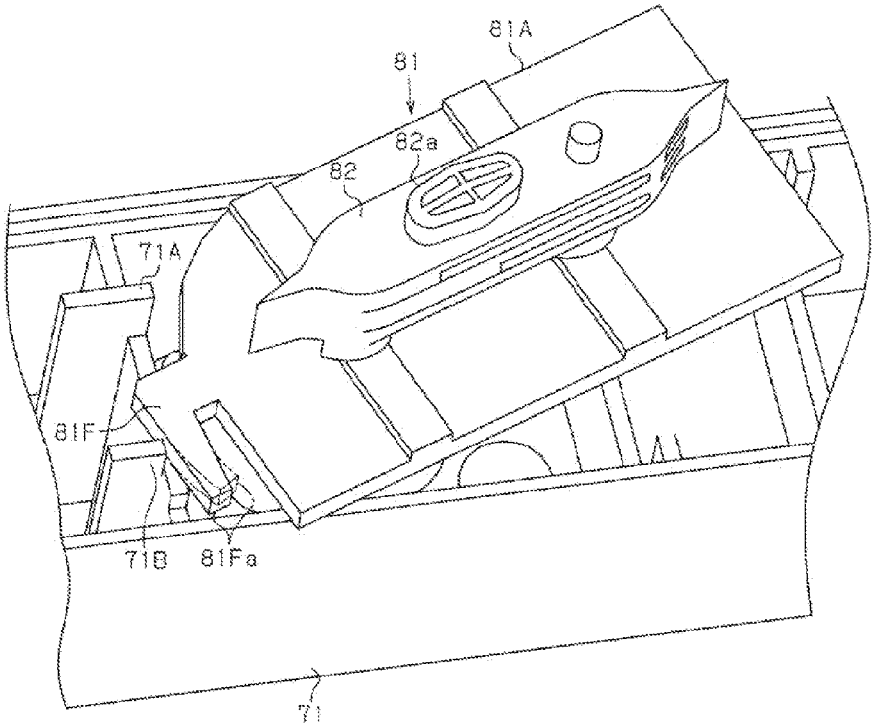
FIG. 23 is an illustrative diagram showing deformation of an L-shaped portion provided on the supply member.

For this reason, as shown in FIG. 23, the L-shaped portion 81F is formed so as to undergo deformation as shown by dashed double-dotted lines in FIG. 23 during rotation when the ink container 80 (first supply member 81) is rotated in the clockwise direction to be attached to the first case member 71. Specifically, the L-shaped portion 81F is formed such that a claw portion 81Fa formed on the rear side in the rotation direction engages with the second projection portion 71B during rotation, and then after the claw portion 81Fa has undergone deformation once along with the rotation, the engagement with the second projection portion 71B is canceled and the deformation immediately reverts such that the claw portion 81Fa is locked to the second projection portion 71B. Accordingly, when the user rotates the ink container 80 in the clockwise direction for attachment to the first case member 71, the user can easily perceive the state of being rotated to the attachment position by the change in rotation force generated when the deformation of the claw portion 81Fa reverts. Note that it is preferable that the deformation of the claw portion 81Fa is elastic deformation.

Accordingly, in this embodiment, the ink container 80 can be removed from the first case member 71. Specifically, the ink container 80 can be removed from the first case member 71 by, when the claw portion 81Fa is locked to the second projection portion 71B, canceling the locking to the second projection portion 71B by deforming the claw portion 81Fa as shown by dashed double-dotted lines in FIG. 23, and then rotating the ink container 80 (first supply member 81) in the counter-clockwise direction.

Effects in Mounting of Ink Cartridge to Mounting Portion

Next, out of the four ink cartridges 70 inserted into the cartridge holding body 22 of the mounting portion 20, the following describes the case in which the wide ink cartridge 70W is inserted at the position farthest on the minus side in the ±X direction in the cartridge holding body 22. Note that the effects in the mounting portion 20 are similar with the three ink cartridges 70 inserted at the other positions, and also with an ink cartridge 70 inserted at the position farthest on the minus side in the ±X direction in the cartridge holding body 22.

Figure 24:
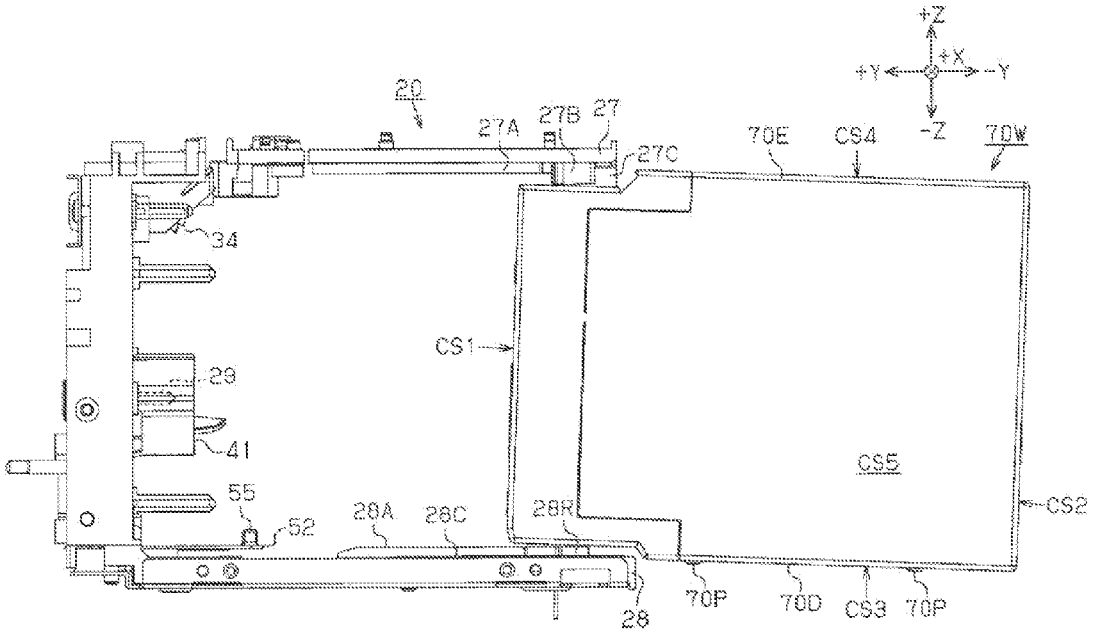
FIG. 24 is a side view of a state in which insertion of the ink cartridge into the mounting portion has started.

As shown in FIG. 24, when the ink cartridge 70W is inserted from the opening side of the cartridge holding body 22 into the space between the insertion guiding portions 27C projecting from the ceiling member 27 of the cartridge holding body 22, the +Y direction side of the third surface CS3 (bottom surface) is placed on the lower guide ribs 28A (arc-shaped rib 28R) on the bottom member 28. Accordingly, in this state at the beginning of insertion, the fifth surface CS5 and the sixth surface CS6 of the ink cartridge 70W serve as guide wall portions that are guided by the insertion guiding portions 27C of the cartridge holding body 22, and their positions in the ±X direction are roughly determined. Note that in order to facilitate insertion of the ink cartridge 70W (70W), a gap is provided between the insertion guiding portions 27C and the fifth surface CS5 of the inserted ink cartridge 70W, or a gap is provided between the insertion guiding portions 27C and the sixth surface CS6.

Also, in this state at the beginning of insertion, the upper protrusion portions 70E and the lower protrusion portions 70D of the ink cartridge 70W are located at positions that do not yet oppose the upper guide ribs 27A and the lower guide ribs 28A of the cartridge holding body 22 in the ±X direction. Also, the four projection portions 70P provided on the third surface have not yet been inserted into the cartridge holding body 22. Accordingly, the ink cartridge 70W is in a state in which an appropriate positioning operation has not yet been performed in the mounting portion 20, and the position is unstable. Note that there is a high probability that the side of the ink cartridge 70W in the direction opposite to the +Y direction, which is the insertion direction, (i.e., the −Y direction side) will be inclined downward in the gravitational direction due to the weight of the ink stored in the ink container 80 or the like, and therefore this inclined state is shown in FIG. 24.

Figure 25:
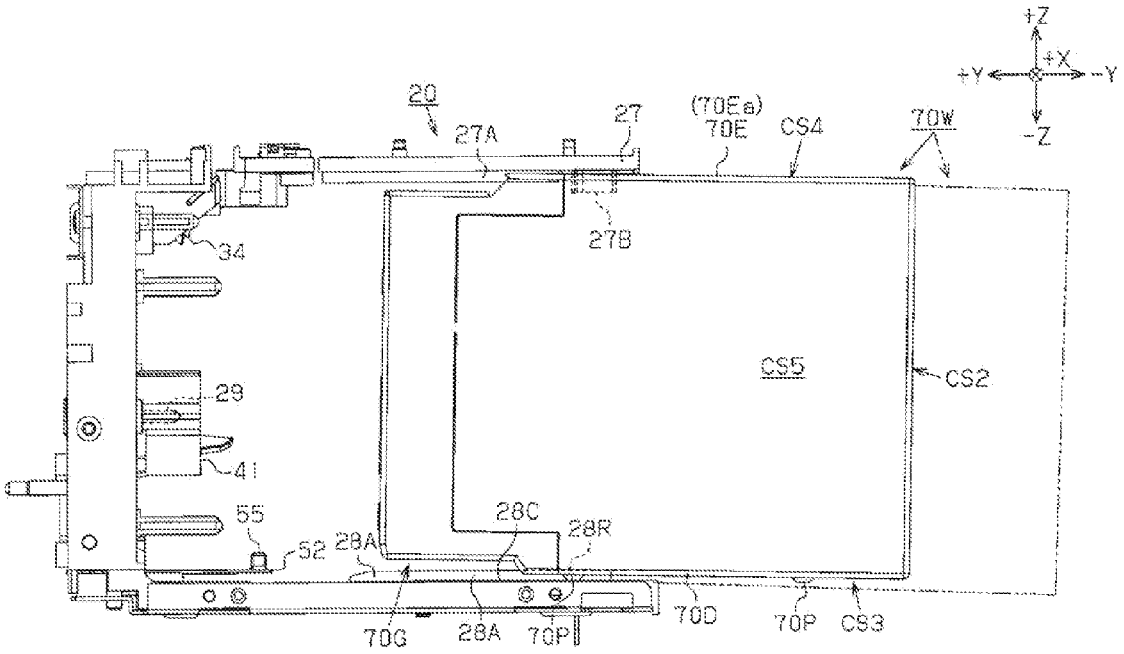
FIG. 25 is a side view of a state in which insertion of the ink cartridge into the mounting portion is in progress.

Next, as shown in FIG. 25, in the mid-insertion state of the ink cartridge 70W in which it is pushed farther from the start-of-insertion state shown by dashed double-dotted lines in FIG. 25, the ink cartridge 70W is positioned by being guided by the arc-shaped rib 28R of the lower guide ribs 28A. Specifically, as the ink cartridge 70W is pushed farther, the arc-shaped rib 28R of the lower guide ribs 28A enters the space between the lower protrusion portions 70D formed on the third surface CS3 (bottom surface). Due to the entrance of the arc-shaped rib 28R, the +Y direction side of the third surface CS3 (bottom surface) side of the ink cartridge 70W opposes the lower guide ribs 28A of the bottom member 28. Also, the upper protrusion portions 70E (inner protrusion portions 70Ea) are also located at positions opposing the upper guide ribs 27A, and the position of the ink cartridge 70W in the ±X direction is restricted on both the third surface CS3 (bottom surface) side and the fourth surface CS4 (upper surface) side. As a result, the ink cartridge 70W is roughly positioned in the ±X direction in the mounting portion 20.

Figure 28A:
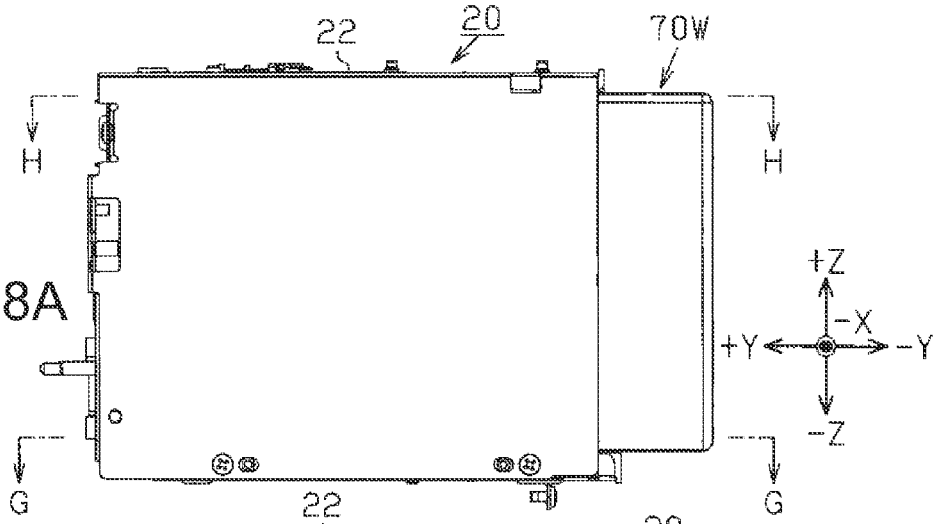
FIGS. 28A, 28B, and 28C are diagrams showing a state in which a lever member of the mounting portion begins to engage with a groove portion of the ink cartridge, and specifically
Figure 28B:
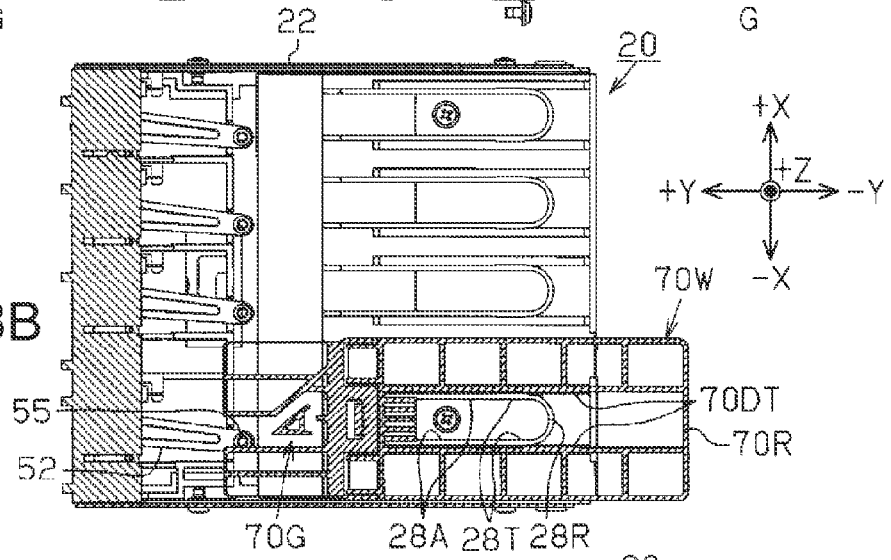
Figure 28C:
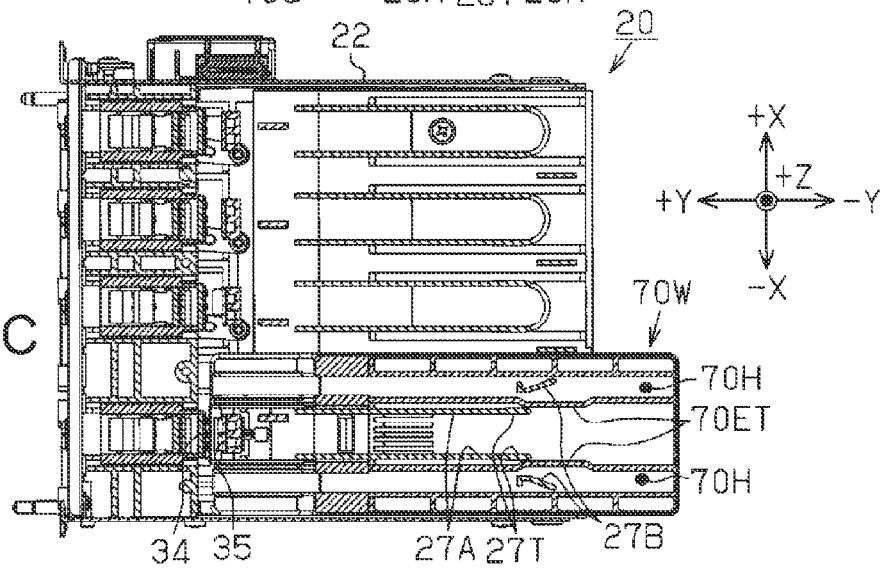

Note that in this mid-insertion state, the guiding portions 27B of the cartridge holding body 22 are inserted into the recessed grooves 70H provided in the ink cartridge 70W so as to avoid inhibiting mounting of the ink cartridge 70W to the mounting portion 20 (see FIG. 28C). Also, the linking ribs 70R provided on the second surface CS2 side of the third surface CS3 of the ink cartridge 70W are separated in the +Y direction rather than being in contact with the arc-shaped rib 28R of the lower guide ribs 28A of the cartridge holding body 22, and therefore mounting of the ink cartridge 70W to the mounting portion 20 is not inhibited (see FIGS. 28B and 29B).

Figure 26:
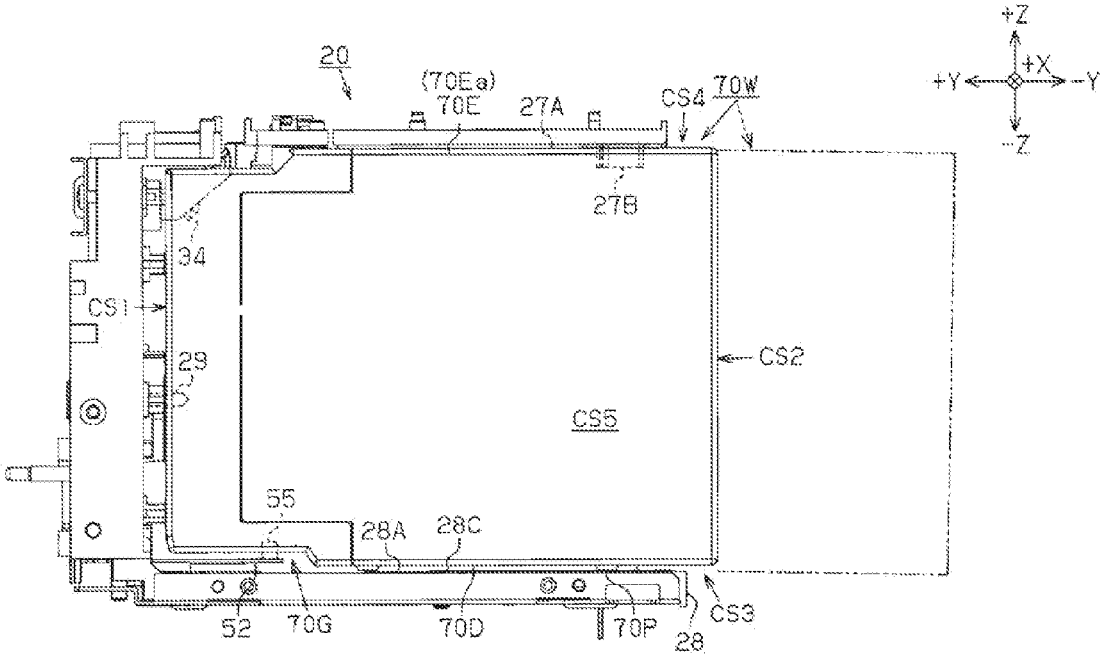
FIG. 26 is a side view of a state in which the ink cartridge has been mounted to the mounting portion.

Next, as shown in FIG. 26, when the ink cartridge 70W is pushed from the mid-insertion state shown by dashed double-dotted lines in FIG. 26, the moving body 41 moves in the +Y direction, and the supply needle 29 is inserted into the liquid supply opening 81K (see FIG. 9A). Also, the second electrode 34 on the mounting portion 20 side and the first electrode 35 on the ink cartridge 70 side (see FIG. 9A) come into contact to achieve an electrically connected mounted state.

Figure 27:
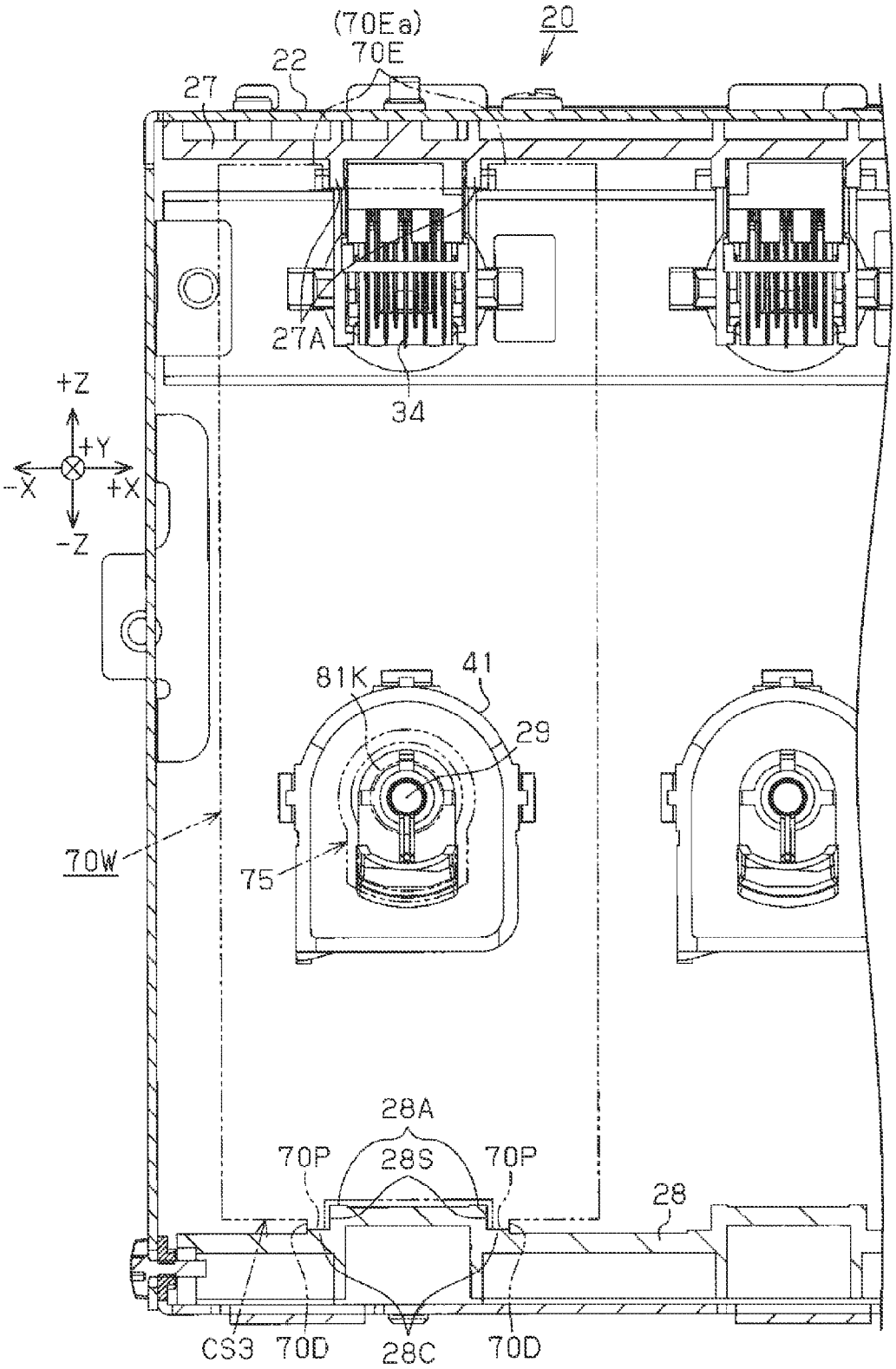
FIG. 27 is a partial enlarged view of the mounting portion viewed in the ink cartridge insertion direction.

As shown in FIG. 27, as the ink cartridge 70W moves in the +Y direction to reach this mounted state, the ink cartridge 70W moves while maintaining the state of being positioned in ±X direction in the mounting portion 20 due to the lower protrusion portions 70D and the lower guide ribs 28A that oppose each other in the ±X direction and the upper protrusion portions 70E and the upper guide ribs 27A that oppose each other in the ±X direction. Also, in this movement, in the mid-insertion state, among the four projection portions 70P provided on the third surface CS3 of the ink cartridge 70W, the two projection portions 70P located on the +Y direction side slide in contact with the belt-like rail surface 28C. Furthermore, in the mounted state and the movement up to the mounted state as well, among the four projection portions 70P provided on the third surface CS3 of the ink cartridge 70W, the two projection portions 70P located on the side opposite to the +Y direction side are in contact with the belt-like rail surface 28C as shown in FIG. 27, or slide in contact with it.

As a result, at least two of the projection portions 70P slide while in contact with the belt-like rail surface 28C, and thus the ink cartridge 70 moves in a stable state in which rotation with the +Y direction serving as the axis line and rotation with the ±X direction serving as the axis line are suppressed. Also, in the mounted state as well, the two projection portions 70P provided with an interval therebetween in the ±X direction and the belt-like rail surface 28C are in contact with each other so as to achieve a stable state in which rotation with the +Y direction serving as the axis line is suppressed.

Also, as shown in FIG. 26, when the ink cartridge 70W enters the mounted state, the groove portion 70G provided on the third surface CS3 is positioned in the +Y direction by being engaged with the lever member 52. In this positioning, the groove portion 70G is subjected to biasing force from the lever member 52 toward the +Z direction (counter-gravitational direction) side, that is to say upward. For this reason, there are cases where the +Y direction side of the ink cartridge 70 is lifted upward by the biasing force of the lever member 52.

In such a case, even if the two projection portions 70P located on the +Y direction side become separated from the belt-like rail surface 28C, the ink cartridge 70 is maintained in the stable state in which rotation with the ±X direction serving as the axis line is suppressed by the two projection portions 70P that are in contact with the belt-like rail surface 28C on the side in the direction opposite to the +Y direction as shown in FIG. 27. Accordingly, positional shift of the liquid supply opening 81K provided in the first surface CS1 relative to the supply needle 29 is suppressed, and thus the supply needle 29 is stably inserted into the liquid supply opening 81K.

Furthermore, in this embodiment, due to the engagement of the groove portion 70G and the lever member 52, when the ink cartridge 70W is locked to the mounting portion 20, the ink cartridge 70W is positioned in a state in which there is no gap and movement in the ±X direction is constrained.

Specifically, as shown in FIGS. 28A, 28B, and 28C, first the ink cartridge 70W is pushed to a position at which engagement of the pin 55 of the lever member 52 to the groove portion 70G starts, and engagement of the rib portions 28T of the lower guide ribs 28A with the lower protruding wall portions 70DT formed on the lower inner wall 70B of the ink cartridge 70W starts. Also, the rib portions 27T of the upper guide ribs 27A start to engage with the upper protruding wall portions 70ET formed on the upper inner wall 70A of the ink cartridge 70W. In other words, the rib portions 28T of the lower guide ribs 28A and the lower protruding wall portions 70DT are formed at positions where this engagement starts.

Due to this engagement starting, the ink cartridge 70W enters a state where there is no gap in the ±X direction between the rib portions 28T of the lower guide rib 28A and the lower protruding wall portions 70DT (provisionally referred to as the lower gap), and no gap in the ±X direction between the rib portions 27T of the upper guide ribs 27A and the upper protruding wall portions 70ET (provisionally referred to as the upper gap).

Alternatively, the lower gap and the upper gap may be gaps that are smaller than the gap between the lower guide ribs 28A and the lower inner wall 70B and the gap between the upper guide ribs 27A and the upper inner wall 70A. Also, in the state in which there are no gaps, there is no problem if in the engagement, pressing force is generated between the rib portions 28T of the lower guide ribs 28A and the lower protruding wall portions 70DT, or between the rib portions 27T of the upper guide ribs 27A and the upper protruding wall portions 70ET.

In this way, when the ink cartridge 70W is inserted into the mounting portion 20 and the state in which there are no gaps in the ±X direction is achieved, the groove portion 70G is engaged with the lever member 52 serving as the movable lock portion without positional shift. Accordingly, the lever member 52 moves smoothly along the cam shape formed in the groove portion 70G. Note that in the states shown in FIGS. 28A, 28B, and 28C, insertion of the supply needle 29 into the liquid supply opening and electrical connection of the first electrode 35 and the second electrode 34 have not yet been performed.

Figure 29A:
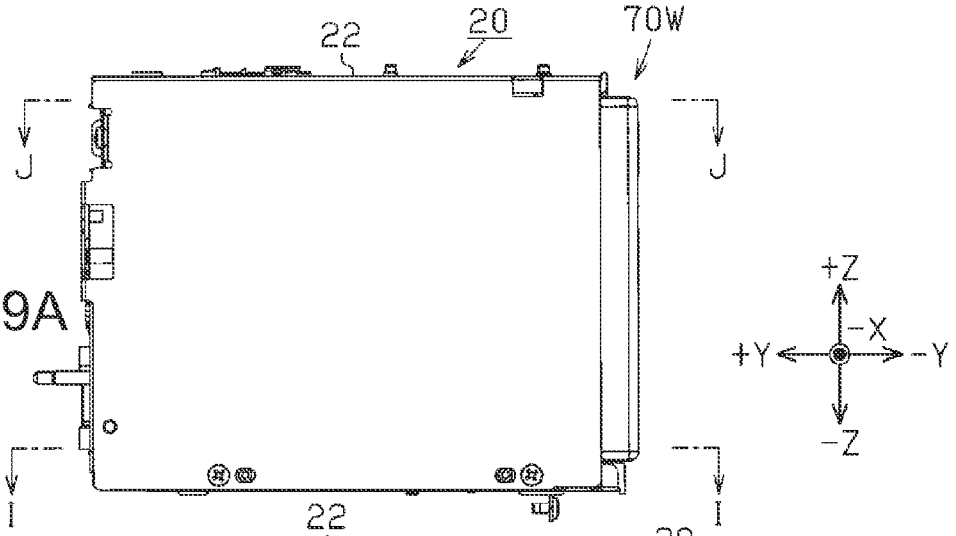
FIGS. 29A, 29B, and 29C are diagrams showing a state in which the ink cartridge is at a deepest position in the mounting portion, and specifically
Figure 29B:
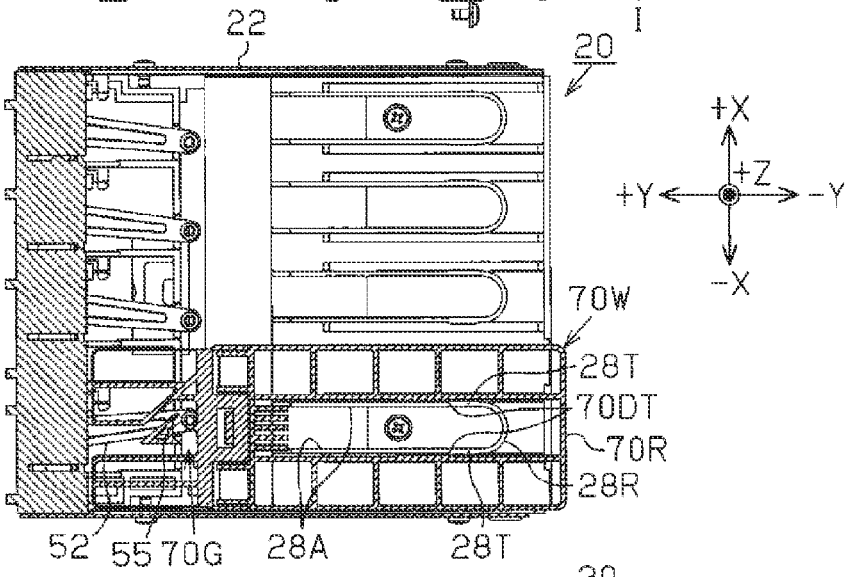
Figure 29C:
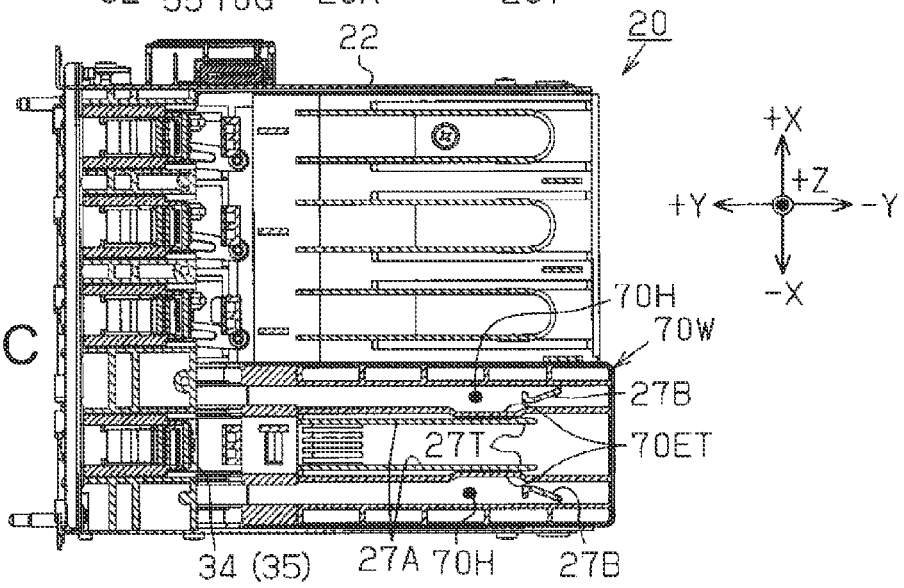

Next, as shown in FIGS. 29A, 29B, and 29C, the inserted ink cartridge 70W is pushed to the deepest position, which is the position farthest back in the mounting portion 20 in the +Y direction. Specifically, it is pushed until the position of the pin 55 of the lever member 52 relative to the groove portion 70G reaches the position indicated by reference sign 55B in FIG. 11A. In this pushed state, in this embodiment, the lower protruding wall portions 70DT that moved in the +Y direction are maintained in a state of engagement with the rib portions 28T of the lower guide ribs 28A. Specifically, the lower protruding wall portions 70DT move relatively in the +Y direction in a range in which engagement with the rib portions 28T is maintained. Also, the rib portions 27T of the upper guide ribs 27A are also maintained in the state of engagement with the upper protruding wall portions 70ET formed on the upper inner walls 70A of the ink cartridge 70W. In other words, the rib portions 28T of the lower guide ribs 28A, the lower protruding wall portions 70DT, the rib portions 27T of the upper guide ribs 27A, and the upper protruding wall portions 70ET are formed with predetermined lengths according to which the above engagement is maintained.

Due to this engagement being maintained, the ink cartridge 70W moves in the +Y direction while maintaining the state in which there are no gaps in the ±X direction, and thus the lever member 52 engages with the groove portion 70G, for which positional shift in the ±X direction accompanying insertion is suppressed. Also, at this time, the supply needle 29 is inserted in the liquid supply opening 81K with positional shift being suppressed, and the first electrode 35 is connected to the second electrode 34 with positional shift being suppressed.

Also, when the supply needle 29 is inserted into the liquid supply opening 81K, the moving body 41 is pushed in the +Y direction as the ink cartridge 70W moves, and thus the first biasing member 48 (see FIG. 10B) is compressed, and the ink cartridge 70 is subjected to biasing force from the first biasing member 48. Accordingly, by pushing the mark MK (see FIG. 8E) that is displayed on the label 74 on the second surface CS2 of the ink cartridge 70W and indicates the pushing position, the user can stably push the ink cartridge 70W in the +Y direction in resistance to the biasing force from the first biasing member 48 while rotation with the bottom surface side serving as the support point is suppressed.

Figure 30A:
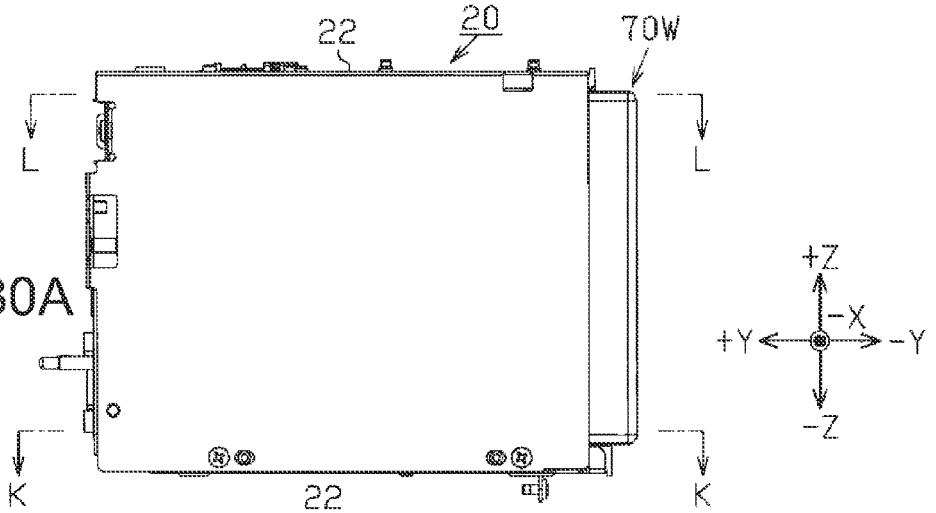
FIGS. 30A, 30B, and 30C are diagrams showing a state in which the ink cartridge is at a mounted position in the mounting portion, and specifically
Figure 30B:
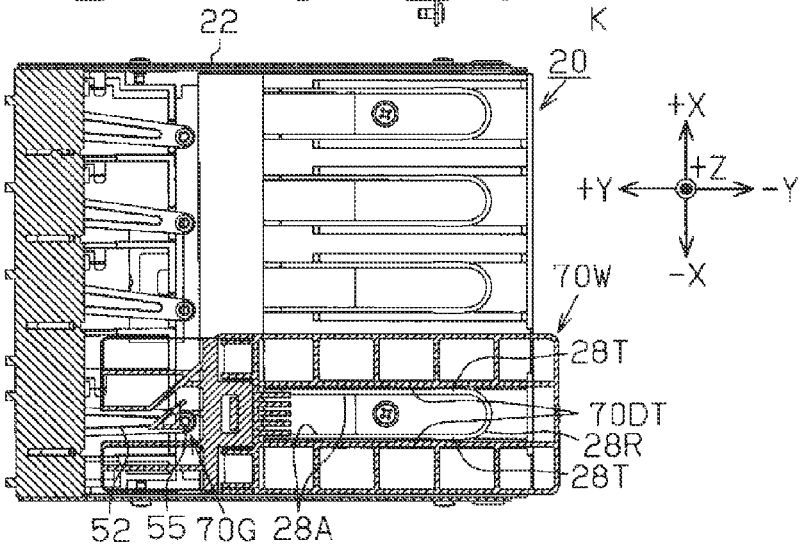
Figure 30C:
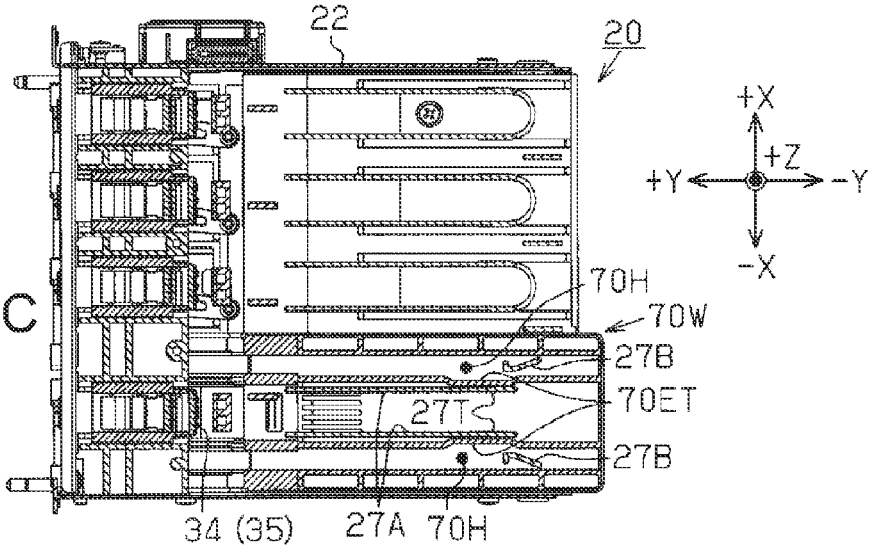

Next, as shown in FIGS. 30A, 30B, and 30C, when the pushing of the ink cartridge 70W at the deepest position in the +Y direction is canceled, the ink cartridge 70W is pressed back in the removal direction by the biasing force from the first biasing member 48. Accordingly, the pin 55 of the lever member 52 moves to the restricted position in the groove portion 70G (see reference sign 55C in FIG. 11A), and thus the ink cartridge 70W moves to the mounting position of being locked by the lever member 52 so as to not come out of the cartridge holding body 22. Accordingly, the biasing force of the first biasing member 48 is set such that, even if pressing force is generated between the rib portions 28T of the lower guide ribs 28A and the lower protruding wall portions 70DT, or pressing force is generated between the rib portions 27T of the upper guide ribs 27A and the upper protruding wall portions 70ET, the first biasing member 48 moves the ink cartridge 70W against such pressing force.

In the movement of the ink cartridge 70W from the deepest position to the mounting position, the lower protruding wall portions 70DT moving in the removal direction are maintained in the state of engagement with the rib portions 28T of the lower guide ribs 28A. Also, the rib portions 27T of the upper guide ribs 27A are also maintained in the state of engagement with the upper protruding wall portions 70ET formed on the upper inner walls 70A of the ink cartridge 70W. Of course, the contact between the first electrode 35 and the second electrode 34 is maintained. Also, when the ink cartridge 70W is at the mounting position, the state in which the supply needle 29 is inserted into the liquid supply opening 81K is maintained.

In this way, when the groove portion 70G is locked by engaging with the lever member 52, which is the movable lock portion, the upper protruding wall portions 70ET and the lower protruding wall portions 70DT of the ink cartridge 70W function as positioning portions that are positioned in the mounting portion 20 by the rib portions 27T of the upper guide ribs 27A and the rib portions 28T of the lower guide ribs 28A. Also, in this embodiment, when the ink cartridge 70W is mounted to the mounting portion 20, the upper protruding wall portions 70ET and the lower protruding wall portions 70DT that function as positioning portions are arranged so as to be located on two sides with the upper guide ribs 27A and the lower guide ribs 28A therebetween, and position the ink cartridge 70W in a direction that intersects the +Y direction, which is the insertion direction.

Note that when the ink cartridge 70W at this mounting position is again pushed toward the +Y direction side in resistance to the biasing force of the first biasing member 48, the ink cartridge 70W again moves to the deepest position shown in FIGS. 29A, 29B, and 29C. Due to the movement to the deepest position, the state of engagement of the groove portion 70G and the pin 55 of the lever member 52 is then canceled, and the ink cartridge 70W is pushed back via the moving body 41 by the biasing force of the first biasing member 48 to a position where it can be removed by the user.

Effects such as the following can be obtained according to the embodiment described above.

(1) Since both the filter chamber 60F and the low pressure chamber 60D are provided in the ink chamber IS, it is possible to suppress a case in which ink that includes air bubbles (gas) or foreign objects other than air bubbles (e.g., contaminants or debris) flows out from the ink chamber IS via the liquid supply opening 81K.

(2) Since at least a portion of the filter chamber 60F and the low pressure chamber 60D is formed by a common member, the filter chamber 60F and the low pressure chamber 60D can be formed at adjacent positions. Accordingly, there is an increased probability that gases will be expelled from the ink flowing into the filter chamber 60F by the adjacent low pressure chamber 60D. Also, since the filter chamber 60F and the low pressure chamber 60D can be formed with a smaller volume overall by being formed with a common member, it is possible to suppress a reduction in the amount of ink that can be stored in the ink chamber IS.

(3) Due to the filter chamber 60F being overlapped with the low pressure chamber 60D in the direction in which the projected area of the filter chamber 60F is largest, air bubbles (gas) in the filter chamber 60F can be easily and effectively caused to flow to the low pressure chamber 60D.

(4) The first opening portion 65 can be located on the gravitational direction side in the vertical direction in the ink chamber IS. Accordingly, the ink in the ink container 80 that decreases in amount as it flows out from the liquid supply opening 81K physically remains on the gravitational direction side, thus making it possible to easily flow into the filter chamber 60F via the first opening portion 65 located on the gravitational direction side.

(5) The members constituting the filter chamber 60F and the low pressure chamber 60D is replaceable. Accordingly, they can be replaced when necessary during the manufacturing of the ink container 80, for example. Also, the filter 66 of the filter chamber 60F can be changed, for example.

(6) Ink can be guided to the filter chamber 60F by being caused to flow through the gaps formed by the protrusion portions 61A, 61B, and 61C so as to not remain in the ink chamber IS.

(7) Deformation of the filter 66 in the filter chamber 60F is restricted by the rib 64*b*, thus making it possible to suppress a decrease in the area of the filter chamber 60F and suppress damage to the filter 66 due to such deformation.

(8) The flow rate of ink flowing to the first supply member 81 side in the filter chamber 60F decreases, thus making it possible to facilitate the flow of ink to the liquid supply opening 81K.

(9) Gas can be expelled from the ink in the filter chamber 60F by the low pressure chamber 60D configured by the second supply member 61, thus making it possible to suppress the outflow of ink that includes contaminants and air bubbles (gas) from the ink chamber IS.

(10) Air is allowed to escape to the spaces 83 due to the connection of the pack body 91 and the first supply member 81, and the expansion of air in the spaces 83 that accompanies a change in temperature is suppressed by the communication opening 84, thus making it possible to suppress deterioration of the connection between the pack body 91 and the first supply member 81.

(11) The case where the communication opening 84 is easily obstructed by a round bar or the like is suppressed, thus making it possible to suppress expansion of air in the spaces 83 that accompanies a change in temperature by the communication opening 84, and suppress deterioration of the connection (adhesion) between the pack body 91 and the first supply member 81 (joining portion 82).

(12) Obstruction of the communication opening 84 by a sheet or the like is suppressed, thus making it possible to allow air to escape to the spaces 83 in the joining of the pack body 91 and the first supply member 81, as well as suppress expansion of air in the spaces 83 that accompanies a change in temperature by the communication opening 84, and suppress deterioration of the connection between the pack body 91 and the first supply member 81.

(13) Since foreign objects adhering to the step portion 81D and the like are located on the gravitational direction side relative to the communication opening 84, blockage of the communication opening 84 is suppressed. As a result, it is possible to suppress expansion of air in the spaces 83 that accompanies a change in temperature by the communication opening 84, and suppress deterioration of the connection between the pack body 91 and the first supply member 81.

(14) Since it is possible for blockage of the communication opening 84 to be suppressed with a high probability by the step provided by the step portion 81D, it is possible to suppress expansion of air in the spaces 83 that accompanies a change in temperature by the communication opening 84, and suppress deterioration of the connection between the pack body 91 and the first supply member 81.

(15) Since blockage of the communication opening 84 located on the +Z direction side of the liquid supply opening 81K by ink that leaked out from the liquid supply opening 81K is suppressed, it is possible to suppress expansion of air in the spaces 83 that accompanies a change in temperature by the communication opening 84, and suppress deterioration of the connection between the pack body 91 and the first supply member 81.

(16) Since the communication opening 84 is concealed in the state of being mounted to the printer 11, blockage of the communication opening 84 is suppressed. As a result, it is possible to suppress expansion of air in the spaces 83 that accompanies a change in temperature by the communication opening 84, and suppress deterioration of the connection between the pack body 91 and the first supply member 81.

(17) The ink cartridge 70 (70W) can include the ink container 80 in which deterioration of the connection between the pack body 91 and the first supply member 81 is suppressed.

(18) In the state in which the tubular flow channel portion 85 of the first supply member 81 is inserted into the through-hole 75H in the first case member 71, the ink container 80 is positioned by being engaged with the first case member 71 by being rotated with the +Y direction, which is the insertion direction, serving as the axis line. Accordingly, the first supply member 81 of the ink container 80 can be supported in the state of being positioned relative to the first case member 71 with a simple structure (and few steps). This results in obtaining an ink cartridge 70 (70W) in which movement of the ink container 80 is suppressed even when subjected to impact due to being dropped or the like.

(19) The first supply member 81 is locked by the first projection portion 71A and the second projection portion 71B that restrict rotation in a state of engagement such that movement of the tubular flow channel portion 85 in the direction opposite to the insertion direction of the through-hole formation portion 75 is restricted, thus making it possible to maintain a state in which the first supply member 81 is supported while being positioned relative to the first case member 71.

(20) Due to deformation of the claw portion 81Fa, it is possible to perceive the state in which the L-shaped portion 81F of the first supply member 81 is locked to the first projection portion 71A and the second projection portion 71B of the first case member 71, thus making it possible for the first supply member 81 to be reliably supported to the first case member 71.

(21) A rotation angle of 90 degrees when the first supply member 81 is attached to the first case member 71 easily serves as a rough standard, and facilitates assembly.

(22) When the first supply member 81 is supported to the first case member 71, removal in the direction opposite to the insertion direction is suppressed by the state of engagement of the engaged portion 86 of the tubular flow channel portion 85 to the support portion 76 of the through-hole formation portion 75, thus making it possible to achieve a state of being firmly positioned and supported to the first case member 71.

(23) By rotating the first supply member 81 in a state in which movement of the tubular flow channel portion 85 in the +Y direction is constrained, the first supply member 81 can be easily and reliably supported to the first case member 71.

(24) When the first supply member 81 is supported to the first case member 71, it is possible to suppress a mistaken insertion orientation of the first supply member 81 when inserting the tubular flow channel portion 85 into the through-hole 75H.

(25) Since the ink cartridge 70 (70W) is positioned at multiple locations by the protrusion portions 70C provided on surfaces that oppose each other in a direction that intersects the +Y direction in the state of being mounted to the mounting portion 20, the ink cartridge 70 (70W) can be mounted to the mounting portion 20 in a stable state.

(26) The ink cartridge 70 (70W) that is biased upward in the vertical direction can be positioned while suppressing tilting in the mounting portion 20.

(27) Since rotation of the ink cartridge 70 (70W) with the +Y direction serving as the axis line is suppressed during mounting to the mounting portion 20, the ink cartridge 70 (70W) is mounted in a stable state in which positional shift of the liquid supply opening 81K is suppressed.

(28) Since tilting of the first electrode 35 of the circuit board 30 is suppressed during mounting to the mounting portion 20, positional shift of the first electrode 35 relative to the mounting portion 20 is suppressed. This enables information regarding ink that is sent from the printer 11 to be stably stored.

(29) If biasing force for electrical connection is applied to the first electrode 35, biasing force in the removal direction is generated by inclination during mounting to the mounting portion 20, thus making it possible to stably remove the ink cartridge 70 (70W) from the mounting portion 20.

(30) Rotation with the bottom surface (third surface CS3) side of the ink cartridge 70 (70W) serving as the support point is suppressed by biasing force in the removal direction during mounting to the mounting portion 20, thus making it possible to stably mount the ink cartridge 70 (70W) to the mounting portion 20.

(31) With regard to the protrusion portions 70C, when the ink cartridge 70 (70W) is inserted into the mounting portion 20, the lower protrusion portions 70D roughly position the ink cartridge 70 (70W), and the ink cartridge 70 (70W) is precisely positioned by the projection portions 70P when mounted to the mounting portion 20. Accordingly, the ink cartridge 70 (70W) can be stably mounted to the mounting portion 20.

(32) In the case where the ink cartridge 70 (70W) is inserted backwards into the mounting portion 20 with the second surface CS2 side as the insertion side, the linking rib 70R will be pushed to the back of the mounting portion 20, in contrast with the case where the ink cartridge 70 (70W) is correctly inserted into the mounting portion 20 with the first surface CS1 side as the insertion side. Accordingly, due to providing the arc-shaped rib 28R that engages with the linking rib 70R if the ink cartridge 70 (70W) is inserted backwards into the mounting portion 20, it is possible to suppress the case where the ink cartridge 70 (70W) is improperly inserted into the mounting portion 20.

(33) Since the ink cartridge 70 (70W) is positioned during mounting due to the groove portion 70G being locked to the lever member 52 in the mounting portion 20, the operation of mounting the ink cartridge 70 (70W) to the mounting portion 20 is performed smoothly, and the ink cartridge 70 (70W) is reliably locked to the mounting portion 20 when the mounting is complete.

(34) When the ink cartridge 70 (70W) is inserted into and mounted to the mounting portion 20, rotation of the ink cartridge 70 (70W) in a direction that intersects the +Y direction is restricted, and thus the groove portion 70G reliably engages with the lever member 52 when the ink cartridge 70 (70W) is mounted.

(35) The ink cartridge 70 (70W) is guided due to the lower inner walls 70B of the lower protrusion portions 70D opposing the rib side surfaces 28S of the lower guide ribs 28A, and due to the lower protruding wall portions 70DT provided on the lower protrusion portions 70D, the groove portion 70G is reliably engaged with the lever member 52 and also reliably locked by the lever member 52.

(36) The upper protruding wall portions 70ET and the lower protruding wall portions 70DT of the ink cartridge 70 (70W) are located on the two sides of the upper guide ribs 27A and the lower guide ribs 28A, thus making it possible to more reliably position the ink cartridge 70 (70W) in the mounting portion 20.

(37) Since positional shift of the groove portion 70G and the lever member 52 is suppressed, the groove portion 70G and the lever member 52 can be more reliably locked.

(38) Since the electrical connection portion of the ink cartridge 70 (70W) is provided in the extension region R4 of the surface sandwiched between the pair of upper protruding wall portions 70ET, electrical connection with the electrical connection portion on the printer 11 side is reliably performed due to being positioned by the upper protruding wall portions 70ET.

(39) The liquid supply opening 81K is also positioned in a state in which positional shift is suppressed by the upper protruding wall portions 70ET and the lower protruding wall portions 70DT, and thus is reliably connected to the supply needle 29 of the mounting portion 20 of the printer 11.

(40) When the ink cartridge 70 (70W) is inserted into the mounting portion 20, it can be inserted so as to be guided by the insertion guiding portions 27C, thus making it possible to mount the ink cartridge 70 (70W) to the mounting portion 20 at an appropriate position.

(41) Since the upper protrusion portions 70E and the lower protrusion portions 70D are guided by the upper guide ribs 27A and the lower guide ribs 28A respectively, and the guiding portions 27B are inserted into the recessed grooves 70H, the wide ink cartridge 70W can be easily mounted at an appropriate position when inserted into the mounting portion 20.

(42) When inserting the wide ink cartridge 70W, insertion is difficult if a side surface different from the one surface (fourth surface CS4) provided with the upper protrusion portions 70E and the recessed grooves 70H is on the upper guide rib 27A and guiding portion 27B side, thus suppressing improper insertion of the ink cartridge 70W into the mounting portion 20.

Note that the above embodiment may be modified to obtain other embodiments such as the following.

In the ink container 80 of the above embodiment, it is not necessarily required that the filter chamber 60F is provided with the inclined surface 64*a* in which the cross-sectional area of the flow channel at a first position in the vicinity of the ink outflow opening 64H is larger than the cross-sectional area of the flow channel at a second position farther from the ink outflow opening 64H than the first position is. For example, if there is no need to slow down the flow of ink flowing out of the filter chamber 60F, the filter chamber 60F may be approximately cuboid with no inclined surface.

In the ink container 80 of the above embodiment, it is not necessarily required that the filter chamber 60F is provided with the rib 64*b* that serves a contact portion for contact with the filter 66 undergoing deformation. For example, the rib 64*b* is not necessary in the case where the filter 66 undergoes little deformation, or in the case where even if the filter 66 undergoes deformation, it does not become separated from the second supply member 61 and open the first opening portion 65, and the functionality of the filter chamber 60F is maintained.

In the ink container 80 of the above embodiment, the second supply member 61 may be provided with one protrusion portion among at least the protrusion portions 61A, 61B, and 61C. Also, one of the provided protrusion portions may be a protrusion portion formed by one projection rather than multiple projections. Alternatively, in the case where the pack body 91 does not undergo deformation or undergoes little deformation as the amount of ink in the ink chamber IS decreases for example, it is not necessarily required for the pack member 92 to be provided with the protrusion portions 61A, 61B, and 61C since there is a low probability of coming into contact with the second supply member 61.

In the ink container 80 of the above embodiment, in the case where replacement of the second supply member 61 is not necessary, if the second supply member 61 is formed so as to be integrated with the first supply member 81 (joining portion 82), there is not necessarily a requirement for a configuration in which the filter chamber 60F and the low pressure chamber 60D are detachably connected to the first supply member 81.

In the ink container 80 of the above embodiment, it is not necessarily required that the first opening portion 65, through which ink can flow into the filter chamber 60F via the filter 66, has a length in the vertical direction that is shorter than the length in a direction that intersects the vertical direction. For example, the first opening portion 65 may be square or rectangular with a long length in the vertical direction, depending on the shape of the pack body 91.

In the ink container 80 of the above embodiment, the low pressure chamber 60D may be formed such that at least a portion is overlapped with the filter chamber 60F in the projection direction in which the projected area of the filter chamber 60F is the largest.

In the ink container 80 of the above embodiment, it is not necessarily required that the filter chamber 60F and the low pressure chamber 60D are formed with a common member. For example, a configuration is possible in which the second supply member 61 is formed by two members divided in the thickness direction, which is the scanning direction, the filter chamber 60F is formed by one of the two divided members of the second supply member 61, and the low pressure chamber 60D is formed by the other one of the divided members.

In the ink container 80 of the above embodiment, it is not necessarily required that the second supply member 61 forming the low pressure chamber 60D is formed at a position that enables reduction of the percentage of gas dissolved in the ink in the filter chamber 60F. For example, there is no problem with the above configuration if there is a low probability of gas being dissolved in the ink flowing into the filter chamber 60F in the ink chamber IS.

In the ink container 80 of the above embodiment, it is not necessarily required that the filter chamber 60F and the low pressure chamber 60D are provided if the ink stored in the ink chamber IS is ink that contains few contaminants and little dissolved gas. One variation of this will be described below with reference to drawings.

Figure 31A:
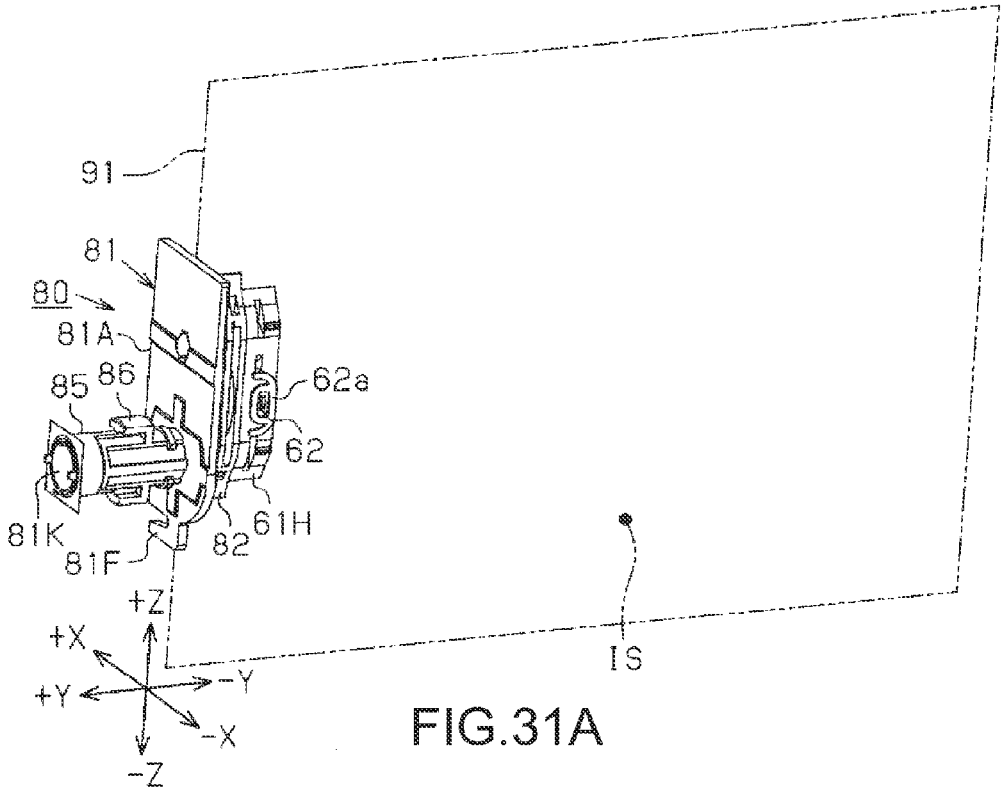
FIGS. 31A and 31B are diagrams showing a supply member that does not include the filter chamber or the low pressure chamber according to a variation, and specifically are perspective views of the supply member from mutually opposite sides.
Figure 31B:
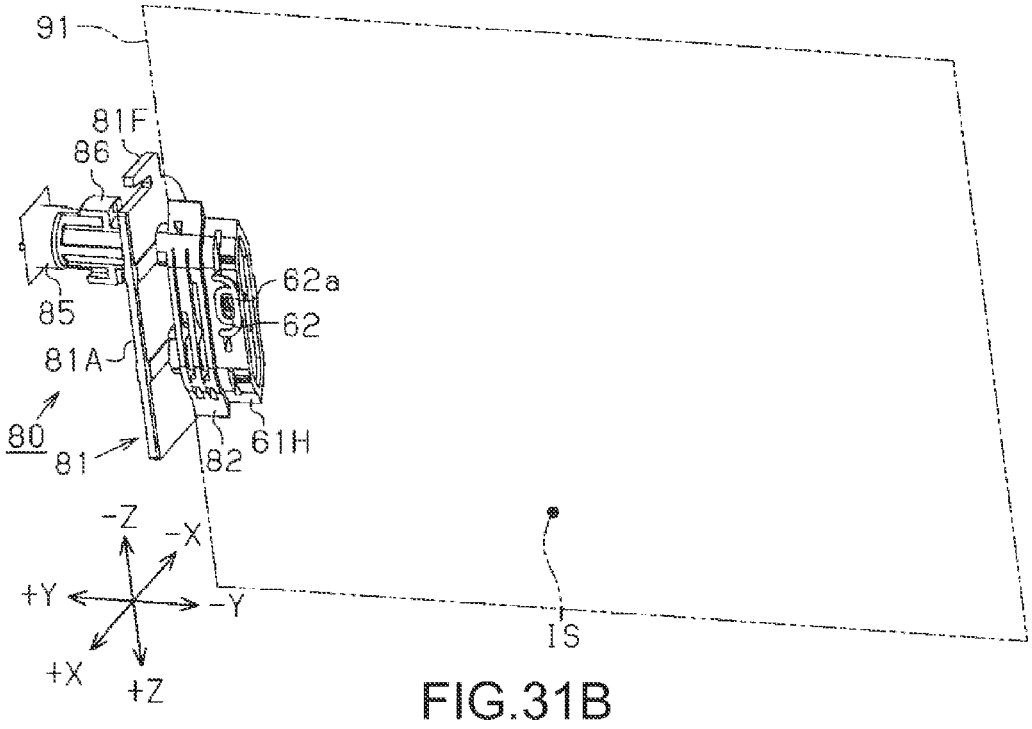

As shown in FIGS. 31A and 31B, in the ink container 80 of this variation, the ink chamber IS, which is the ink storage space, is formed by the first supply member 81 having the liquid supply opening 81K formed therein and the pack body 91 connected to the first supply member 81. Also, a second supply member 61H is provided on the ink chamber IS side of the joining portion 82, and the second supply member 61H is provided with an injection opening 62 for injecting ink into the ink chamber IS and includes a valve element 93 that serves as a check valve. Accordingly, the second supply member 61H is generally formed by cutting off the portion of the second supply member 61 of the above embodiment that forms the filter chamber 60F and the low pressure chamber 60D. Due to this shape, there is no need to change the shape of the first supply member 81, and it is easy to form the ink container 80 that is not provided with the filter chamber 60F or the low pressure chamber 60D. In other words, it is easy to manufacture ink containers 80 that have the same shape while including or not including the filter chamber 60F and the low pressure chamber 60D according to the type of ink that is to be stored.

In the ink container 80 of the above embodiment, if the communication opening 84 is at a location where it is exposed to the atmosphere and there is a low probability of being covered by a sheet or the like, it is not necessarily required that it is located on the +Y direction side of the first supply member 81 toward the mounting portion 20 of the printer 11. For example, it may be formed in a side surface of the base portion 81A.

In the ink container 80 of the above embodiment, it is not necessarily required that the communication opening 84 is located on the side in the counter-gravitational direction (+Z direction side), which is the vertical direction, relative to the liquid supply opening 81K in the state of being mounted to the mounting portion 20. For example, the communication opening 84 may be provided at any position on the member surface 81S of the base portion 81A in the case of a structure in which even if ink leaks out of the liquid supply opening 81K, the ink does not flow to the base portion 81A.

In the ink container 80 of the above embodiment, the width W1 of the step portion 81D in the vertical direction may be the same as the width W2 of the communication opening 84 in the vertical direction, or wider than the width W2. For example, if the step portion 81D is formed such that the step portion on the counter-gravitational direction (+Z direction side) of the step portion 81D is located within the width W2 of the communication opening 84, at least two step portions can be formed in the communication opening 84, thus making it possible to suppress blockage of the communication opening 84.

In the ink container 80 of the above embodiment, it is not necessarily required that the step portion 81D is located on the side in the gravitational direction, which is the vertical direction, of the communication opening 84 in the state of being mounted to the mounting portion 20. For example, if there is a low probability of foreign objects or the like attaching the step portion 81D, the step portion 81D may be located on the counter-gravitational direction side (+Z direction side) of the communication opening 84.

In the ink container 80 of the above embodiment, the member surface 81S of the first supply member 81 in which the communication opening 84 is formed does not need to be provided with the step portion 81D by which a step in the direction perpendicular to the member surface 81S is formed in at least a portion of the communication opening 84. For example, the step portion 81D does not need to be provided in this way if there is a low probability of blockage of the communication opening 84.

In the ink container 80 of the above embodiment, the step portion 81D of the first supply member 81 may be a groove provided in the member surface 81S.

Figure 32A:
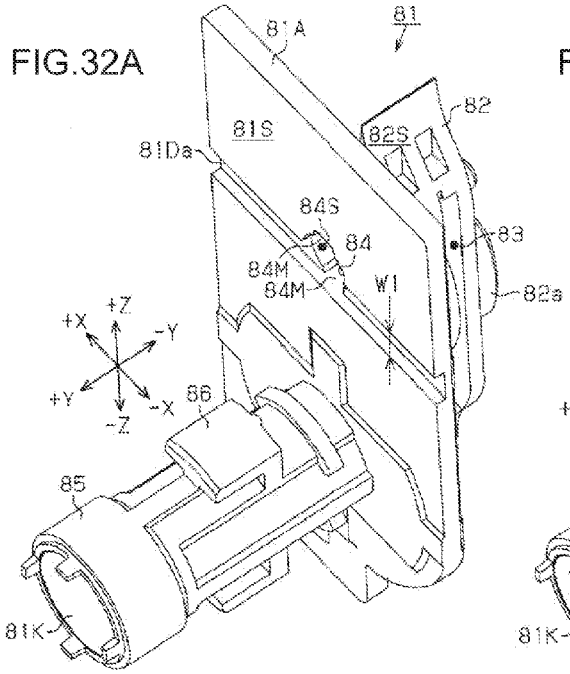
FIG. 32A is a perspective diagram showing a supply member according to a variation in which a groove that intersects the communication opening is formed.
Figure 32B:
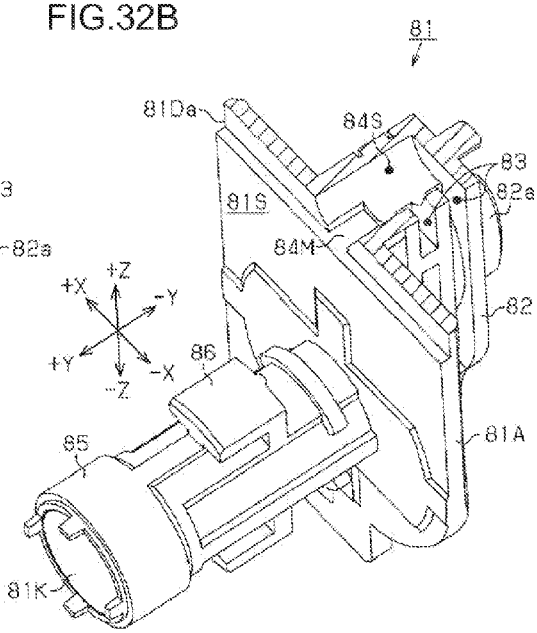
FIG. 32B is a perspective view of the supply member taken along the groove.

For example, as shown in FIGS. 32A and 32B, in this variation, a recessed groove that traverses the communication opening 84 and is in communication with the atmosphere is formed as a step portion 81Da in the member surface 81S of the base portion 81A of the first supply member 81. Accordingly, the step portion 81Da is in communication with the cylindrical space 84S. Also, in this variation, the recessed groove forming the step portion 81Da extends to the two end portions of the base portion 81A in the short-side direction, and even if the member surface 81S provided with the communication opening 84 is covered, the exposure of the communication opening 84 to the atmosphere can be maintained due to the openings formed in the end portions of the base portion 81A.

In the ink container 80 of the above embodiment, the shape of the communication opening 84 is not necessarily limited to being a polygon. For example, it may be a circle or an ellipse. Alternatively, it may have a boat shape similar to the joining portion 82. Any shape may be applied as long as it is a shape that can reduce the possibility of blockage of the communication opening 84.

In the ink cartridge 70 (70W) of the above embodiment, it is not necessarily required that the first supply member 81 of the ink container 80 is formed so as to be asymmetrical in a view in the direction of insertion in the first case member 71. For example, if the tubular flow channel portion 85 is formed in the center of the base portion 81A, there is no need to identify the insertion orientation of the first supply member 81 when the tubular flow channel portion 85 is inserted into the through-hole 75H, and therefore there is no problem if the base portion 81A has a symmetrical shape. Also, the base portion 81A may have a symmetrical shape if the first supply member 81 or the base portion 81A is provided with a shape or marking by which it is possible to identify the insertion orientation of the first supply member 81 when the tubular flow channel portion 85 is inserted into the through-hole 75H, such as a color portion or gate in molding.

In the ink cartridge 70 (70W) of the above embodiment, it is not necessarily required that the through-hole formation portion 75 is provided with the contact portion 76A that can come into contact with the base portion 81A in the insertion direction of the tubular flow channel portion 85. For example, if a marker indicating the amount of insertion of the tubular flow channel portion 85 is provided, and first supply member 81 is rotated when the tubular flow channel portion 85 has been inserted up to the marker, the first supply member 81 can be supported to the first case member 71.

In the ink cartridge 70 (70W) of the above embodiment, it is not necessarily required that the tubular flow channel portion 85 is provided with the engaged portions 86 by which movement of the first supply member 81 in the direction opposite to the direction of insertion into the through-hole 75H is restricted. For example, there is no need to provide the tubular flow channel portion 85 with the engaged portions 86 if the first supply member 81 is supported such that movement in the direction opposite to the direction of insertion into the first case member 71 is restricted by a portion of the first supply member 81 other than the tubular flow channel portion 85 when the tubular flow channel portion 85 has been rotated after insertion into the through-hole 75H. Note that in this case, it is preferable that the engaging portions for engagement with the engaged portions 86 provided on the through-hole formation portion 75 are formed on a portion of the first case member 71 other than the support portion 76.

In the ink cartridge 70 (70W) of the above embodiment, it is not necessarily required that with the first projection portion 71A and the second projection portion 71B serving as lock portions, the position at which the tubular flow channel portion 85 is rotated 90 degrees from the position inserted into the through-hole 75H is the position at which the first supply member 81 is locked by the lock portions. For example, an angle of 30 degrees, 45 degrees, or 60 degrees may be used, as long as long as it is an angle that serves as a rough standard when attaching the first supply member 81 to the first case member 71.

In the ink cartridge 70 (70W) of the above embodiment, it is not necessarily required that the first supply member 81 is provided with the L-shaped portion 81F that is provided with the claw portion 81Fa that can undergo deformation during locking to the first projection portion 71A and the second projection portion 71B. For example, a configuration is possible in which the L-shaped portion 81F does not undergo deformation, but rather the second projection portion 71B undergoes deformation (elastic deformation) so as to move out of the rotation locus of the L-shaped portion 81F.

In the ink cartridge 70 (70W) of the above embodiment, the first case member 71 does not need to be provided with the first projection portion 71A and the second projection portion 71B that, by locking the first supply member 81, restrict rotation of the tubular flow channel portion 85 when the tubular flow channel portion 85 is in the engaged state. For example, with a configuration in which rotation of the tubular flow channel portion 85 is restricted by engagement of the through-hole formation portion 75 and the second engaged portion 86B of the engaged portion 86, the first supply member 81 can be maintained in a state of being supported to the first case member 71.

In the ink cartridge 70 (70W) of the above embodiment, it is not necessarily required that the linking rib 70R serving as the second protrusion portion provided on the third surface CS3 is provided so as to configure part of the second surface CS2. One variation of this will be described below with reference to drawings.

Figure 33A:
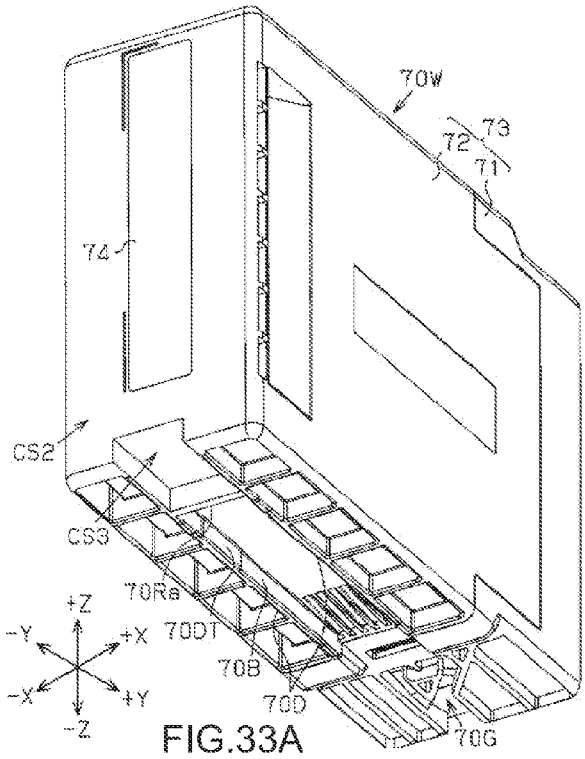
FIGS. 33A and 33B are perspective diagrams showing a variation of a protrusion portion that suppresses improper insertion of an ink cartridge into the mounting portion.

As shown in FIG. 33A, a linking rib 70Ra that links the pair of lower protrusion portions 70D at a position on the second surface CS2 side of the third surface CS3 of the ink cartridge 70W (70) may be formed as the second protrusion portion. According to this configuration, a rectangular notch portion is formed on the bottom surface side of the second surface CS2 in the ink cartridge 70W (70) in a view from the second surface CS2 side. Accordingly, the user can easily recognize the bottom surface and upper surface using this notch portion, thus suppressing improper insertion of the ink cartridge 70W (70) into the mounting portion 20.

Figure 33B:
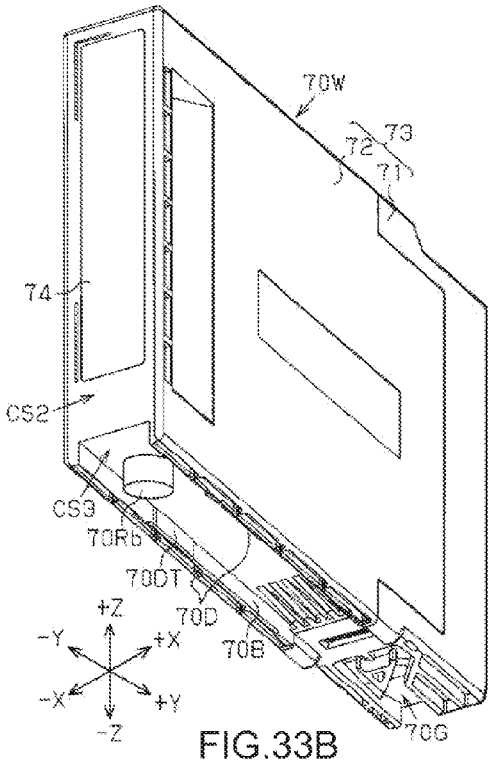

Alternatively, as shown in FIG. 33B, instead of a linking rib, a circular boss 70Rb that projects in the shape of a column may be formed at a position on the second surface CS2 side of the third surface CS3 of the ink cartridge 70 (70W) as the second protrusion portion. According to this configuration, a circular boss is formed on the bottom surface side of the second surface CS2 in the ink cartridge 70 (70W) in a view from the second surface CS2 side. Accordingly, the user can easily recognize the bottom surface and upper surface using this circular boss, thus suppressing improper insertion of the ink cartridge 70 (70W) into the mounting portion 20.

In the ink cartridge 70 (70W) of the above embodiment, it is not necessarily required that the protrusion portions 70C are configured by pair of lower protrusion portions 70D extending in the +Y direction and the projection portions 70P provided on the lower protrusion portions 70D. For example, the lower protrusion portions 70D may be formed with a short length in the +Y direction and caused to function as the protrusion portions.

In the ink cartridge 70 (70W) of the above embodiment, the first surface biased portion does not need to be located closer to the third surface CS3 than to the fourth surface CS4 on the first surface CS1. Conversely, it may be located closer to the fourth surface CS4, or may be located the same distance from the third surface CS3 and the fourth surface CS4.

In the ink cartridge 70 (70W) of the above embodiment, it is not necessarily required that the circuit board 30 is inclined relative to the +Y direction toward the mounting portion 20. For example, it may be oriented so as to be orthogonal to the +Y direction.

In the ink cartridge 70 (70W) of the above embodiment, it is not necessarily required that the first electrode 35, which is the electrical connection portion provided on the circuit board 30, is located between the protrusion portions 70C in a view in the +Y direction toward the mounting portion 20. It is preferable that the first electrode 35 is arranged in accordance with the position of the second electrode 34 on the mounting portion 20.

In the ink cartridge 70 (70W) of the above embodiment, it is not necessarily required that the liquid supply opening 81K is located between the protrusion portions 70C in a view in the +Y direction toward the mounting portion 20. It is preferable that it is arranged in accordance with the position of the supply needle 29 in the mounting portion 20.

In the ink cartridge 70 (70W) of the above embodiment, it is not necessarily required that the protrusion portions 70C provided on the third surface CS3 are located on the second surface CS2 side relative to the groove portion 70G, which is the third surface biased portion. For example, if the groove portion 70G is provided on the second surface CS2 side of the third surface CS3, it is preferable that the protrusion portions 70C are provided on the first surface CS1 side.

In the ink cartridge 70 (70W) of the above embodiment, it is not necessarily required that the protrusion portions 70C are provided on the third surface CS3. For example, the protrusion portions may be provided on the fourth surface CS4, or may be provided on both the third surface CS3 and the fourth surface CS4. In other words, it is sufficient that protrusion portions are provided in accordance with the direction in which the ink cartridge 70 (70W) is biased in the mounting portion 20.

In the ink cartridge 70 (70W) of the above embodiment, it is not necessarily required that the lower protrusion portions 70D are each provided with the two projection portions separated by an interval in the +Y direction. For example, each may be provided with one projection portion 70P, or provided with three or more projection portions 70P separated by intervals in the +Y direction. Note that if only one projection portion 70P is provided, it is preferable that the projection portion 70P is provided toward the second surface CS2 side, which is the side opposite to the +Y direction in the lower protrusion portion 70D.

In the ink cartridge 70W of the above embodiment, it is not necessarily required that the inner protrusion portions 70Ea and the recessed grooves 70H are provided on the same one fourth surface CS4. For example, a configuration is possible in which the inner protrusion portions 70Ea are provided in the fourth surface CS4, and the recessed grooves 70H are provided on the third surface side. In this case, the guiding portions 27B are provided on the bottom member 28 of the mounting portion 20.

In the ink cartridge 70 (70W) of the above embodiment, it is not necessarily required to provide the recessed grooves 70H for insertion of the guiding portions 27B provided on the mounting portion 20. For example, the guiding portions 27B are not necessary in a configuration in which an ink cartridge 70 is not inserted at the position of the ink cartridge 70W in the mounting portion 20. The recessed grooves 70H are not necessary in this case.

In the ink cartridge 70 (70W) of the above embodiment, it is not necessarily required that the fifth surface CS5 or the sixth surface CS6 is provided as a guide wall portion guided by the insertion guiding portions 27C provided on the mounting portion 20. For example, if the insertion guiding portions 27C are not necessary when inserting the ink cartridge 70 (70W) into the mounting portion 20, it is not necessary for the fifth surface CS5 or the sixth surface CS6 to be used a guide wall portion guided by the insertion guiding portions 27C in this way.

In the ink cartridge 70 (70W) of the above embodiment, the liquid supply opening 81K does not need to be arranged in the surface region R1 that intersects the extension region R3 of the third surface CS3 and the extension region R4 of the fourth surface CS4. It is preferable that the liquid supply opening 81K is arranged in accordance with the position of the supply needle 29 in the mounting portion 20.

In the ink cartridge 70 (70W) of the above embodiment, it is not necessarily required that the first electrode 35 is provided in the extension region R4, which is the extension in the +Y direction of the surface region sandwiched between the upper protruding wall portions 70ET, which are positioning portions. It is preferable that the first electrode 35 is arranged in accordance with the position of the second electrode 34 that serves as the electrical connection portion provided in the mounting portion 20 of the printer 11.

In the ink cartridge 70 (70W) of the above embodiment, it is not necessarily required that the groove portion 70G is provided in the extension region R3, which is the extension in the +Y direction of the surface region sandwiched between the lower protruding wall portions 70DT, which are positioning portions. It is preferable that the groove portion 70G is arranged in accordance with the lever member 52, which is the movable lock portion, provided in the mounting portion 20 of the printer 11.

In the ink cartridge 70 (70W) of the above embodiment, it is not necessarily required that the upper protruding wall portions 70ET or the lower protruding wall portions 70DT are located on the two sides of the upper guide ribs 27A or the lower guide ribs 28A when the ink cartridge 70 (70W) is mounted to the mounting portion 20. For example, as long as positioning is possible, the upper protruding wall portions 70ET or the lower protruding wall portions 70DT may be located on one side of the upper guide ribs 27A or one side of the lower guide ribs 28A respectively.

In the ink cartridge 70 (70W) of the above embodiment, it is not necessarily required that the upper protruding wall portions 70ET or the lower protruding wall portions 70DT are provided on the upper protrusion portions 70E (inner protrusion portions 70Ea) or the lower protrusion portions 70D. For example, the upper protruding wall portions 70ET or the lower protruding wall portions 70DT may be provided on the fourth surface CS4 or the third surface CS3 as portions different from the upper protrusion portions 70E (inner protrusion portions 70Ea) or lower protrusion portions 70D.

In the ink cartridge 70 (70W) of the above embodiment, it is not necessarily required that the upper protruding wall portions 70ET or the lower protruding wall portions 70DT position the ink cartridge 70 (70W) in a direction that intersects the +Y direction. For example, the upper protruding wall portions 70ET or the lower protruding wall portions 70DT may position the ink cartridge 70 (70W) in the +Y direction. With this configuration, even if variation occurs in the +Y direction position of the ink cartridge 70 (70W) locked by the movable lock portion (lever member 52), the ink cartridge 70 (70W) is stably positioned in the +Y direction relative to the mounting portion 20 by the upper protruding wall portions 70ET or the lower protruding wall portions 70DT.

In the ink cartridge 70 (70W) of the above embodiment, a configuration is possible in which at least either the upper protruding wall portions 70ET or the lower protruding wall portions 70DT are provided as positioning portions in the mounting portion 20.

In the above embodiment, it is not necessarily required that the rib portions 27T or the rib portions 28T are provided on the upper guide ribs 27A or the lower guide ribs 28A. Also, the belt-like rail surfaces 28C do not need to be provided on the bottom member 28 of the mounting portion 20.

In the above embodiment, the lower protruding wall portions 70DT do not need to be in a state of being engaged with the rib portions 28T of the lower guide ribs 28A when the ink cartridge 70W (70) has been pressed to the deepest position in the mounting portion 20. Alternatively, the rib portions 27T of the upper guide ribs 27A do not need to be in a state of being engaged with the upper protruding wall portions 70ET. A configuration is possible in which these engaged states are maintained at least in the mounted state.

In the above embodiment, in the ink cartridge 70, it is not necessarily required that the first electrode 35 is provided on the inclined surface 70K that is included in a direction that intersects the +Y direction toward the cartridge holding body 22. For example, the first electrode 35 may be provided on a side surface for which the +Y direction is the perpendicular direction (i.e., a side surface that extends in a direction perpendicular to the +Y direction).

In the above embodiment, it is not necessarily required that the first biasing member 48 is provided in the periphery of the supply needle 29, and it may be provided on the counter-gravitational direction side (+Z direction side) or gravitational direction side (−Z direction side) relative to the supply needle 29, for example.

In the above embodiment, the first biasing member 48 that biases the moving body 41 or the second biasing member 38 that biases the movable member 31 may be a member other than a coil spring, such as a U-shaped plate spring.

In the above embodiment, the number of ink cartridges 70 held in the cartridge holding body 22 is not necessarily limited to being four. Also, the position where the wide ink cartridge 70W is held is not necessarily limited to be the position farthest on the left side in the cartridge holding body 22.

In the above embodiment, the mounting portion 20 may be configured so as to be included on the outer side of the casing 11*a* of the printer 11. In the case where ink is supplied from the mounting portion 20 provided on the outside of the casing 11*a* to the liquid injection head 18 inside the casing 11*a*, the ink supply tube TB for supplying the ink needs to be drawn from the outside of the casing 11*a* to the inside. Accordingly, in this case, it is preferable that a hole or notch that allows insertion of the ink supply tube TB is provided in the casing 11*a*. Alternatively, the ink supply tube TB may be drawn from the outside of the casing 11*a* to the inside through a gap provided in the casing 11*a*. According to this configuration, ink can be easily supplied to the liquid injection head 18 using the ink flow channel in the ink supply tube TB.

The liquid injection head 18 is not limited to being of the so-called serial head type in which ink is ejected while moving back and forth along with the carriage 16 in a direction that intersects the sheet P conveying direction. Specifically, it may be of the so-called line head type in which it is shaped overall such that the length corresponds to the width of the sheet P, it is fixedly arranged such that the lengthwise direction conforms to the width direction of the sheet P that intersects the conveying direction, and a liquid is ejected toward the medium from a large number of nozzles provided so as to extend over substantially the entire length in the lengthwise direction.

In the above embodiment, the printer 11 may be a liquid consuming apparatus that ejects or discharges liquid other than ink. Note that examples of the state of liquid that is ejected as minuscule droplets from the liquid consuming apparatus include a spherical shape, a tear shape, and a shape having a thread-like trailing end. Furthermore, the liquid in this case may be any material that can be ejected from the liquid consuming apparatus. For example, the liquid may be any material that is in a liquid phase, and examples thereof include materials in a liquid state having high or low viscosity, sol, gel water, and other materials that flow, such as inorganic solvent, organic solvent, solution, liquid resin, liquid metal (metallic melt), and the like. Furthermore, the examples include not only liquid, as one state of materials, but also materials in which solvent contains dissolved, dispersed, or mixed particles of functional material made of a solid, such as pigments or metal particles. Typical examples of the liquid include ink as described in the foregoing embodiment, liquid crystal, and the like. Here, it is assumed that examples of the ink include various liquid state compositions such as commonly used water-based ink, oil-based ink, gel ink, and hot melt ink. Specific examples of the liquid consuming apparatus include liquid consuming apparatuses that eject liquid containing dispersed or dissolved materials such as electrode materials or coloring material used for producing liquid crystal displays, electro luminescence (EL) displays, field emission displays, color filters, and the like. The examples may further include liquid consuming apparatuses that eject bioorganic materials used to manufacture biochips, liquid consuming apparatuses that are used as precision pipettes and eject sample liquid, textile printing apparatus, micro-dispensers, and the like. The examples may further include liquid consuming apparatuses that eject lubricating oil for pinpoint application onto precision machines such as watches or cameras, liquid consuming apparatuses that eject transparent resin liquid such as ultraviolet curing resin onto a substrate in order to form minute hemispherical lenses (optical lenses) used for optical communications devices or the like. The examples may further include liquid consuming apparatuses that eject acidic or alkaline etching liquid in order to perform etching on a substrate or the like.

What is claimed is:

1. A liquid container having a liquid storage chamber configured to store a liquid, the liquid container being configured to be removably mounted to a mounting portion of a liquid consuming apparatus that includes a guide rail having a guide surface that guides insertion in an insertion direction and removal in a direction opposite the insertion direction of the liquid container and a movable lock portion that locks the liquid container to the mounting portion when the liquid container is inserted and mounted to the mounting portion, the liquid container comprising:

a first surface that has formed therein a liquid supply opening through which the liquid can flow from the liquid storage chamber to the liquid consuming apparatus, and is on a leading side in the insertion direction during insertion of the liquid container into the mounting portion;

a second surface that opposes the first surface;

a third surface that intersects the first surface and the second surface and has formed therein a groove portion configured to engage with the movable lock portion, the groove portion located closer to the first surface than to the second surface;

a fourth surface that opposes the third surface; and a positioning portion that is provided on the third surface at a location closer to the second surface than is the groove portion, and the positioning portion is configured and adapted to be positioned by the guide surface of the guide rail of the mounting portion when the liquid container is locked in place in the mounted condition by engagement of the groove portion with the movable lock portion due to the liquid container moving in the direction of insertion into the mounting portion and the portion of the third surface having the groove portion is closer to the fourth surface than is the portion of the third surface having the positioning portion.

2. The liquid container according to claim 1, wherein the positioning portion positions the liquid container in a direction that intersects the insertion direction.

3. The liquid container according to claim 1, further including:

a protrusion portion that has an opposing surface that opposes the guide surface of the guide rail when the liquid container is mounted to the mounting portion, wherein the positioning portion is provided on the protrusion portion.

4. The liquid container according to claim 1, wherein a plurality of positioning portions are arranged so as to be located at positions that sandwich the guide rail when the liquid container is mounted to the mounting portion.

5. The liquid container according to claim 4, wherein the positioning portions are provided on the third surface, and the groove portion is provided in an extension region that is an extension in the insertion direction of a surface region sandwiched by the positioning portions.

6. The liquid container according to claim 4, wherein the positioning portions are provided on the fourth surface, and an electrical connection portion that performs electrical connection with the liquid consuming apparatus is provided in an extension region that is an extension in the insertion direction of a surface region sandwiched by the positioning portions.

7. The liquid container according to claim 6, wherein the liquid supply opening is arranged in a surface region of the first surface, the surface region intersecting the extension region of the surface region sandwiched by the positioning portions provided on the third surface and the extension region sandwiched by the positioning portions provided on the fourth surface.

8. The liquid container according to claim 1, further including:

an extended surface that extends in a direction that intersects the first surface, the third surface, and the fourth surface, wherein the extended surface is provided with a guide wall portion that is guided by a guide projection provided on the mounting portion.

9. The liquid container according to claim 1, wherein the mounting portion of the liquid consuming apparatus is provided with a guide projection on each of two sides in an intersection direction that intersects the insertion direction of the liquid container relative to the guide rail, and the liquid container further includes:

a protrusion portion configured to be inserted between the guide rail and the guide projection and be guided by the guide rail when the liquid container is inserted into the mounting portion; and a recession portion that is provided on a side opposite to the guide rail in the intersection direction of the protrusion portion, and is configured to receive insertion of a guide projection when the liquid container is mounted to the mounting portion.

10. The liquid container according to claim 9, wherein the protrusion portion and the recession portion are provided on one surface.

11. The liquid container of claim 4, wherein the positioning portions and the groove portion are both on the third surface.

12. The liquid container of claim 11, wherein the groove portion has a groove portion opening adapted to receive the movable lock portion and the positioning portions are closer to the fifth or sixth surfaces than is the grove portion opening.

13. The liquid container of claim 6, wherein the positioning portions are also on the fourth surface and the groove portion is on the third surface.

* * * * *